US012458869B2

(12) United States Patent
Chiang

(10) Patent No.: US 12,458,869 B2
(45) Date of Patent: Nov. 4, 2025

(54) GAMEPLAY AREA SYSTEM

(71) Applicant: Heavy Play LLC, Burlingame, CA (US)

(72) Inventor: Randy Yang Chiang, Burlingame, CA (US)

(73) Assignee: HEAVY PLAY LLC, Burlingame, CA (US)

( * ) Notice: Subject to any disclaimer, the term of this patent is extended or adjusted under 35 U.S.C. 154(b) by 686 days.

(21) Appl. No.: 17/858,015

(22) Filed: Jul. 5, 2022

(65) Prior Publication Data

US 2023/0321522 A1 Oct. 12, 2023

Related U.S. Application Data

(60) Provisional application No. 63/329,865, filed on Apr. 11, 2022, provisional application No. 63/329,370, filed on Apr. 8, 2022.

(51) Int. Cl.
*A63F 3/00* (2006.01)

(52) U.S. Cl.
CPC ..... *A63F 3/0023* (2013.01)

(58) Field of Classification Search
CPC ..... A63F 3/0023; A63F 2003/00249; A63F 2003/00258; A63F 2003/0063; A63F 1/06; A63F 1/10; A63F 9/0495; A63F 1/062
See application file for complete search history.

(56) References Cited

U.S. PATENT DOCUMENTS 724,760 A 4/1903 Altena
734,092 A 7/1903 Reed
(Continued)

FOREIGN PATENT DOCUMENTS

CN 101711177 A 5/2010
CN 118946389 A 11/2024
(Continued)

OTHER PUBLICATIONS

Etsy—"MTG commander deck box, Magic the gathering commander deck box's with optional travel case"—Downloaded on Oct. 26, 2023—Available from Internet <URL: https://www.etsy.com/listing/1410337351/mtg-commander-deck-box-magic-the?gpla=1&gao=1& >.
(Continued)

*Primary Examiner* — Jay Trent Liddle
(74) *Attorney, Agent, or Firm* — Gallium Law; Jacob Panangat; Justin Schwechter

(57) ABSTRACT

In some examples, a gameplay area system comprises a playmat including a middle section. The playmat may comprise a first side section rotatably coupled to the middle section enabling the first side section to fold over the middle section, the first side section comprising at least one closing magnet. According to some examples, the playmat comprises a second side section rotatably coupled to the middle section opposite the first side section, enabling the second side section to fold over the middle section and the first side section. The second side section may comprise at least one mat magnet. The at least one mat magnet may be configured to magnetically couple to the at least one closing magnet while the first side section is folded over the middle section and while the second side section is folded over the middle section and the first side section.

20 Claims, 57 Drawing Sheets

(56) References Cited

U.S. PATENT DOCUMENTS

| | | | | | |
|---|---|---|---|---|---|
| 1,121,949 | A * | 12/1914 | Surmann | B65D 5/566 | 229/152 |
| 2,600,951 | A | 6/1952 | Edwards | | |
| 3,652,086 | A * | 3/1972 | Stecker | A63F 9/0402 | 273/148 R |
| 5,100,151 | A | 3/1992 | Lyon et al. | | |
| 5,244,212 | A | 9/1993 | Bendit | | |
| 5,255,923 | A * | 10/1993 | Bennett | A63F 3/0023 | 273/287 |
| 6,203,017 | B1 | 3/2001 | Schultz | | |
| 6,254,097 | B1 | 7/2001 | Larner | | |
| 8,833,769 | B1 | 9/2014 | Hilvitz | | |
| 8,974,295 | B2 | 3/2015 | Maharbiz et al. | | |
| 9,061,196 | B2 | 6/2015 | Kingsley | | |
| 10,894,201 | B2 | 1/2021 | Botha et al. | | |
| 11,351,442 | B1 * | 6/2022 | Pickens | A63F 1/067 | |
| 2002/0105143 | A1 | 8/2002 | Elliot et al. | | |
| 2004/0051248 | A1 * | 3/2004 | Griesse | A63F 3/0023 | 273/284 |
| 2005/0252422 | A1 * | 11/2005 | Sharpe | A47B 3/00 | 108/35 |
| 2007/0063004 | A1 * | 3/2007 | Weinberg | B65D 21/0208 | 229/120.01 |
| 2007/0216095 | A1 | 9/2007 | Jacobs | | |
| 2007/0235929 | A1 | 10/2007 | Nip | | |
| 2016/0166920 | A1 * | 6/2016 | Reiher | A63F 3/0023 | 273/284 |
| 2018/0178112 | A1 | 6/2018 | Guarino | | |
| 2018/0251266 | A1 | 9/2018 | Schilf et al. | | |
| 2019/0076729 | A1 | 3/2019 | Olson | | |
| 2021/0387079 | A1 * | 12/2021 | Rosendahl | A63F 1/10 | |
| 2023/0277918 | A1 * | 9/2023 | Alonso Perez | B65D 81/36 | 273/285 |

FOREIGN PATENT DOCUMENTS

| | | | |
|---|---|---|---|
| DE | 202019106389 | U1 | 12/2019 |
| FR | 2383583 | A7 | 10/1978 |
| JP | 1973013181 | U | 2/1973 |
| JP | 3178068 | U | 8/2012 |
| KR | 200469148 | Y1 | 9/2013 |
| KR | 102029769 | B1 | 11/2019 |
| WO | 2005060353 | A2 | 7/2005 |
| WO | 2017098276 | A1 | 6/2017 |

OTHER PUBLICATIONS

Etsy—"Commander / EDH Deck Box for Magic: The Gathering with Token and General Compartment"—Downloaded on Oct. 26, 2023—Available from Internet <URL: https://www.etsy.com/listing/1413708412/commander-edh-deck-box-for-magic-the?gpla=1&gao=1& >.

Tolarian Community College—"Innovative New Playmats For Magic: The Gathering, Pokémon TCG: Gamegenic, Duelist, Windward, Nomad"—First Available Oct. 4, 2020—Available as of at least Mar. 30, 2022—Available on Internet <URL: https://www.youtube.com/watch?v=oxbkWpgG5gY&t=296s>.

Dragon Shield—"Nomad—Black—Outdoor & Travel Playmat"—Available as of at least Mar. 30, 2022—Available on Internet <URL: https://www.dragonshield.com/webshop/other-gaming-accessories/331-nomad-blackblack.html>.

Dektech—"Dektech—TCG Deck Box—Titans"—Available as of at least Mar. 30, 2022—Available from Internet <URL: https://gemaccessoriesus.com/product/dektech-tcg-deck-box-titans/>.

Gamegenic—"Sidekick 100+ XL Convertible"—Available as of at least Mar. 30, 2022—Available from Internet <URL: https://www.gamegenic.com/product/sidekick-100-xl-convertible/ >.

Gamescape North—"Folding Magnetic Dice Trays"—Available as of at least Mar. 30, 2022—Available from Internet <URL: https://www.gamescape-north.com/folding-magnetic-dice-tray.html >.

Ultimate Guard—"Sidewinder 100+ XenoSkin"—Available as of at least Mar. 30, 2022—Available from Internet <URL: https://ultimateguard.com/en/Boxes/Sidewinder-Xenoskin/UGD011215/ >.

Ultimate Guard—"Boulder 100+ Deck Case"—Available as of at least Mar. 30, 2022—Available from Internet <URL: https://ultimateguard.com/en/Boxes/Boulder/UGD010846/ >.

Ultimate Guard—"Twin Flip'N'tray Xenoskin"—Available as of at least Mar. 30, 2022—Available from Internet <URL: https://ultimateguard.com/en/Boxes/Twin-Flip-n-Tray-Xenoskin/UGD010849/>.

Ultimate Guard—"Arkhive Xenoskin"—Available as of at least Mar. 30, 2022—Available from Internet <URL: https://ultimateguard.com/en/Boxes/Arkhive-Xenoskin/UGD011139/>.

10XBETA—"DEALN Kickstarter"—Available Nov. 9, 2016—Available from Internet <URL: https://vimeo.com/190871343 >.

Ultimate Guard—"Play-Mat"—Available as of at least Aug. 11, 2022—Available from Internet <URL: https://ultimateguard.com/en/Play-Mats/Play-Mat/UGD010194/>.

Ultra Pro—"Solid Color Standard Gaming Playmat Mousepad"—Available as of at least Aug. 11, 2022—Available from Internet <URL: https://ultrapro.com/products/solid-color-standard-gaming-playmat-mousepad >.

Dragon Shield—"Black/Black—Magic Carpet XL"—Available as of at least Aug. 11, 2022—Available from Internet <URL: https://www.dragonshield.com/webshop/us/other-gaming-accessories/198-magic-carpet-xl-blackblack.html >.

Inked Gaming—"Standard Colors Playmat"—Available as of at least Aug. 11, 2022—Available from Internet <URL: https://www.inkedgaming.com/products/standard-colors-playmat >.

Heavy Play—"Card Gaming Equipment Heavy Play"—Available from Internet <URL: https://web.archive.org/web/20221222051230/https://heavyplay.com/>.

Heavy Play—"EquipMAG System CURV Sleeves Kickstarter Youtube"—Available from Internet <URL: https://www.youtube.com/watch?v=IKBp1eZDyWY>.

Heavy Play—"Heavy Play // RFG Deckbox MAX + RNG Dicebox MAX"—Available from Internet <https://www.youtube.com/watch?v=knltwe_bPBw>.

* cited by examiner

GAMEPLAY AREA SYSTEM

BACKGROUND

Field

The present disclosure relates to containment systems and playable surfaces, particularly for cards such as playing cards and dice.

Description of Related Art

In card games, such as Magic: The Gathering or Pokémon, players pit their cards against one another in games of combat and strategy. Often, players will use a playmat to place their cards upon. These playmats may allow easier sliding of the cards across its surface than a surface such as that of a table, and may help protect the cards from anything that may be on the table at which the players are sitting. For this reason, many playmats include some type of slidable, cloth top, and some type of rubber bottom to prevent the playmat from sliding on the surface on which it is placed.

Many times, these games include multiple components in addition to the cards. Some games use tokens, counters, or dice. Each of these individual components are carried separately by a user, in addition to the playmat that they also must carry around. In tournament settings especially, a player might find themselves moving their kit (i.e., playmat, deck-boxes, dice-boxes) multiple times in a short duration as they compete against multiple other people at multiple locations. The solutions provided to facilitate the transport of all of this gear are minimal at best, and current solutions in the prior art have problems which will be explored more thoroughly in this disclosure.

SUMMARY

The present disclosure describes systems and techniques for facilitating the carrying of a general gameplay area system. The system may include separate subcomponents that are used in conjunction or separately based on the needs of the user.

In some examples, a gameplay area system comprises a playmat. According to some examples, the playmat comprises a middle section. The playmat may comprise a first side section rotatably coupled to the middle section enabling the first side section to fold over the middle section, the first side section comprising at least one closing magnet. In some examples, the playmat comprises a second side section rotatably coupled to the middle section opposite the first side section, enabling the second side section to fold over the middle section and the first side section. According to some examples, the second side section comprises at least one mat magnet. The at least one mat magnet may be configured to magnetically couple to the at least one closing magnet while the first side section is folded over the middle section and while the second side section is folded over the middle section and the first side section. In some examples, when the playmat lays in an open position, the playmat comprises a top surface and a bottom surface opposite the top surface.

According to some examples, the second side section is smaller in width than the middle section and the first side section.

The gameplay area system may comprise a folding deck box sized to retain at least one playing card. In some examples, the folding deck box comprises a bottom wall. According to some examples, the folding deck box comprises a left side wall coupled to the bottom wall, the left side wall substantially perpendicular to the bottom wall. The folding deck box may comprise a right side wall coupled to the bottom wall, the right side wall substantially perpendicular to the bottom wall, and the right side wall opposite the left side wall. In some examples, the folding deck box comprises a back wall coupled to the bottom wall, the left side wall, and the right side wall, the back wall substantially perpendicular to the bottom wall, the left side wall, and the right side wall. According to some examples, the folding deck box comprises at least one back magnet disposed within the back wall, the at least one back magnet configured to magnetically couple to a corresponding at least one mat magnet. The folding deck box may comprise a front wall coupled to the bottom wall, the left side wall, and the right side wall, the front wall partially perpendicular to the bottom wall, the left side wall, and the right side wall, and the front wall opposite the back wall.

In some examples, the folding deck box comprises a flap. The flap may comprise a bottom portion rotatably coupled to the back wall. According to some examples, the flap comprises a top portion rotatably coupled to the back portion. The flap may comprise a front portion rotatably coupled to the top portion. In some examples, the flap comprises a bottom portion rotatably coupled to the front portion opposite the top portion.

According to some examples, the folding deck box comprises at least one flap magnet disposed within the bottom portion. The folding deck box may comprise at least one bottom magnet disposed within the bottom wall equal in amount to the at least one flap magnet, wherein each at least one flap magnet is configured to magnetically couple to a corresponding at least one bottom magnet.

In some examples, the front portion of the flap comprises a feature selected from the group consisting of a window, optical translucency, optical transparency, and optical opacity.

According to some examples, the gameplay area system comprises a two-piece deck box sized to retain at least one playing card. The two-piece deck box may comprise a top section. In some examples, the top section comprises a top wall. According to some examples, the top section comprises a top section front wall coupled to the top wall, the top section front wall substantially perpendicular to the top wall. The top section may comprise a top section back wall coupled to the top wall, the back wall substantially perpendicular to the top wall, wherein the top section back wall is substantially parallel to the top section front wall. In some examples, the top section comprises a first top section side wall coupled to the top wall, the top section front wall, and the top section back wall, the first top section side wall substantially perpendicular to the top wall, the top section front wall, and the top section back wall. According to some examples, the top section comprises a second top section side wall coupled to the top wall, the top section front wall, and the top section back wall, the second top section side wall substantially perpendicular to the top wall, the top section front wall, and the top section back wall, wherein the second top section side wall is substantially parallel to the first top section side wall.

At least one top magnet may be disposed within a wall selected from the group consisting of the top section front wall, the top section back wall, the first top section side wall, and the second top section side wall. In some examples, the at least one top magnet is configured to magnetically couple to at least one mat magnet.

According to some examples, the two-piece deck box comprises a bottom section. The bottom section may comprise a bottom wall. In some examples, the bottom section comprises a bottom section front wall coupled to the bottom wall, the bottom section front wall substantially perpendicular to the top wall. According to some examples, the bottom section comprises a bottom section back wall coupled to the bottom wall, the bottom section back wall substantially perpendicular to the bottom wall, wherein the bottom section back wall is substantially parallel to the bottom section front wall. The bottom section may comprise a first bottom section side wall coupled to the bottom wall, the bottom section front wall, and the bottom section back wall, the first bottom section side wall substantially perpendicular to the bottom wall, the bottom section front wall, and the bottom section back wall. In some examples, the bottom section comprises a second bottom section side wall coupled to the bottom wall, the bottom section front wall, and the bottom section back wall, the second bottom section side wall substantially perpendicular to the bottom wall, the bottom section front wall, and the bottom section back wall, wherein the second bottom section side wall is substantially parallel to the first bottom section side wall.

According to some examples, at least one bottom magnet is disposed within a wall selected from the group consisting of the bottom section front wall, the bottom section back wall, the first bottom section side wall, and the second bottom section side wall. The at least one bottom magnet may be configured to magnetically couple to at least one mat magnet.

In some examples, the top section is configured to detachably couple to the bottom section. According to some examples, the bottom section front wall further comprises a bottom section front inset lip. The bottom section back wall may further comprise a bottom section back inset lip. In some examples, the first bottom section side wall further comprises a first bottom section side inset lip. According to some examples, the second bottom section side wall further comprises a second bottom section side inset lip.

The top section front wall may be configured to receive the bottom section front inset lip. In some examples, the top section back wall is configured to receive the bottom section back inset lip. According to some examples, the first top section side wall is configured to receive the first bottom section inset lip. The second top section side wall may be configured to receive the second bottom section inset lip.

In some examples, inset lip selected from the group consisting of the bottom section front inset lip, the bottom section back inset lip, the first bottom section side inset lip, and the second bottom section side inset lip further comprises a male snap fixture. According to some examples, a wall selected from the top section front wall, the top section back wall, the first top section side wall, and the second top section side wall further comprises a female snap fixture configured to receive the male snap fixture in a corresponding location.

The gameplay area system may comprise a dice-box size to retain at least one die. In some examples, the dice-box comprises an inner compartment. According to some examples, the inner compartment comprises an inner bottom wall. The inner compartment may comprise an inner front wall coupled to the inner bottom wall, the inner front wall substantially perpendicular to the inner bottom wall. In some examples, the inner compartment comprises an inner back wall coupled to the inner bottom wall opposite the inner front wall, the inner back wall substantially perpendicular to the inner bottom wall. According to some examples, the inner compartment comprises a first inner side wall coupled to the inner bottom wall, the inner front wall, and the inner back wall, the first inner side wall substantially perpendicular to the inner bottom wall, the inner front wall, and the inner back wall. The inner compartment may comprise a second inner side wall coupled to the inner bottom wall, the inner front wall opposite the first inner side wall, and the inner back wall opposite the first inner side wall, the second inner side wall substantially perpendicular to the inner bottom wall, the inner front wall, and the inner back wall.

In some examples, the dice-box comprises an outer compartment sized to retain the inner compartment. According to some examples, the outer compartment comprises an outer bottom wall. The outer bottom wall may comprise at least one outer bottom magnet disposed within the outer bottom wall, the at least one outer bottom magnet configured to couple to at least one mat magnet. In some examples, the outer compartment comprises a first outer side wall coupled to the outer bottom wall and the outer back wall, the first outer side wall substantially perpendicular to the outer bottom wall and the outer back wall. According to some examples, the outer compartment comprises a second outer side wall coupled to the outer bottom wall opposite the first outer side wall and the outer back wall opposite the first outer side wall, the second outer side wall substantially perpendicular to the outer bottom wall and the outer back wall. The outer compartment may comprise an outer top wall coupled to the outer back wall opposite the outer bottom wall, the first outer side wall opposite the outer bottom wall, and the second outer side wall opposite the outer bottom wall, the outer top wall substantially perpendicular to the outer back wall, the first outer side wall, and the second outer side wall.

In some examples, the inner bottom wall further comprises at least one inner bottom magnet configured to magnetically couple to the at least one outer bottom magnet. According to some examples, the outer top wall further comprises at least one outer top magnet configured to magnetically couple to at least one mat magnet.

The dice-box may further comprise at least one insert configured to slide into the inner compartment, the at least one insert configured to divide a space of the inner compartment into at least two distinct spaces.

In some examples, the bottom surface comprises a rubber-type backer configured to prevent the playmat from slipping from a surface. According to some examples, the top surface comprises a cloth-type surface configured to facilitate sliding of an object across the top surface.

The at least one mat magnet may cover at least a portion of an edge of the second side section. In some examples, the at least one closing magnet covers at least a portion an edge of the first side section.

Also included is an additional disclosure for another gameplay area system. In some examples, the gameplay area system comprises a playmat. According to some examples, the playmat comprises a first section comprising at least one closing magnet. The playmat may comprise a second section rotatably coupled to the first section enabling the second section to fold over the first section, the second section comprising at least one mat magnet. In some examples, at least one mat magnet is configured to magnetically couple to the at least one closing magnet while the second section is folded over the first section. According to some examples, when the playmat lays in an open position, the playmat comprises a top surface and a bottom surface opposite the top surface.

The at least one mat magnet may cover at least a portion of an edge of the first section. In some examples, the at least one closing magnet covers at least a portion of an edge of the second section.

Also included is another additional disclosure for another gameplay area system. In some examples, the gameplay area system comprises a playmat. According to some examples, the playmat comprises a first section. The playmat may comprise a second section rotatably coupled to the first section enabling the second section to fold with respect to the first section. In some examples, the playmat comprises a third section rotatably coupled to the second section enabling the third section to fold with respect to the second section. According to some examples, the playmat comprises a fourth section rotatably coupled to the third section enabling the fourth section to fold with respect to the third section. A section selected from the group consisting of the first section, the second section, the third section, and the fourth section may comprise at least one closing magnet. In some examples, a section selected from the group consisting of the first section, the second section, the third section, and the fourth section comprises at least one mat magnet. According to some examples, the section comprising the at least one closing magnet and the section comprising the at least one mat magnet are different. The at least one mat magnet may be configured to magnetically couple to the at least one closing magnet while the first section, the second section, the third section, and the fourth section are in a folded configuration. In some examples, when the playmat lays in an open position, the playmat comprises a top surface and a bottom surface opposite the top surface.

According to some examples, the at least one mat magnet covers at least a portion of an edge of the mat section. The at least one closing magnet may cover at least a portion of an edge of the closing section.

COMPONENT INDEX

Figure 1:
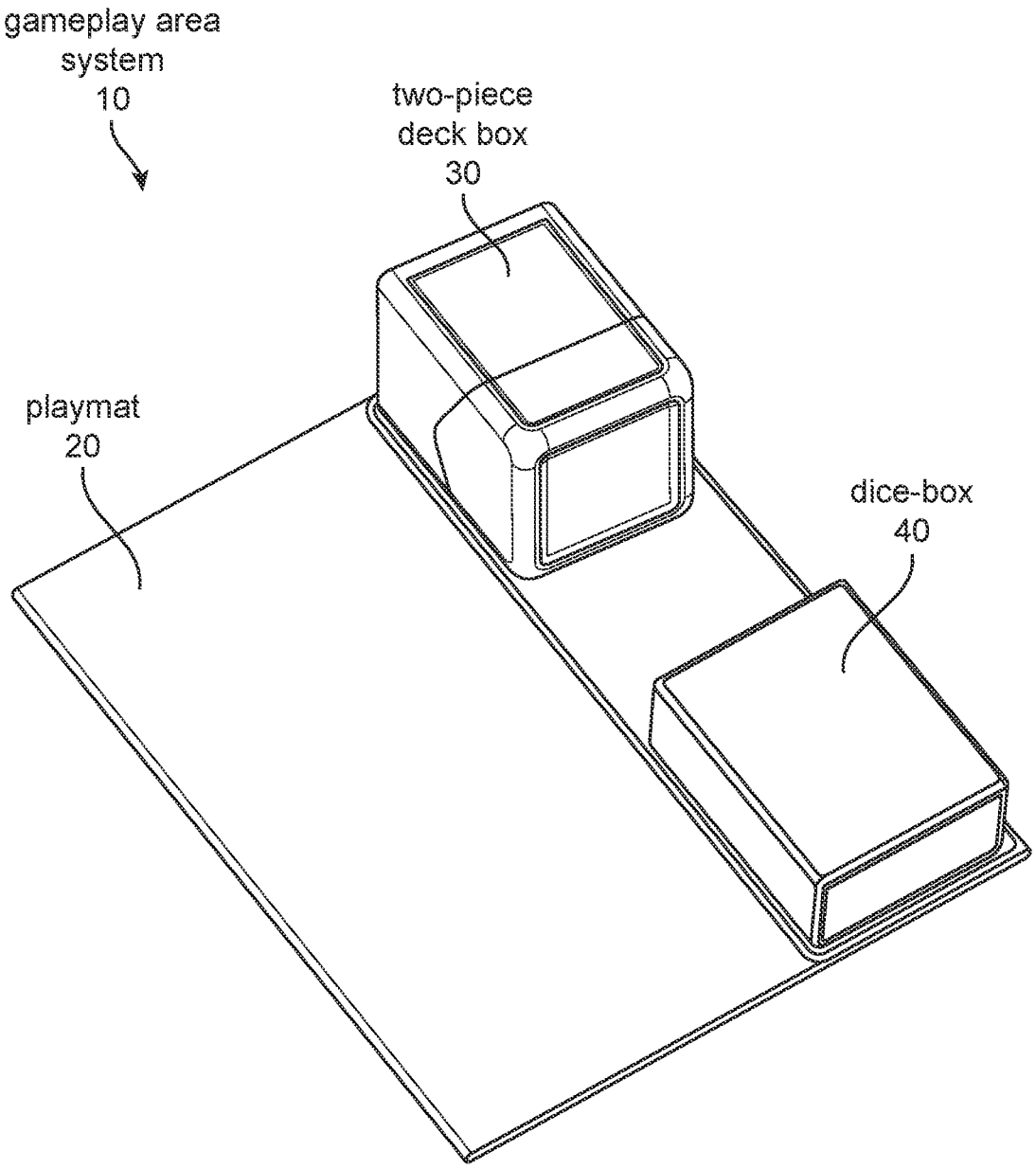
FIG. 1 illustrates a perspective view of an exemplary gameplay area system including a playmat, a two-piece deck box, and a dice-box.

10—Gameplay area system
20—Playmat
20*a*—Playmat
20*b*—Playmat
20*c*—Playmat
20*d*—Playmat
20*e*—Playmat
20*f*—Playmat
20*g*—Playmat
30—Two-piece deck box
40—Dice-box
40*a*—Dice-box
40*b*—Dice-box
50—Folding deck box
60—Playing card
70—Dice
202—Top surface
204—Cloth-type surface
302—Bottom surface
304—Rubber-type backer
306—Middle section
308—First side section
310—Second side section
312—At least one closing magnet
314—At least one mat magnet
602—Top section
604—Bottom section
606—Bottom section front inset lip
608—Bottom section back inset lip
610—First bottom section side inset lip
612—Second bottom section side inset lip
614—Male snap fixture
616—Female snap fixture
618—At least one top magnet
620—At least one bottom magnet
622—Arrow
624—At least one magnet
802—Top wall
804—Top section front wall
806—Top section back wall
808—First top section side
810—Second top section side
812—Bottom wall
814—Bottom section front wall
816—Bottom section back wall
818—First bottom section side wall
820—Second bottom section side wall
1002—Inner compartment
1004—Outer compartment
1006—Outer bottom wall
1008—Outer top wall
1010—First outer side wall
1012—Second outer side wall
1014—At least one outer top magnet
1102—Inner bottom wall
1104—Inner front wall
1106—Inner back wall
1108—First inner side wall
1110—Second inner side wall
1112—At least one outer bottom magnet
1114—At least one inner bottom magnet
1202—Insert
1402—Bottom wall
1404—Left side wall
1406—Right side wall
1408—Back wall
1410—Front wall
1412—Flap
1414—Finger slot
1416—Front wall window
1502—Back portion
1504—Top portion
1506—Front portion
1508—Bottom portion
1510—Front portion window
1702—At least one bottom magnet
1704—At least one flap magnet
1802—Back magnet
2002—First section
2004—Second section
2202—First section
2202*a*—First section
2202*b*—First section
2202*c*—First section
2204—Second section
2204*a*—Second section
2204*b*—Second section
2204*c*—Second section
2206—Third Section
2206*a*—Third section
2206*b*—Third section
2206*c*—Third section
2208—Fourth section
2208*a*—Fourth section
2208*b*—Fourth section
2208*c*—Fourth section
2602—Middle section
2604—First side section
2606—Second side section
2802—Middle section
2804—First side section
2806—Second side section

DETAILED DESCRIPTION

Playmats for card games are and have been for quite some time, essentially large mousepads. These playmats in the prior art tend to have neoprene backers and polyester top surfaces and are transported or stored through rolling the mat up and either carrying it as is, or placing the rolled up playmat into a tube. This is cumbersome and makes it difficult when players need to move frequently between tables, such as in a tournament-type setting. Variations in the appearance of the playmat, such as through licensed artwork, are common in the playmat field, but no great improvements have been made to the structure of the playmat itself.

Throughout the disclosure, multiple variations of magnets are shown and presented. It is understood that, as long as one magnet is present, other materials with magnetic properties, such as steel, may be used. For instance, in some examples, the playmat 20 is shown and described as having at least one mat magnet 314, and the two-piece deck box is shown and described as having at least one magnet 624. If the at least one magnet 624 were replaced with similarly sized pieces of steel, the invention described herein would remain fully functional. It is additionally understood, however, that every magnet that is replaced with a different material that simply has magnetic characteristics will create a weaker magnetic coupling than using magnets throughout the invention.

FIG. 1 illustrates a perspective view of an exemplary gameplay area system 10, including a playmat 20, a two-piece deck box 30, and a dice-box 40. The playmat 20 is described in greater detail in FIGS. 2, 3, 4A, 4B, 4C, 5A, 5B, 20A, 20B, 21, 22A, 22B, 23A, 23B, 24A, 24B, and 25. The two-piece deck box 30 is described in greater detail in FIGS. 6, 7, 8A, 8B, and 9. The dice-box 40 is described in greater detail in FIGS. 10A, 10B, 11A, 11B, 12, and 13. While not shown in FIG. 1, a folding deck box 50 may also be included in the gameplay areas system 10. The folding deck box is described in greater detail in FIGS. 14A, 14B, 15A, 15B, 16, 17A, 17B, 18, and 19.

Generally, the gameplay area system 10 features multiple magnets disposed through the independent elements of the playmat 20, the two-piece deck box 30, the dice-box 40, and the folding deck box 50. These magnets allow for modular construction and coupling of each of these independent elements to one another. As such, when the gameplay area system 10 is placed together so that all elements are magnetically coupled to at least one other element, the entire gameplay area system 10 may easily be transported between locations while mitigating the risk of any of the independent elements falling or being left behind accidentally.

Figure 2:
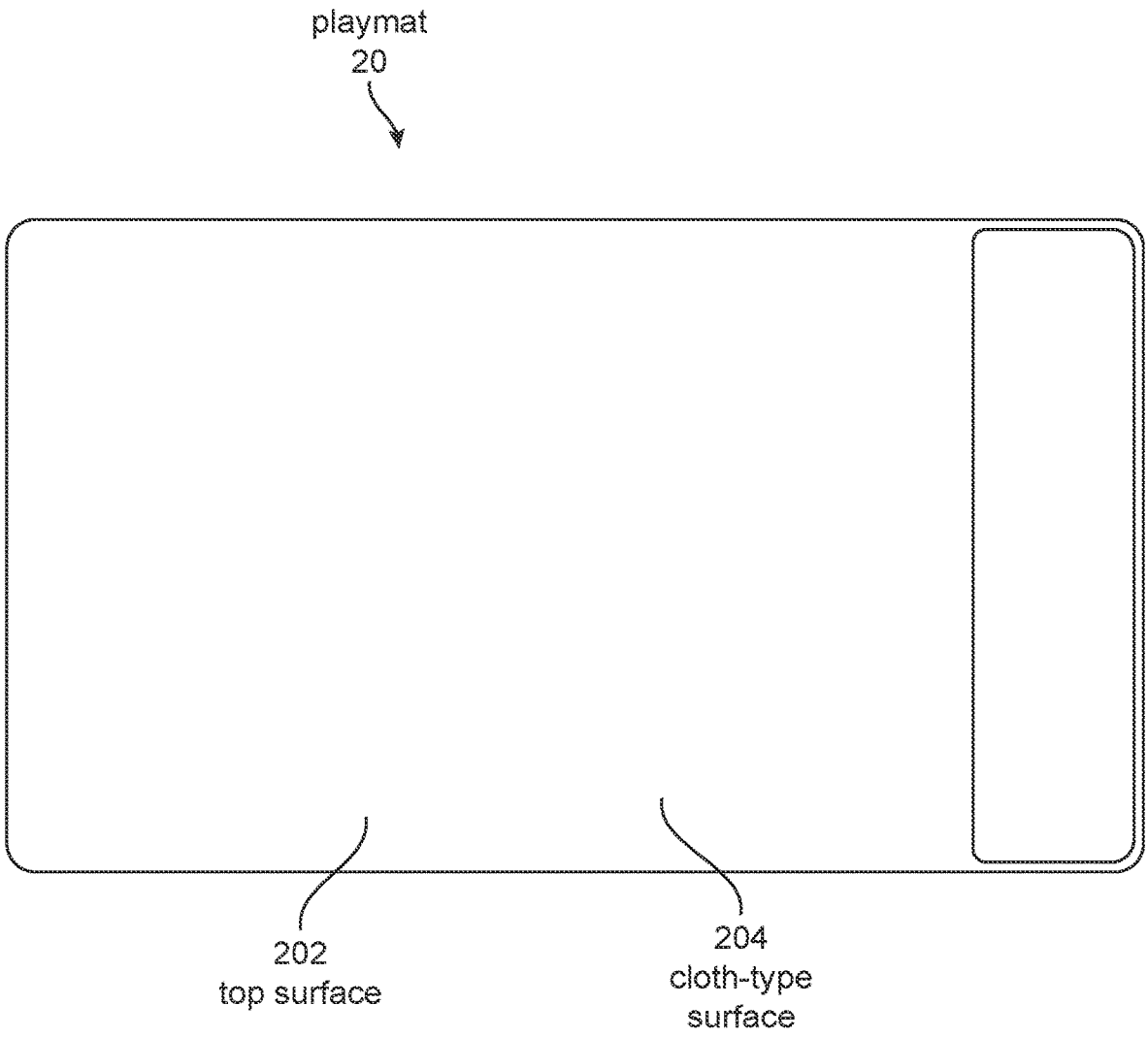
FIG. 2 illustrates a top view of a playmat, according to some examples.

FIG. 2 illustrates a top view of an exemplary playmat 20. As can be seen in this front view, the playmat includes a top surface 202 when laid out flat. This top surface 202 may comprise a cloth-type surface 204. This cloth-type surface 204 facilitates the sliding of cards across the surface.

Exemplary dimensions for an open playmat 20 include a width of about 610 millimeters and a height of about 350 millimeters. Some games require larger play surfaces, so larger variants may be included without adjusting the height. An example of such a variant, perhaps called a "wide" or an "XL" playmat 20, includes a width of about 800 millimeters and a height of about 350 millimeters.

Additionally, there is the potential for playmats 20 capable of being played upon by more than one person at a time. A "two-player" playmat 20 may include a width of about 610 millimeters (similar to the exemplary standard playmat 20 described above) and a height of somewhere between about 610 millimeters and about 750 millimeters. This height may allow multiple players to play at the same time without interfering with one another.

It is understood throughout this disclosure that any playmat 20 disclosed may have any of these dimensions, or any dimensions not specifically detailed above, without affecting the performance of the playmat 20.

Figure 3:
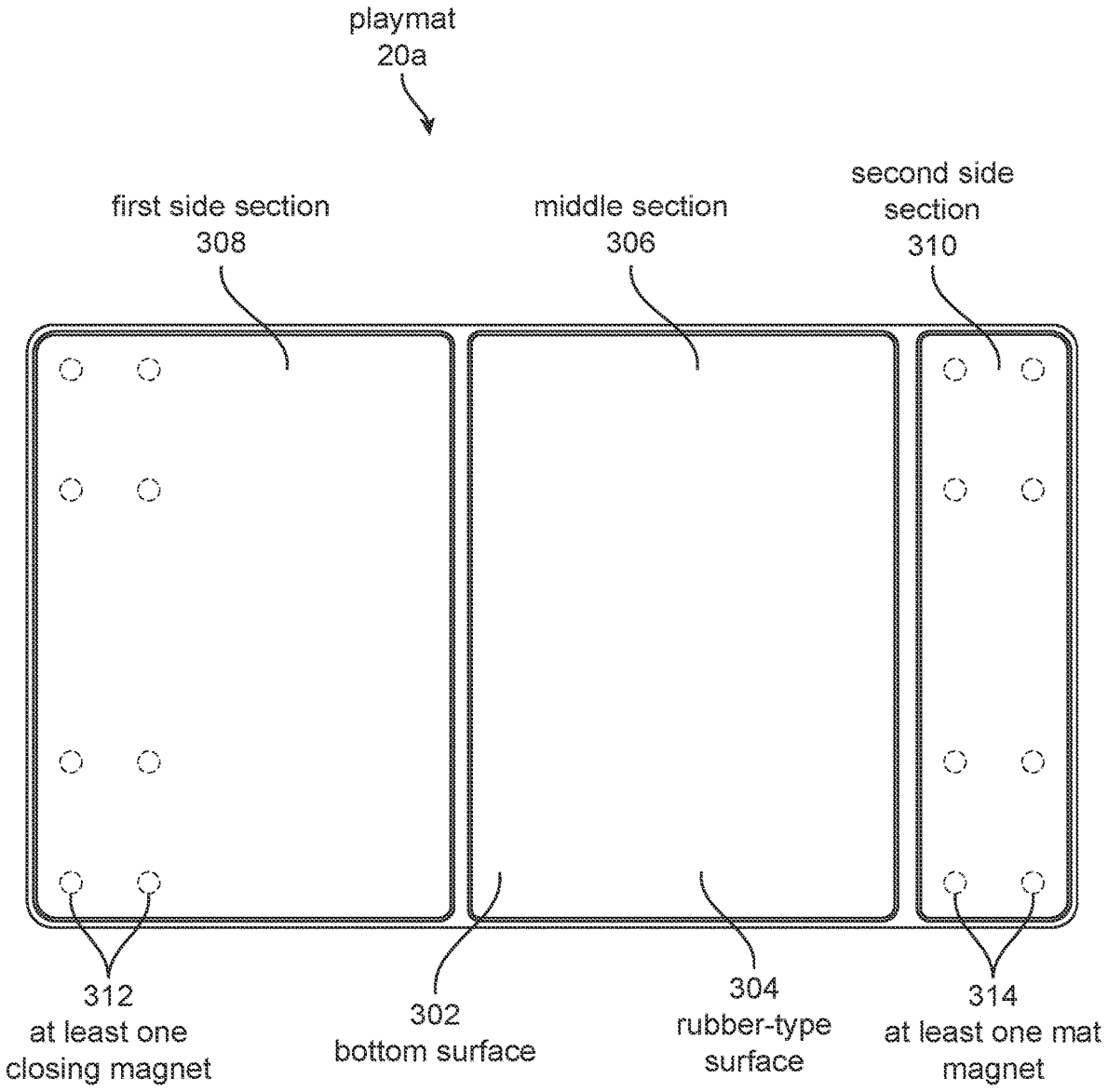
FIG. 3 illustrates a bottom view of an exemplary playmat.

FIG. 3 illustrates a bottom view of an exemplary playmat 20*a* having a three-paneled construction. The back view shows the bottom surface 302, as it may appear when the playmat 20*a* is laid flat. The bottom surface 302 may comprise a rubber-type surface 304. This rubber-type surface 304 helps to prevent slipping of the playmat 20*a* while in use.

The three panels of the playmat 20*a* can be viewed on the bottom surface 302. This is because the top surface 202 may be constructed as such to prevent seeing the disconnects between distinct portions, allowing a smooth playing surface. The three panels of playmat 20*a* may include a middle section 306, a first side section 308 that is adjacent to the middle section 306, and a second side section 310 that is adjacent to the middle section 306 along the edge opposite that of the first side section 308.

The first side section 308 may include at least one closing magnet 312 within its construction, presented as hidden lines to indicate the closing magnets 312 are not flush or exposed from the surface of first side section 308. Similarly, the second side section 310 may include at least one mat magnet 314 within its construction, again presented as hidden lines to indicate the mat magnets 314 are not flush or exposed from the surface of second side section 310. Eight closing magnets 312, as well as eight mat magnets 314 are shown in FIG. 3, as well as FIGS. 4A-5B. However, the number of magnets present does not need to be exactly eight, nor does the number of closing magnets 312 need to match the number of mat magnets 314. Any number of magnets sufficient to magnetically couple components of the gameplay area system 10 to one another may be provided. This may be as few as one magnet, and up to as many magnets as may reasonably fit within the first side section 308 and the second side section 310 without interfering with one another. While not shown, in some examples magnetic strips may be present instead of or in addition to individual magnets.

As will be described later in FIGS. 9, 13, and 19, the magnets on both sides (the at least one closing magnet 312 and the at least one mat magnet 314) are broken into distinct sections—one section of four magnets near the top edge of the playmat 20*a*, and one section of four magnets near the bottom edge. These distinct sections are to facilitate coupling to the other distinct components of the gameplay area system 10 (i.e., the two-piece deck box 30, the dice-box 40, and the folding deck box 50). However, the number of sections need not be limited to two, and as few as one distinct section, or as many distinct sections as could reasonably fit within the confines of the playmat 20*a* may be included.

Additionally, while the second side section 310 is illustrated as shorter in width than the middle section 306 and the first side section 308, this is not strictly necessary. Nor is the fact that the middle section 306 and the first side section 308 are shown as approximately equal in width. The sizes of each panel may vary, so long as the playmat 20*a* may still close upon itself. For example, the dimensions of the first side section 308 and the second side section 310 may be reversed or varied.

Figure 4A:
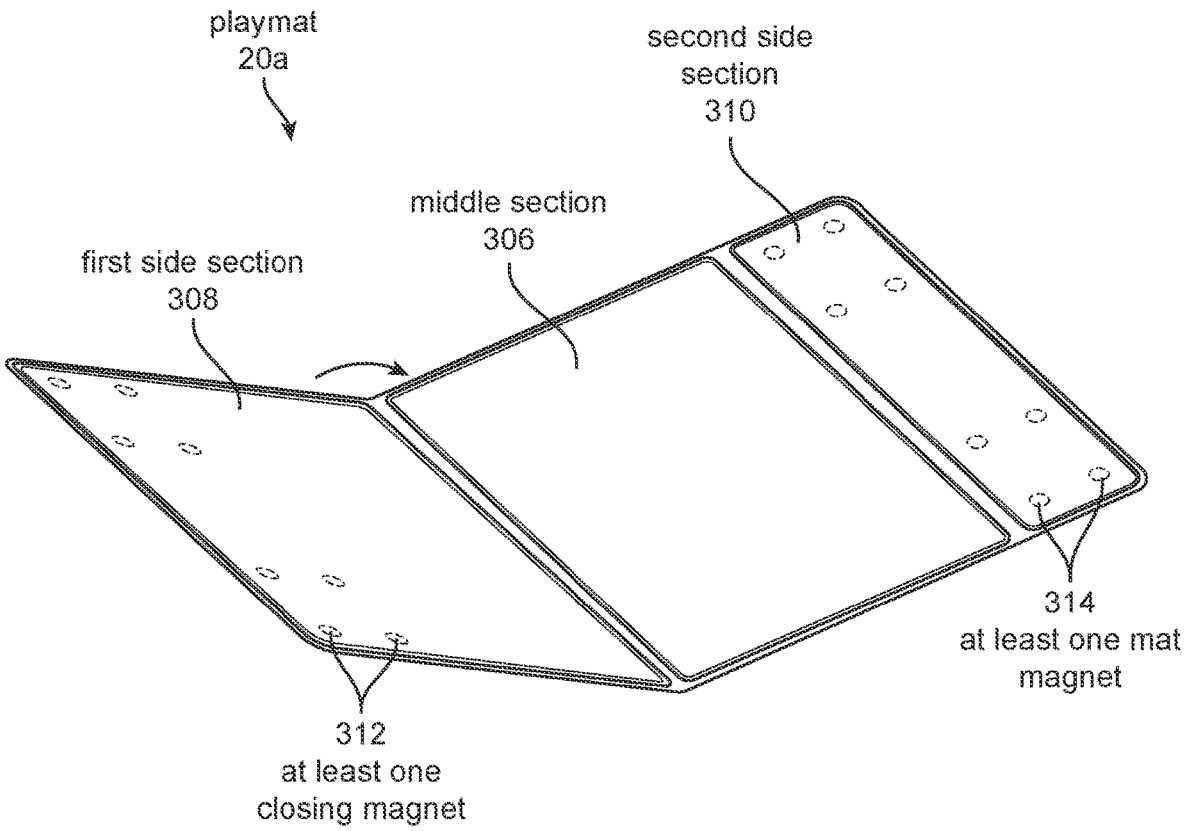
FIG. 4A illustrates a perspective view of the exemplary playmat of FIG. 3 being partially folded.
Figure 4B:
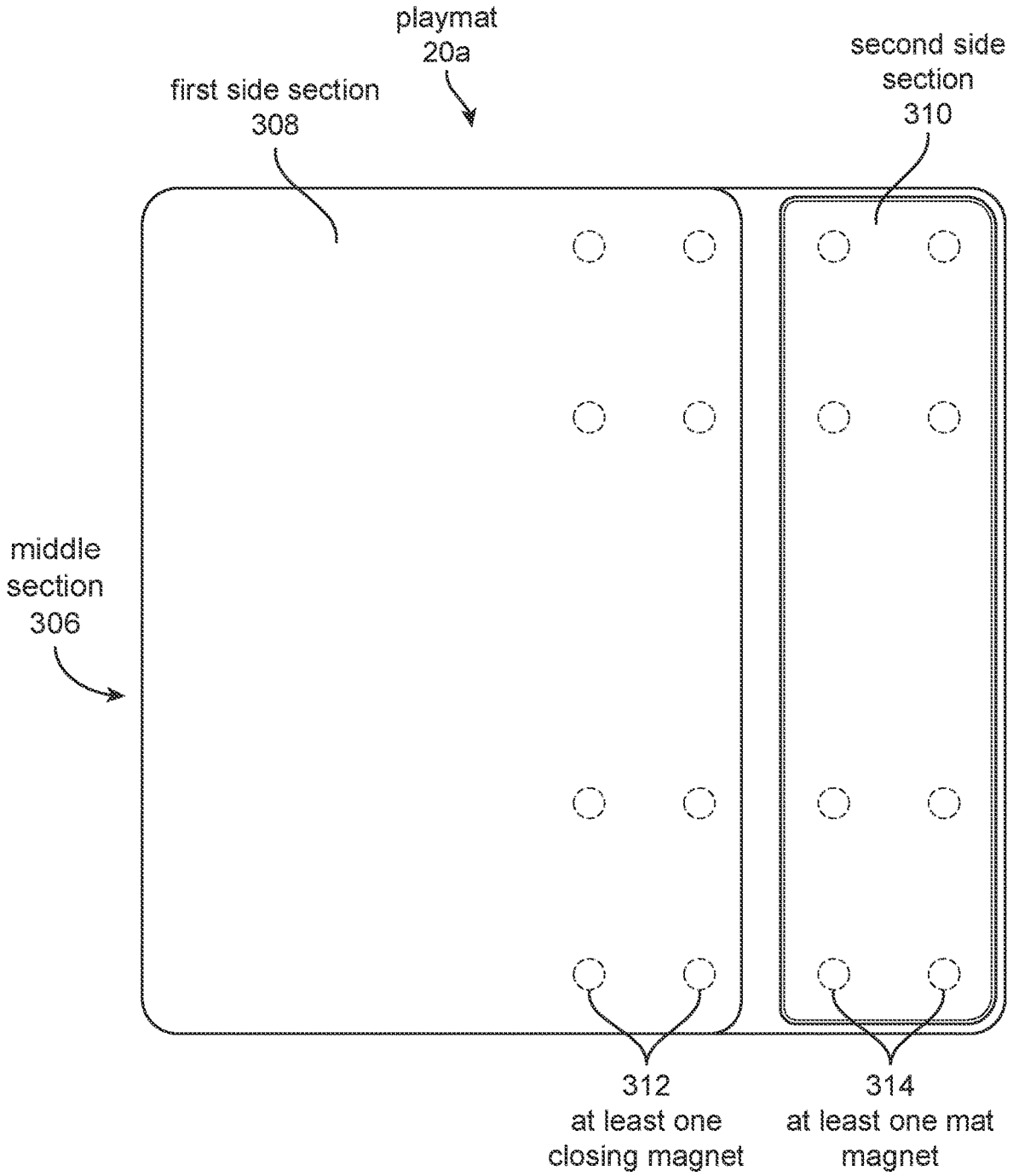
FIG. 4B illustrates a top view of the exemplary playmat of FIG. 4A with the fold completed.
Figure 4C:
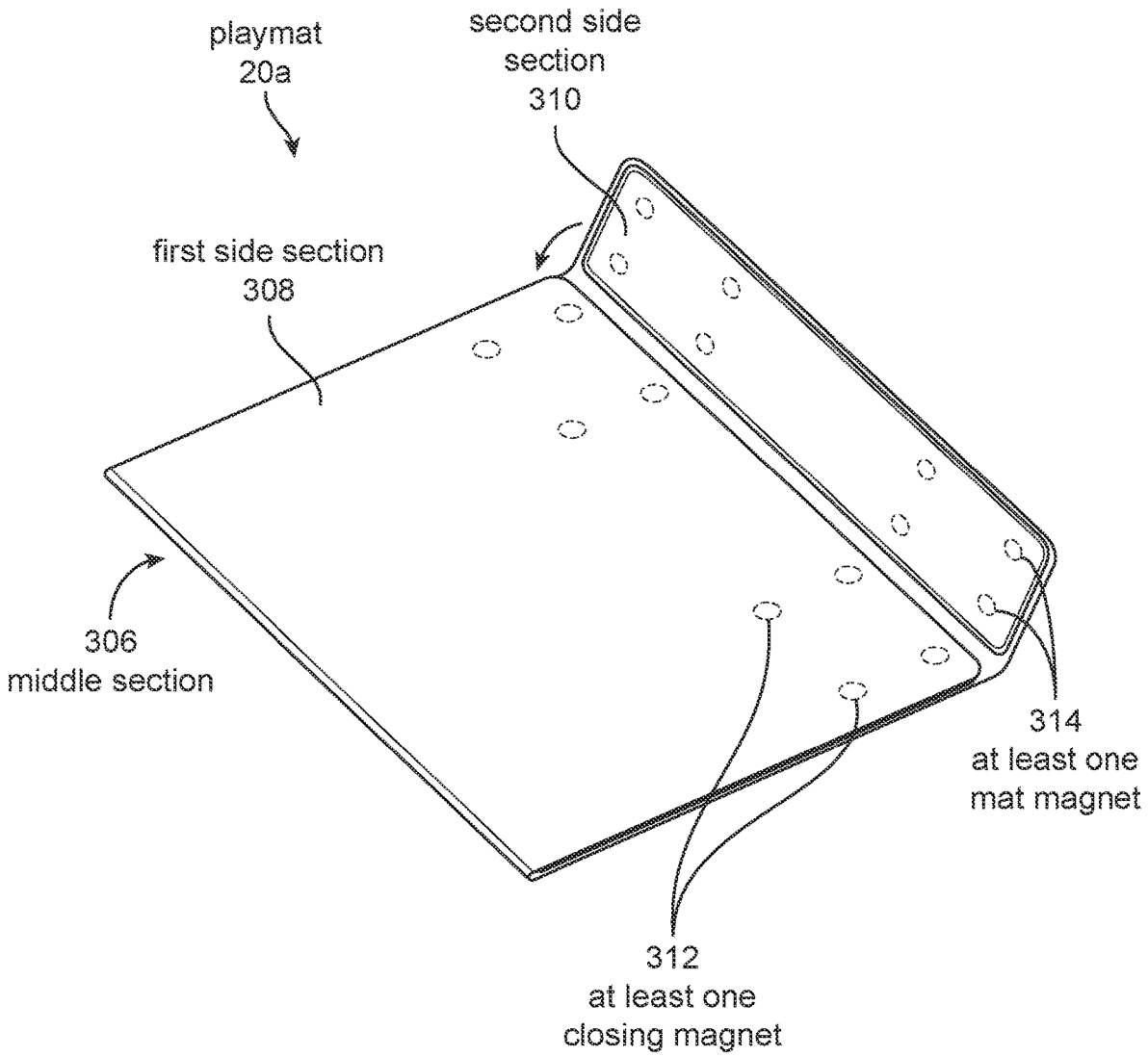
FIG. 4C illustrates a perspective view of the exemplary playmat of FIG. 4B being folded further.

FIGS. 4A, 4B, and 4C illustrate the exemplary playmat 20*a* being folded for storage or transport. FIGS. 4A and 4C show perspective views, and FIG. 4B shows a top view. These views are all shown from the top surface 202, with the delineations of separate panels (i.e., the middle section 306, the first side section 308, and the second side section 310) still drawn to facilitate visualization of the folding process.

FIG. 4A shows first side section 308 being folded over the middle section 306. The first side section 308 and the second side section 310 are hingeably coupled to the middle section 306. This may be accomplished through the inherent flexibility of the material covering each of these sections, or via mechanical means, such as actual hinges.

FIG. 4B shows the playmat 20*a* after the first side section 308 has completed its fold over the middle section 306. As can be seen in this view, the at least one closing magnet 312 and the at least one mat magnet 314 are adjacent to each other while in this position. While not shown, the area between the second side section 310 and the middle section 306 (or first side section 308 in this figure) may be larger than the previously shown areas between the middle section 306 and the first side section 308. This is to compensate for the now greater thickness represented by the stack of the first side section 308 and the middle section 306 when the second side section 310 is to fold over top of these panels (in FIG. 4C). FIG. 4C illustrates second side section 310 being folded over the first side section 308 (and the middle section 306 which is now underneath the first side section 308).

Figure 5A:
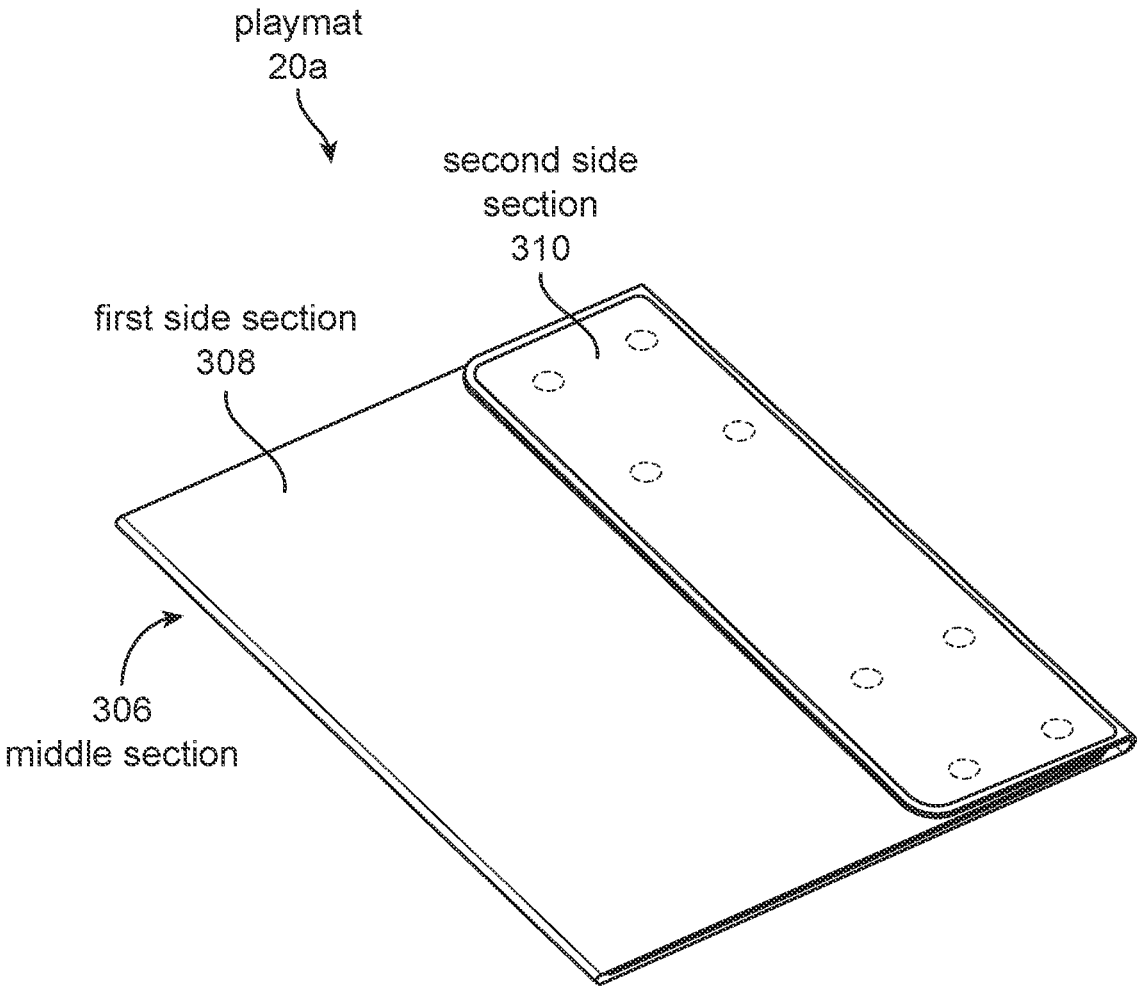
FIG. 5A illustrates a perspective view of the exemplary playmat of FIG. 4C with the fold completed.
Figure 5B:
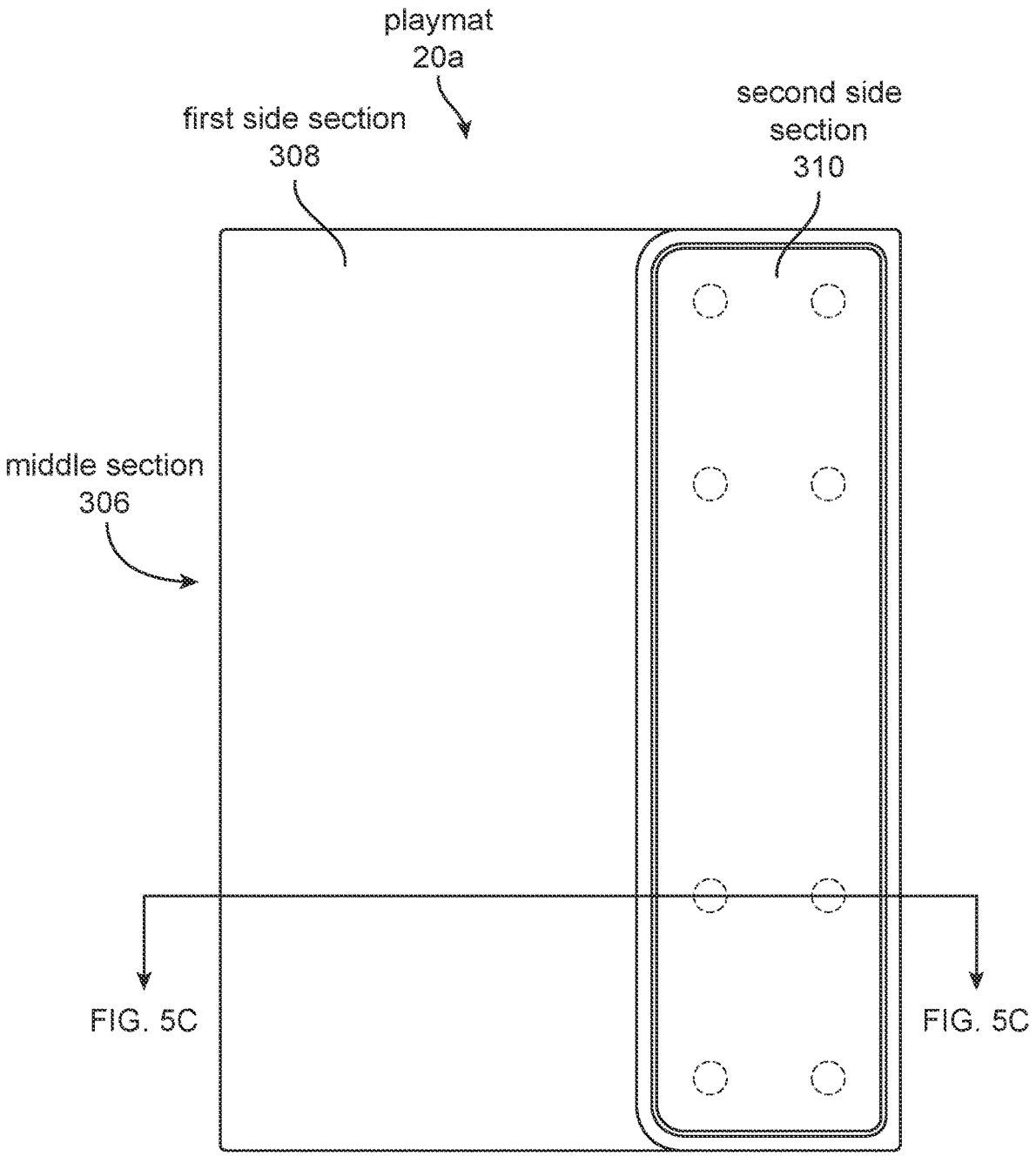
FIG. 5B illustrates a top view of the exemplary playmat of FIG. 5A.
Figure 5C:
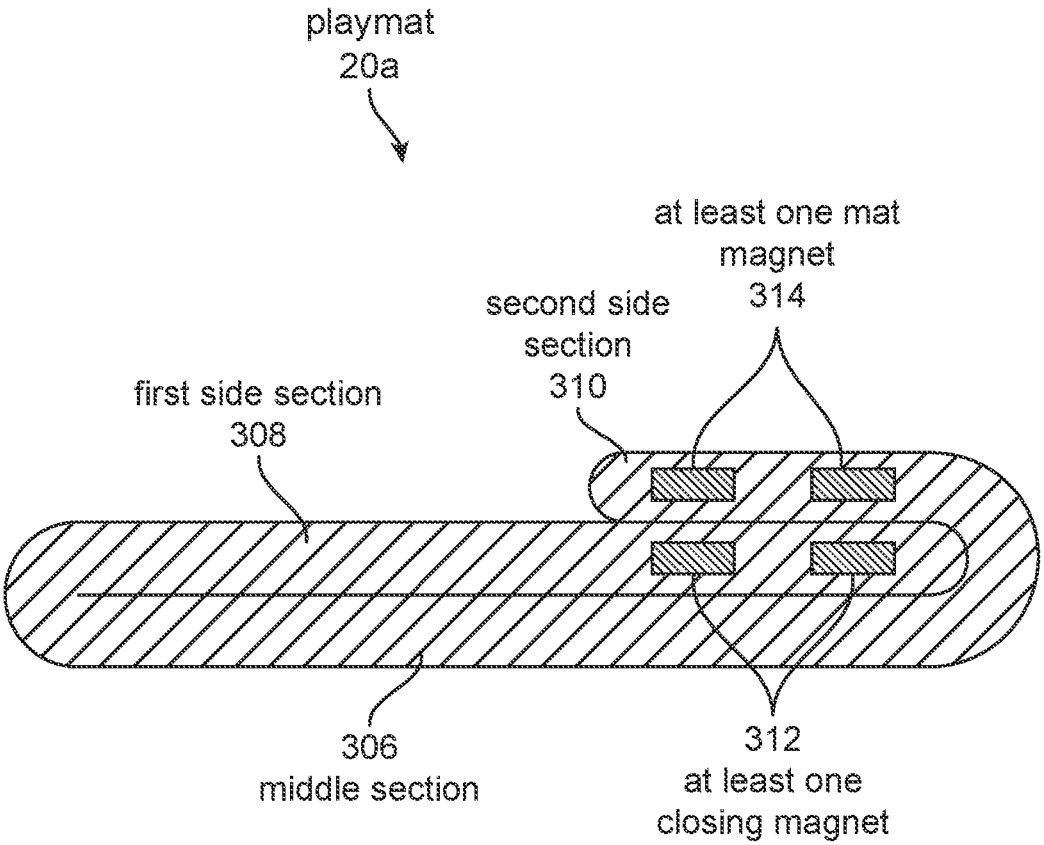
FIG. 5C shows a cross-sectional front view of the exemplary playmat of FIG. 5A

FIG. 5A illustrates a perspective view of the exemplary playmat 20*a* of FIGS. 4A-4C with the fold completed, and FIG. 5B illustrates a top view of the same. As described previously, the at least one closing magnet 312 and the at least one mat magnet 314 are aligned, and in the fully closed position, they secure the second side section 310 to the first side section 308. This may prevent the playmat 20*a* from opening without outside influence. This also permits magnets that will be described in further figures to magnetically couple to the second side section 310 via the at least one mat magnets 314 (such as those present in the two-piece deck box 30, dice-box 40, and folding deck box 50). FIG. 5C illustrates a cross-sectional view of the playmat 20*a* while it is in a closed configuration, showing the at least one mat magnet 314 and the at least one closing magnet 312 closely adjacent to one another. The thicknesses of the middle section 306, the first side section 308, and the second side section 310 are exaggerated for the purposes of illustrating the playmat 20*a* in its folded configuration.

Conventional two-piece deck boxes generally come in one of two form factors—a straight horizontal cut or a diagonal cut. The straight horizontal cut requires a user to open the deck box by applying force directly upward, while the diagonal cut allows a user to apply leverage to facilitate the opening of the deck box. The diagonal cut has the disadvantage of more easily opening accidentally, such as after being dropped. The figures and descriptions herein describe an asymmetrical chevron cut, which combines the benefits of the horizontal cut and the diagonal cut, while mitigating the deficits. It is understood, however, that any type of cut may work with the present disclosure.

Figure 6A:
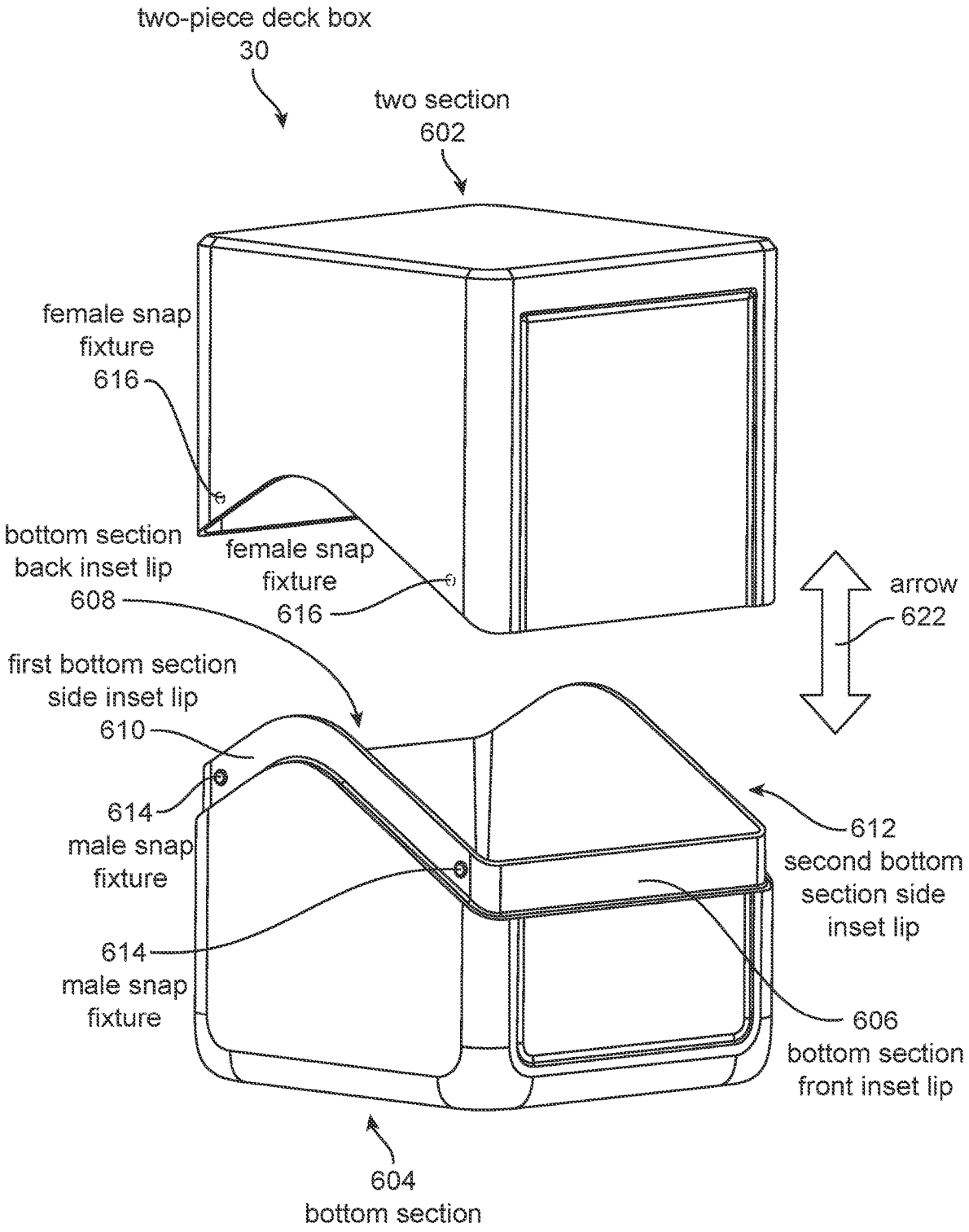
FIG. 6A illustrates a perspective view of an exemplary two-piece deck box in an open configuration.
Figure 6B:
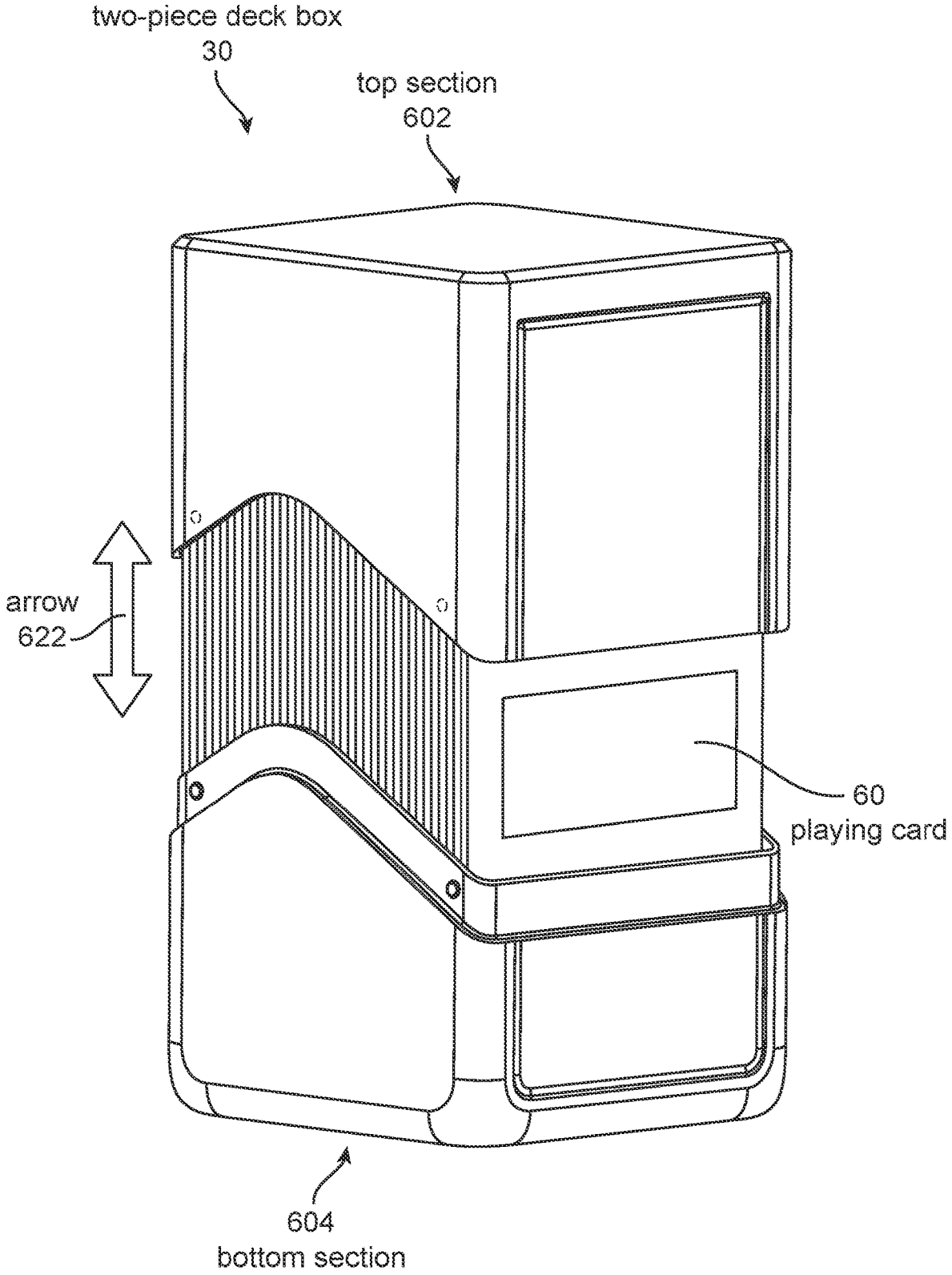
FIG. 6B illustrates the perspective view of the exemplary two-piece deck box of FIG. 6A with playing cards.

FIGS. 6A and 6B illustrate a perspective view of an exemplary two-piece deck box 30 in an open configuration. According to FIG. 6A, two-piece deck box 30 includes a top section 602 and a bottom section 604. An arrow 622 shows the direction of travel when the top section 602 is lowered onto the bottom section 604 to close the two-piece deck box 30. It is understood that this motion may be reversed, and the bottom section 604 may be raised into the top section 602 to close the two-piece deck box 30. FIG. 6B shows the two-piece deck box 30 of FIG. 6A with playing cards 60 present.

The bottom section 604 may include a peripheral inset lip, including a bottom section front inset lip 606, a bottom section back inset lip 608, a first bottom section side inset lip 610, and a second bottom section side inset lip 612. This peripheral inset lip may be configured to slide into the opening at the bottom of the top section 602.

The first bottom section side inset lip 610 describes two male snap fixtures 614. Similarly, on the first top section side 808 (FIGS. 8A and 8B) two female snap fixtures 616 may be present, shown as hidden lines to indicate that these female snap fixtures 616 are present on the interior of this first top section side 808. When the peripheral inset lip is inserted into the opening at the bottom of the top section 602, the male snap fixtures 614 may engage with the female snap fixtures 616 to prevent the top section 602 and the bottom section 604 from decoupling without outside influence.

While the male snap fixtures 614 are shown on the first bottom section side inset lip 610, it is understood that these male snap fixtures 614 may be present on any portion of the peripheral inset lip, including the bottom section front inset lip 606, the bottom section back inset lip 608, the second bottom section side inset lip 612, or any combination thereof. Also, while only two male snap fixtures 614 are shown in FIG. 6A, it is understood that as few as one male snap fixture 614 and up to as many male snap fixtures 614 as are desired and as may fit along the peripheral inset lip may be present in two-piece deck box 30.

Similarly, while the female snap fixtures 616 are shown on the first top section side 808, it is understood that these female snap fixtures 616 may be present on any portion of the lower part of the top section 602, including the top section front wall 804, the top section back wall 806, the second top section side 810 (FIGS. 8A and 8B), or any combination thereof. Also, while only two female snap fixtures 616 are shown in FIG. 6A, it is understood that as few as one female snap fixture 616 and up to as many female snap fixtures 616 as are desired and as may fit along the bottom perimeter of the top section 602 may be present in two-piece deck box 30.

While it is likely that a user would desire the same number of male snap fixtures 614 as female snap fixtures 616, this is not strictly necessary, and variations between the numbers of male snap fixtures 614 and female snap fixtures 616 may exist. Also, while male snap fixtures 614 are described as being present on the bottom section 604, and female snap fixtures 616 are described as being present on the top section 602, these snap fixtures may be swapped, meaning that the female snap fixtures could be present on the bottom section 604 and the male snap fixtures 614 could be present on the top section 602. The entire disclosure as pertaining to FIG. 6A also applies to this switched snap fixture placement example.

Figure 6C:
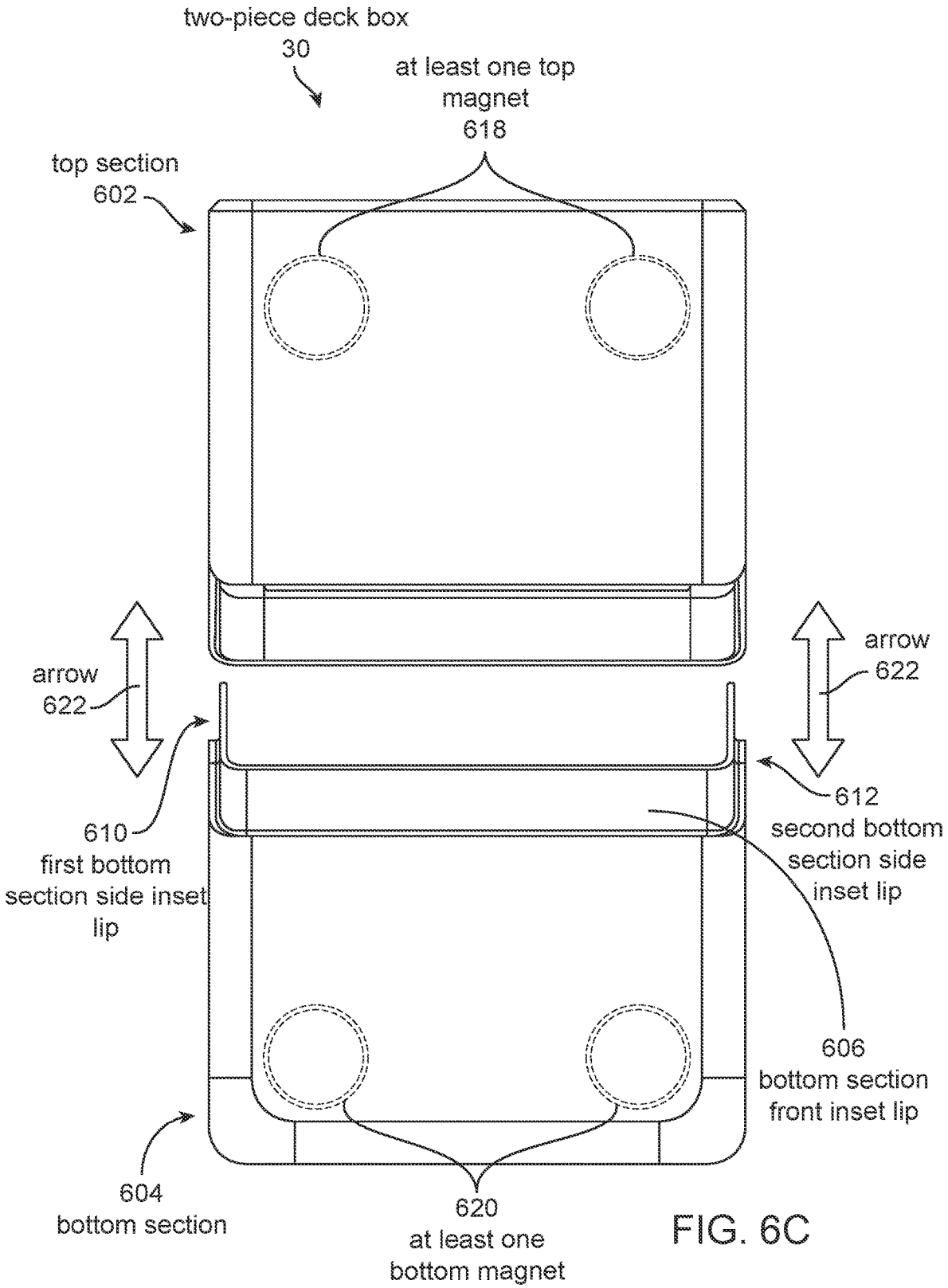
FIG. 6C illustrates a back view of the exemplary two-piece deck box of FIG. 6A

FIG. 6C illustrates a back view of the exemplary two-piece deck box 30 of FIG. 6A as it may be seen in an open position. Once again, arrows 622 show the direction of travel when the top section 602 is lowered onto the bottom section 604 to close the two-piece deck box 30. It is understood that this motion may be reversed, and the bottom section 604 may be raised into the top section 602 to close the two-piece deck box 30.

Figure 8A:
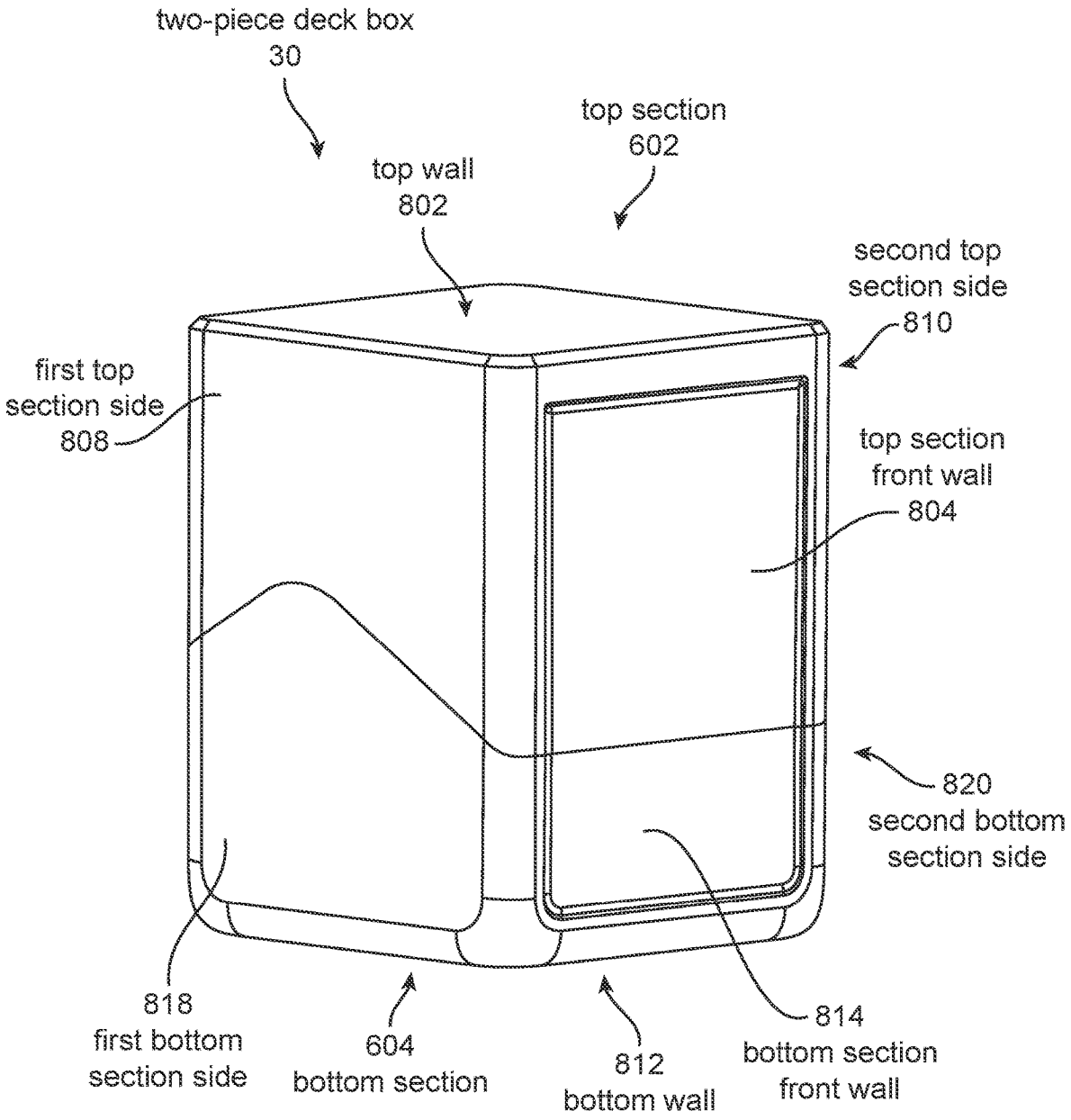
FIG. 8A illustrates a perspective view of an exemplary two-piece deck box in a closed configuration.
Figure 8B:
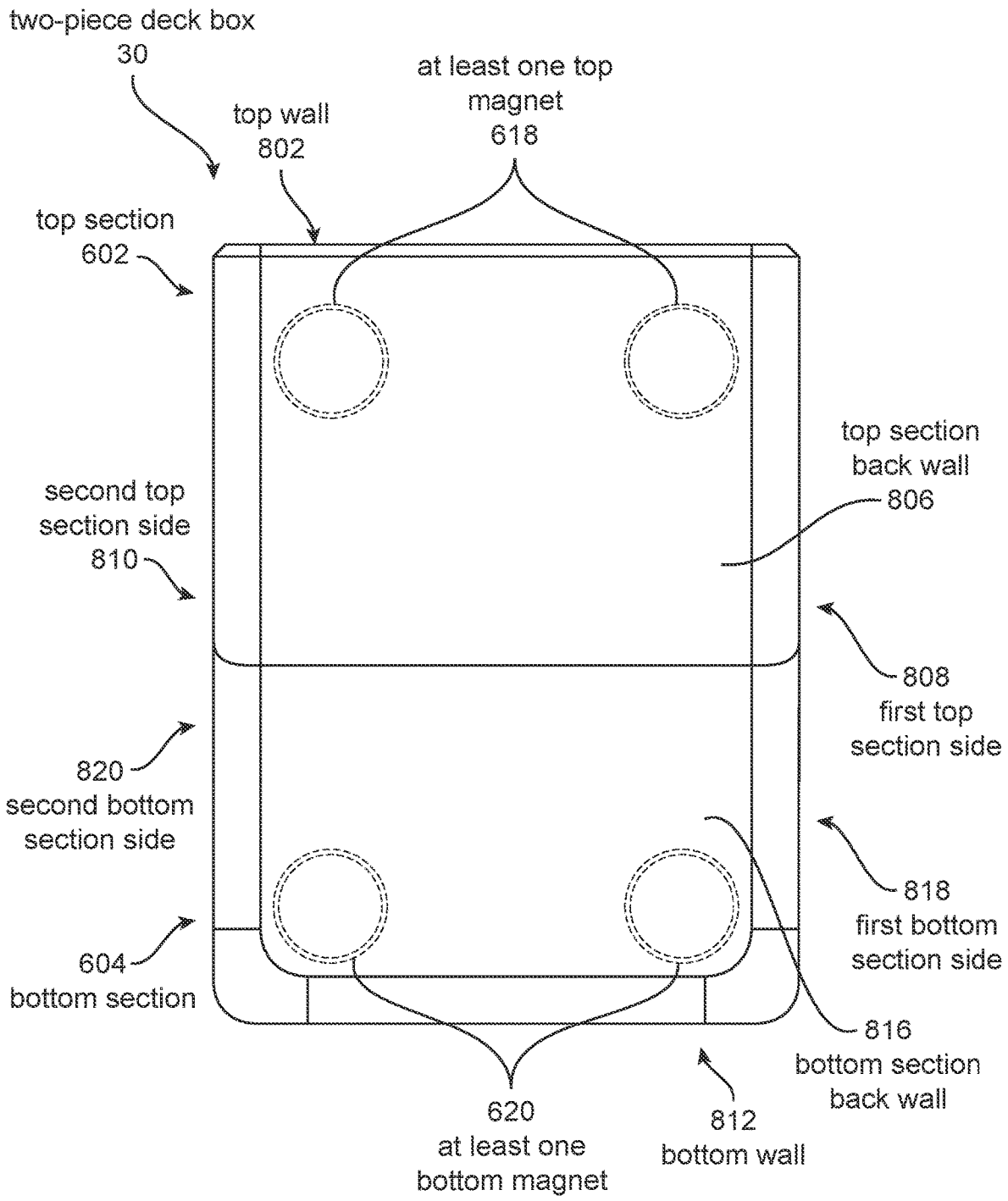
FIG. 8B illustrates a back view of the exemplary two-piece deck box of FIG. 8A.

As can be seen in FIG. 6C, at least one top magnet 618 may be present along the top section back wall 806 (FIG. 8B). The at least one top magnet 618 is shown as hidden lines to indicate that the at least one top magnet 618 is integral to, or disposed within, the top section back wall 806. While two top magnets 618 are shown, as few as one top magnet 618 and up to as many top magnets 618 as desired by the user and as may fit on the surface of the top section 602 may be present. Additionally, while the at least one top magnet 618 is shown as on the top section back wall 806, this placement is not strictly necessary, and the at least one top magnet 618 may be present on the top wall 802, the top section front wall 804, the first top section side 808, the second top section side 810 (FIGS. 8A and 8B), or any combination thereof as desired by the user.

Similarly, at least one bottom magnet 620 may be present along the bottom section back wall 816. The at least one bottom magnet 620 is shown as hidden lines to indicate that the at least one bottom magnet 620 is integral to, or disposed within, the bottom portion 1508. While two bottom magnets 620 are shown, as few as one bottom magnet 620 and up to as many bottom magnets 620 as desired by the user and as may fit on the surface of the bottom section 604 may be present. Additionally, while the at least one bottom magnet 620 is shown as on the bottom section back wall 816, this placement is not strictly necessary, and the at least one bottom magnet 620 may be present on the bottom wall 812, the bottom section front wall 814, the first bottom section side 818, the second bottom section side 820 (FIGS. 8A and 8B), or any combination thereof as desired by the user. While the at least one top magnet 618 and the at least one bottom magnet 620 are shown as equal in number, this is also not strictly necessary, and variations may be used as desired by the user. While not shown, in some examples magnetic strips may be present instead of or in addition to individual magnets.

Figure 7A:
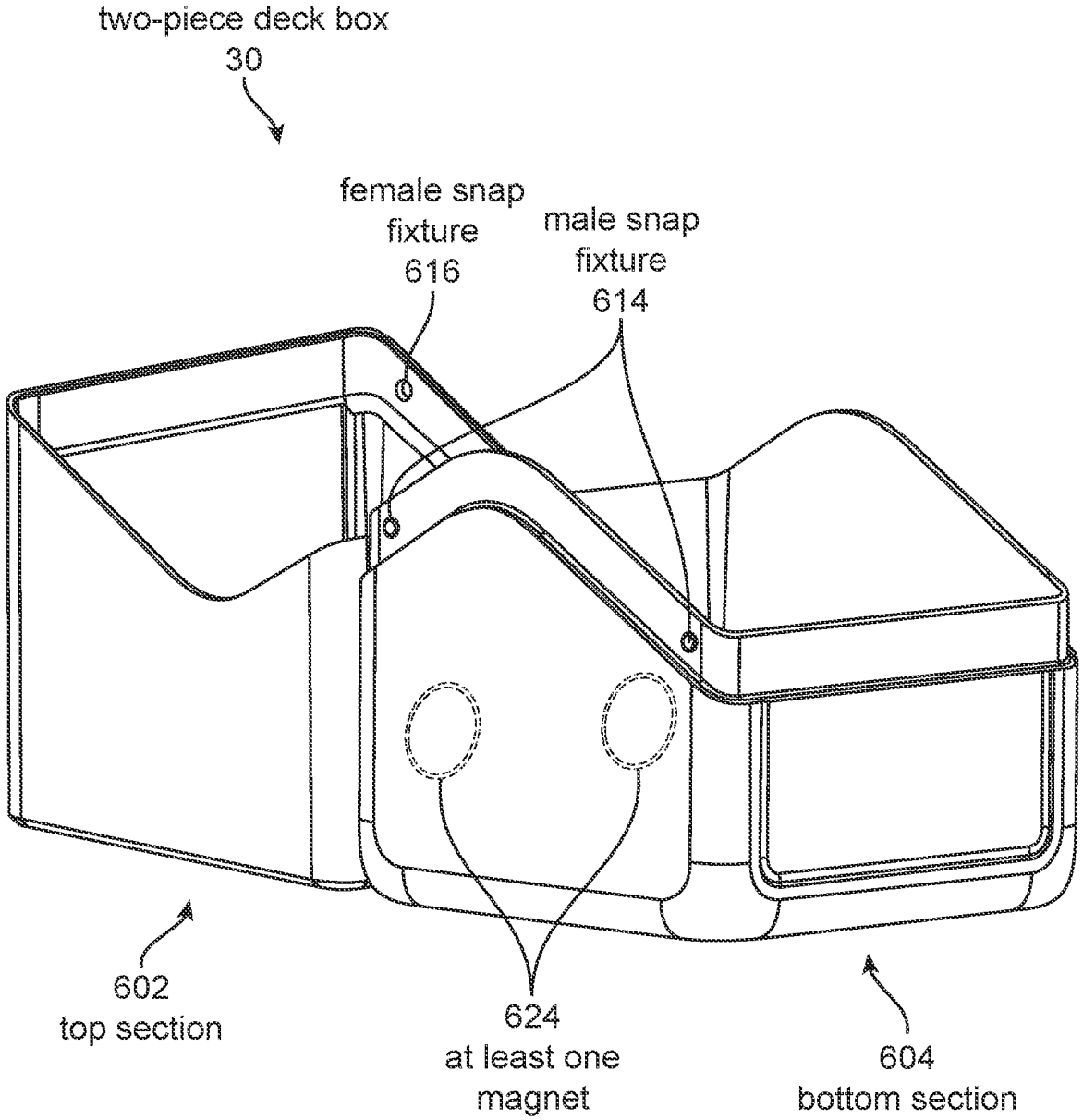
FIG. 7A illustrates a perspective view of a two-piece deck box in another open configuration.
Figure 7B:
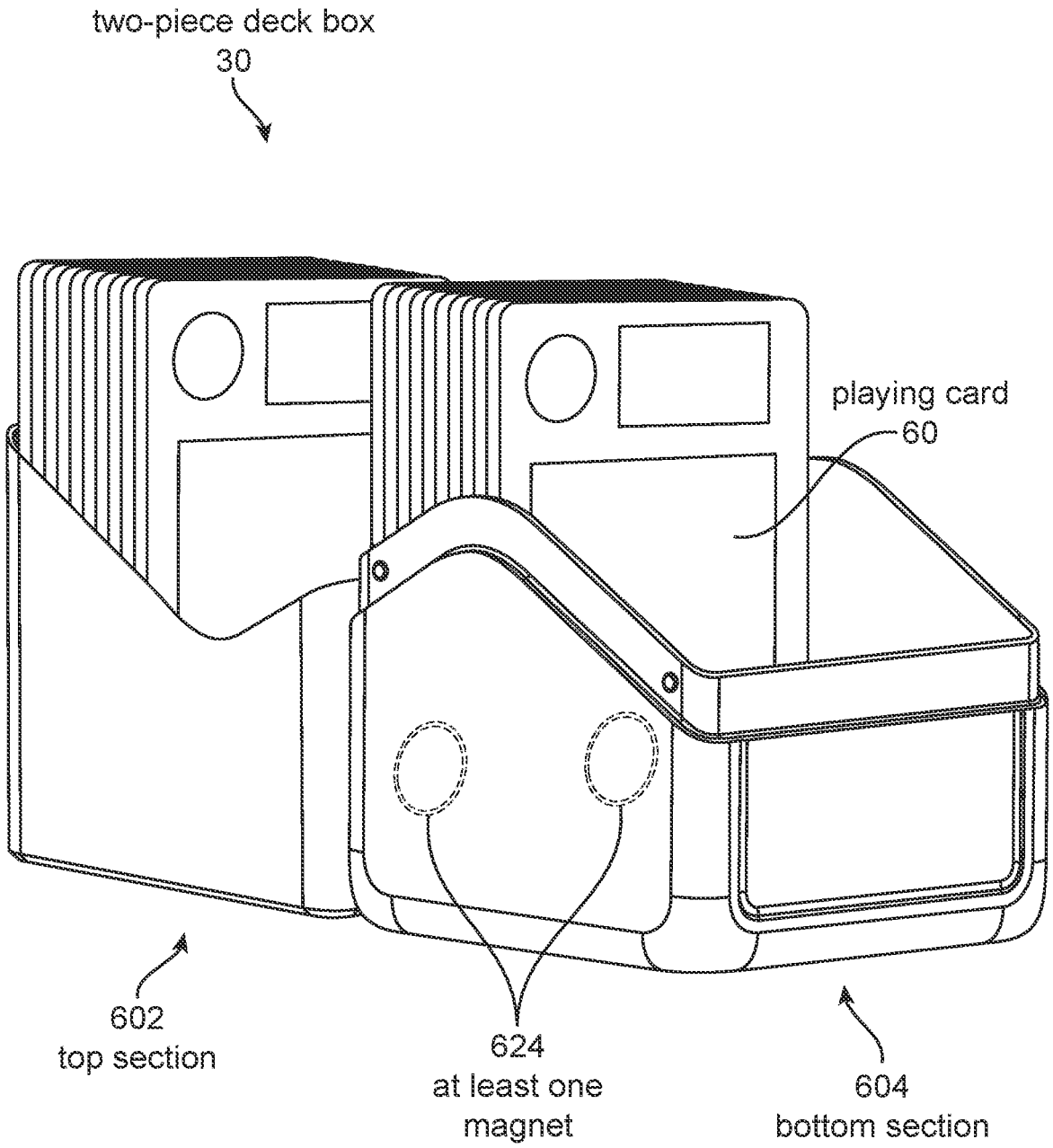
FIG. 7B illustrates the perspective view of the two-piece deck box of FIG. 7A with playing cards.

Traditional two-piece deck boxes, while in an open configuration, result in two separate components to keep track of. As shown in FIGS. 7A and 7B, at least one magnet 624 may be present on the top section 602 and the bottom section 604. The at least one magnet 624 may be used to attach the two-piece deck box 30 to a playmat 20, but, as shown, may also magnetically couple the top section 602 to the bottom section 604, allowing the two-piece deck box to sit more neatly while in this open configuration.

FIGS. 7A and 7B illustrate a profile view of the two-piece deck box 30 in an open configuration. The top section 602 and the bottom section 604 may be placed such that the top section back wall 806 and the bottom section back wall 816 (FIGS. 8A and 8B) are adjacent one another. In some configurations of magnets, the at least one top magnet 618 and at least one bottom magnet 620 may interact with each other to hold the top section 602 and the bottom section 604 together while in this open configuration. This is shown as hidden lines illustrating at least one magnet 624 as they may be positioned when the two-piece deck box 30 is in this configuration. FIG. 7B shows the two-piece deck box of FIG. 7A with playing cards 60 inside both the top section 602 and the bottom section 604. The two-piece deck box 30 is sized such that playing cards may be kept in either portion while in an open configuration. The at least one top magnet 618 and the at least one bottom magnet 620 may also interact with the at least one mat magnet 314, as shown and described in FIG. 9.

The at least one magnet 624 may also be used to magnetically couple one two-piece deck box 30 to an additional two-piece deck box 30. It is common in the playing card field to have "duel decks" which are designed to be played against one another. The at least one magnet 624 allows these two two-piece deck boxes to remain neatly coupled together.

FIG. 8A illustrates a perspective view of an exemplary two-piece deck box in a closed configuration and FIG. 8B illustrates a back view of the same. As can be seen from these figures, the top section 602 may comprise a top wall 802, a top section front wall 804 extending substantially perpendicular to the top wall 802, and a top section back wall 806 extending substantially perpendicular to the top wall 802 along an edge opposite that of the top section front wall 804. The top section 602 also may include a first top section side 808 extending substantially perpendicular to the top wall 802, the top section front wall 804, and the top section back wall 806. The first top section side 808 may close the space created between the top section front wall 804 and the top section back wall 806 on the side where it resides. Additionally, the top section 602 may include a second top section side 810 extending substantially perpendicular to the top wall 802, the top section front wall 804, and the top section back wall 806. The second top section side 810 may close the space created between the top section front wall 804 and the top section back wall 806 on the side where it resides. These five walls create a cavity into which items, such as playing cards, may be placed.

Also shown in these figures is a bottom section 604 which may include a bottom wall 812, a bottom section front wall 814 extending substantially perpendicular to the bottom wall 812, and a bottom section back wall 816 extending substantially perpendicular to the bottom wall 812 along an edge opposite that of the bottom section front wall 814. The bottom section 604 may also include a first bottom section side 818 extending substantially perpendicular to the bottom wall 812, the bottom section front wall 814, and the bottom section back wall 816. The first bottom section side 818 may close the space created between the bottom section front wall 814 and the bottom section back wall 816 on the side where it resides. Additionally, the bottom section 604 may include a second bottom section side 820 extending substantially perpendicular to the bottom wall 812, the bottom section front wall 814, and the bottom section back wall 816. The second bottom section side 820 may close the space created between the bottom section front wall 814 and the bottom section back wall 816 on the side where it resides. These five walls create a cavity into which items, such as playing cards, may be placed.

When the top section 602 is lowered onto the bottom section 604, as shown in both FIGS. 8A and 8B, the two-piece deck box 30 creates a fully enclosed container for storing or transporting items, such as playing cards. The container does not need to be fully enclosed, as windows or cutouts for design purposes may be included without affecting the purpose or capabilities of the two-piece deck box 30.

In both FIGS. 6C and 8B, while the at least one top magnet 618 and the at least one bottom magnet 620 are shown as integral to or disposed within the top section back wall 806 and the bottom section back wall 816, respectively, this is not strictly necessary. The magnets may also be present on the surface of the top section back wall 806 and the bottom section back wall 816 without affecting the functionality of the two-piece deck box 30.

The top section front wall 804 may be thinner than other walls of the two-piece deck box 20, and/or glossy as opposed to traditional matte. This can create a window, allowing a user to view cards within the two-piece deck box 30 to more quickly identify the card deck within.

Figure 9:
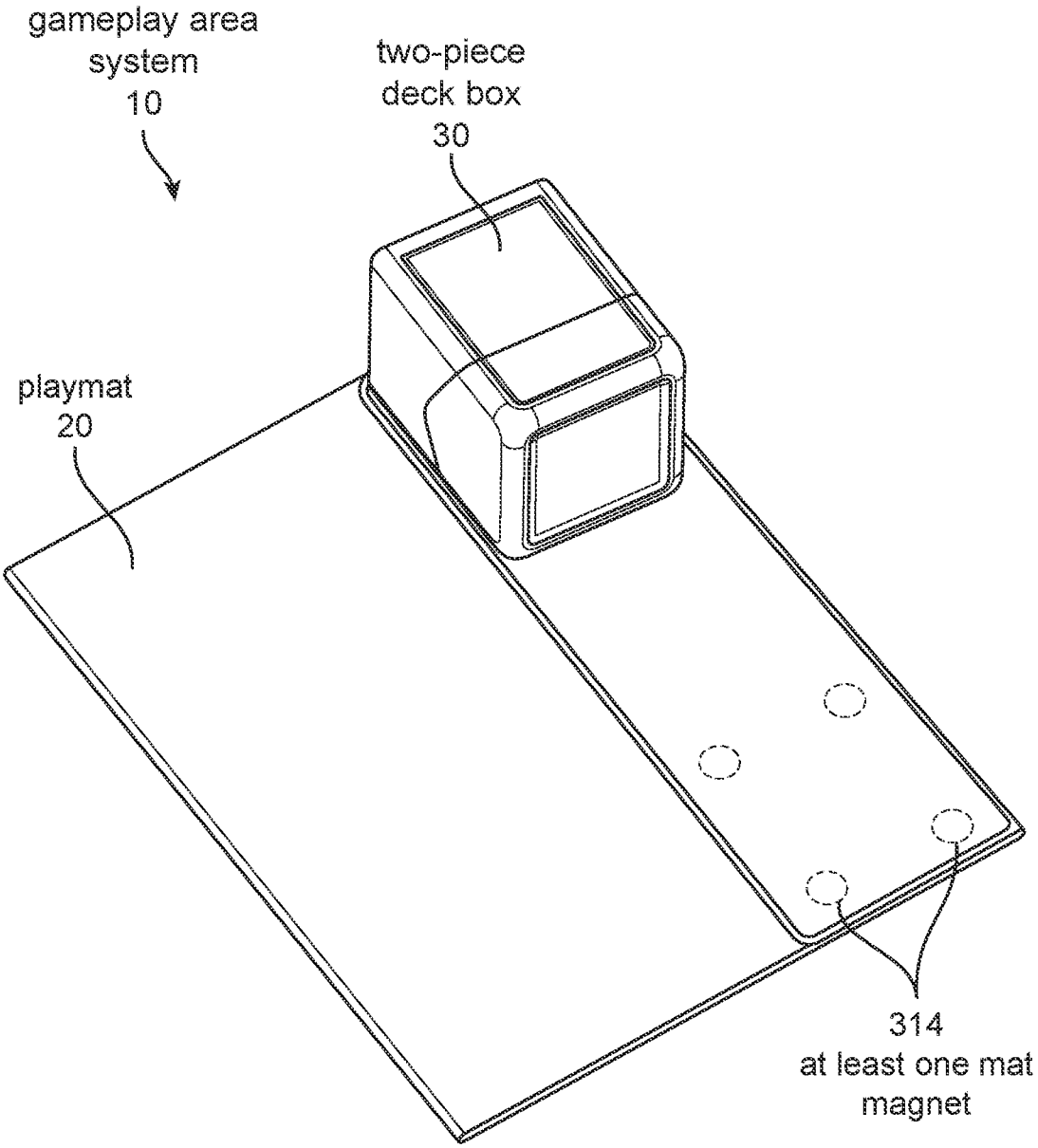
FIG. 9 illustrates a perspective view of an exemplary two-piece deck box magnetically coupled to an exemplary playmat.

FIG. 9 illustrates a perspective view of an exemplary two-piece deck box 30 magnetically coupled to an exemplary playmat 20, creating a two-component gameplay area system 10. As can be seen in FIG. 9, the playmat 20 includes two distinct docking areas. The bottom docking area is exposed, showing hidden circles indicating included mat magnets 314 within the playmat 20. The other docking area is covered by the two-piece deck box 30, where the at least one top magnet 618 and the at least one bottom magnet 620 are magnetically coupled to the mat magnets 314 in this location. This facilitates the transport of both the playmat 20 and the two-piece deck box 30, while still leaving room for additional components to dock to the playmat 20. As discussed previously, the inclusion of only two distinct docking areas is not intended to be limiting, and any number of distinct docking areas as can fit on the playmat 20 may be present in the gameplay area system 10.

Typically, separate dice-boxes are not a part of a standard system for carrying components of a card game. More deluxe deck boxes will sometimes include a compartment meant for dice, but these compartments vary in size and are thus not necessarily interchangeable between different deck boxes. This can create difficulty in ensuring that a player has all the components needed for the specific game they are trying to play, unless they create a specific deck box with the dice they need for each game they play. The present disclosure solves this problem by isolating the dice to a dice-box 20 which is independent from, and capable of magnetically coupling to, any of the other components of the gameplay area system 10.

Figure 10A:
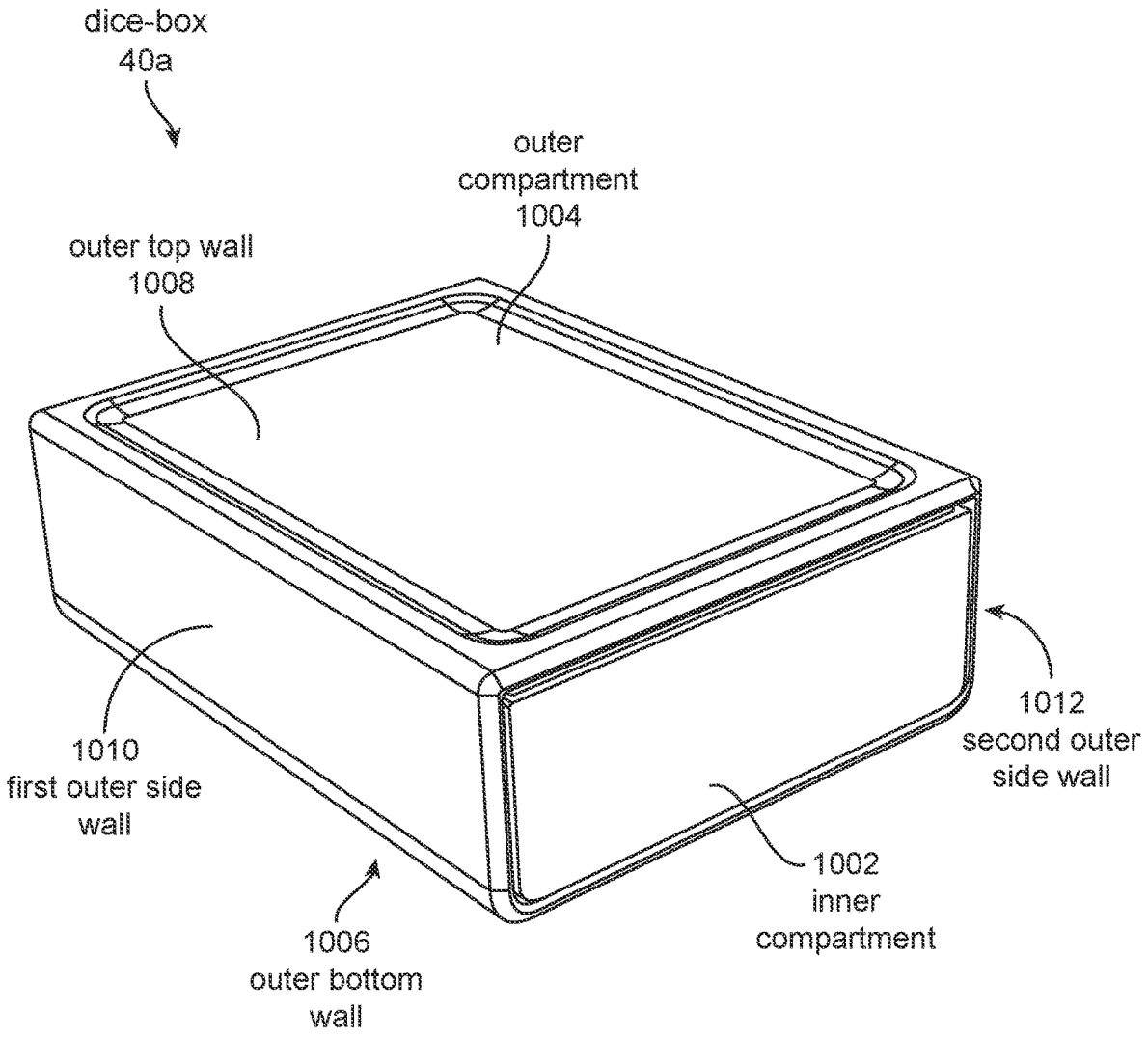
FIG. 10A illustrates a perspective view of an exemplary dice-box in a closed configuration.

FIG. 10A illustrates a perspective view of an exemplary dice-box 40*a* in a closed configuration. As shown, the dice-box 40*a* may include an inner compartment 1002 that is slidably coupled, or slidably engages an outer compartment 1004. The outer compartment 1004 may be a hollow rectangular, or approximately rectangular, prism. The walls of this outer compartment 1004 as shown include an outer bottom wall 1006 and an outer top wall 1008 opposite from and substantially parallel to the outer bottom wall 1006.

The outer compartment 1004 may include a first outer side wall 1010 extending substantially perpendicular to the outer bottom wall 1006 and the outer top wall 1008. The first outer side wall 1010 may couple to and close the spaces that exist between the outer bottom wall 1006 and the outer top wall 1008. The outer compartment 1004 may also include a second outer side wall 1012 extending substantially perpendicular to the outer bottom wall 1006 and the outer top wall 1008, the second outer side wall 1012 opposite of, and substantially parallel to, the first outer side wall 1010. The second outer side wall 1012 may couple to and close the spaces that exist between the outer bottom wall 1006 and the outer top wall 1008. The outer compartment 1004 may be sized so as to receive the inner compartment 1002.

Figure 10B:
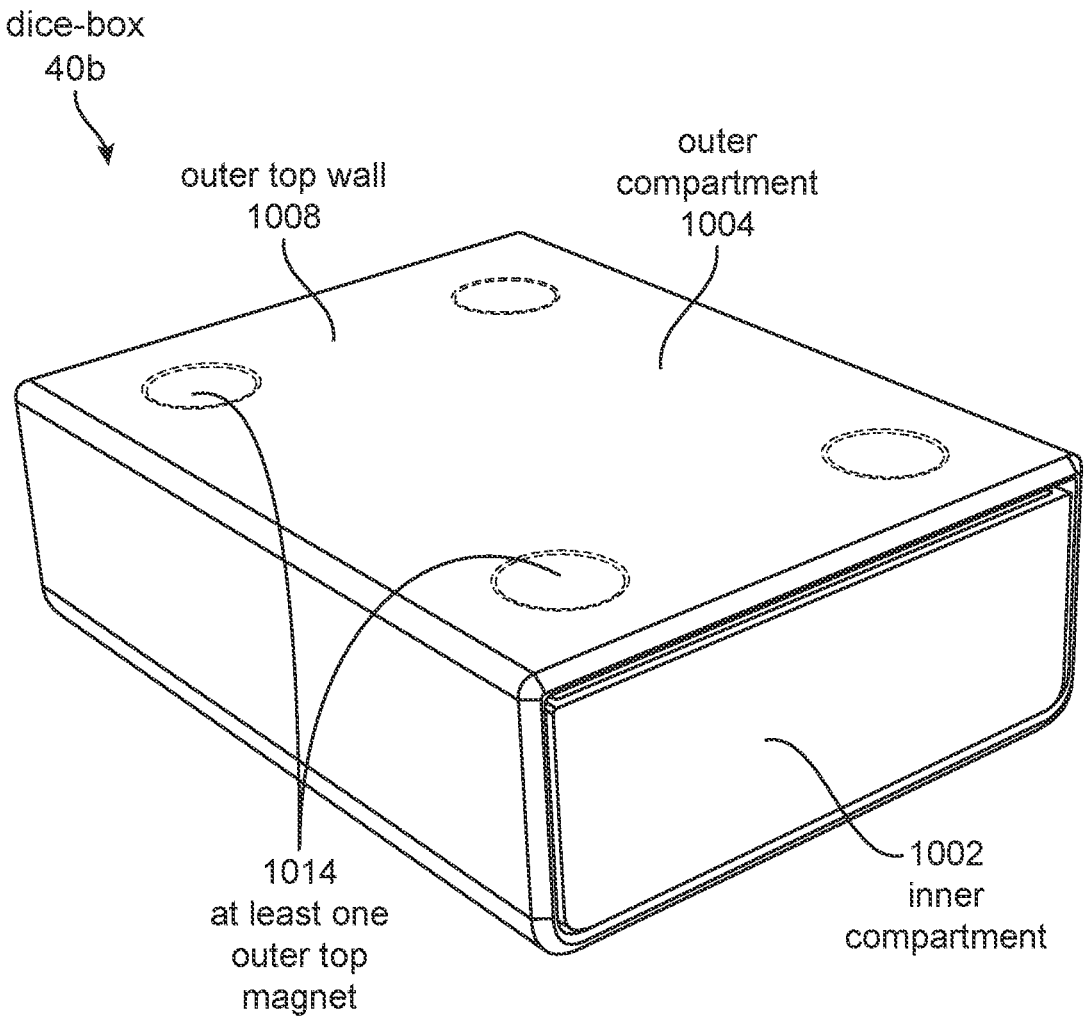
FIG. 10B illustrates a perspective view of another exemplary dice-box in a closed configuration.
Figure 11C:
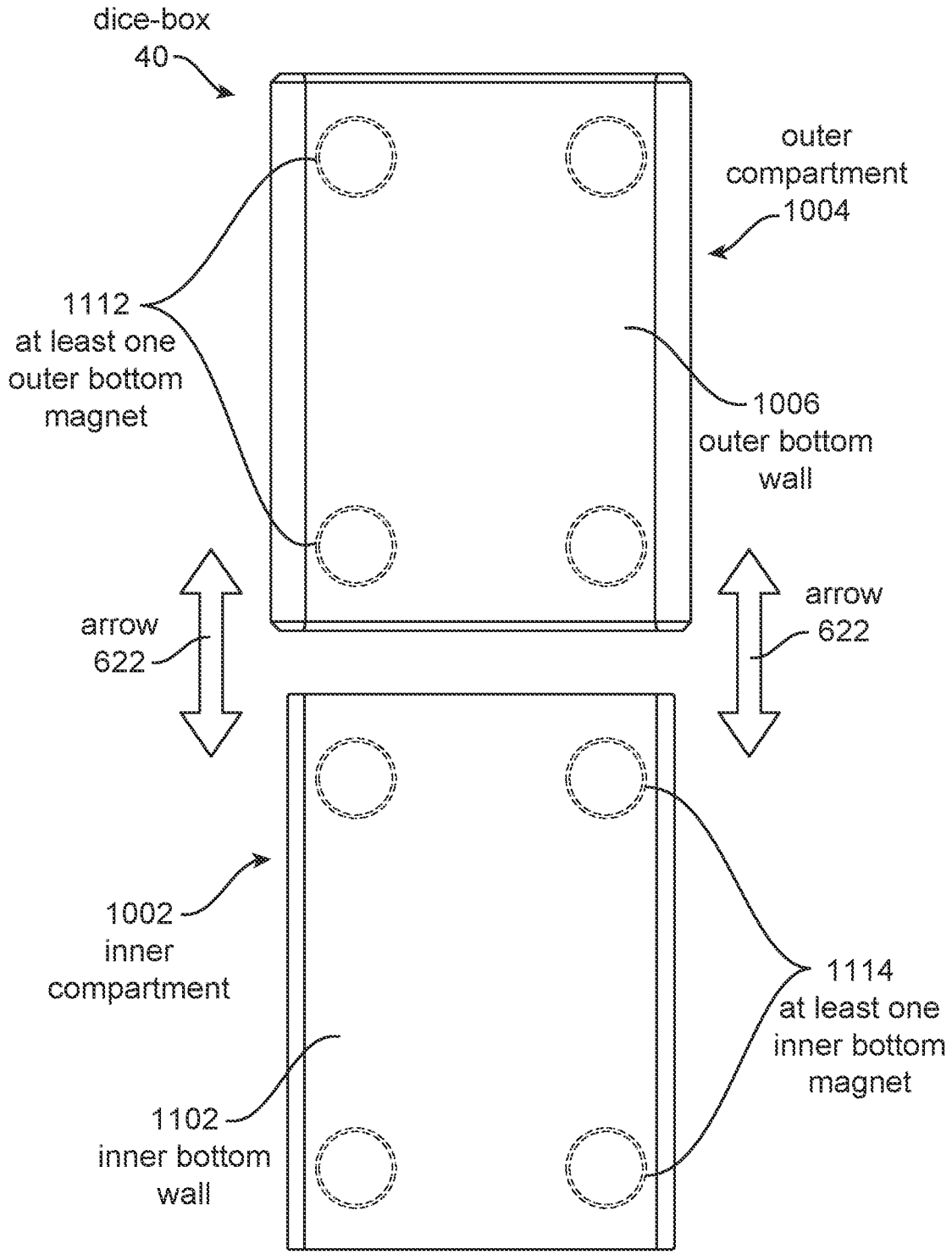
FIG. 11C illustrates a bottom view of the exemplary dice-box of FIG. 11A.
Figure 12A:
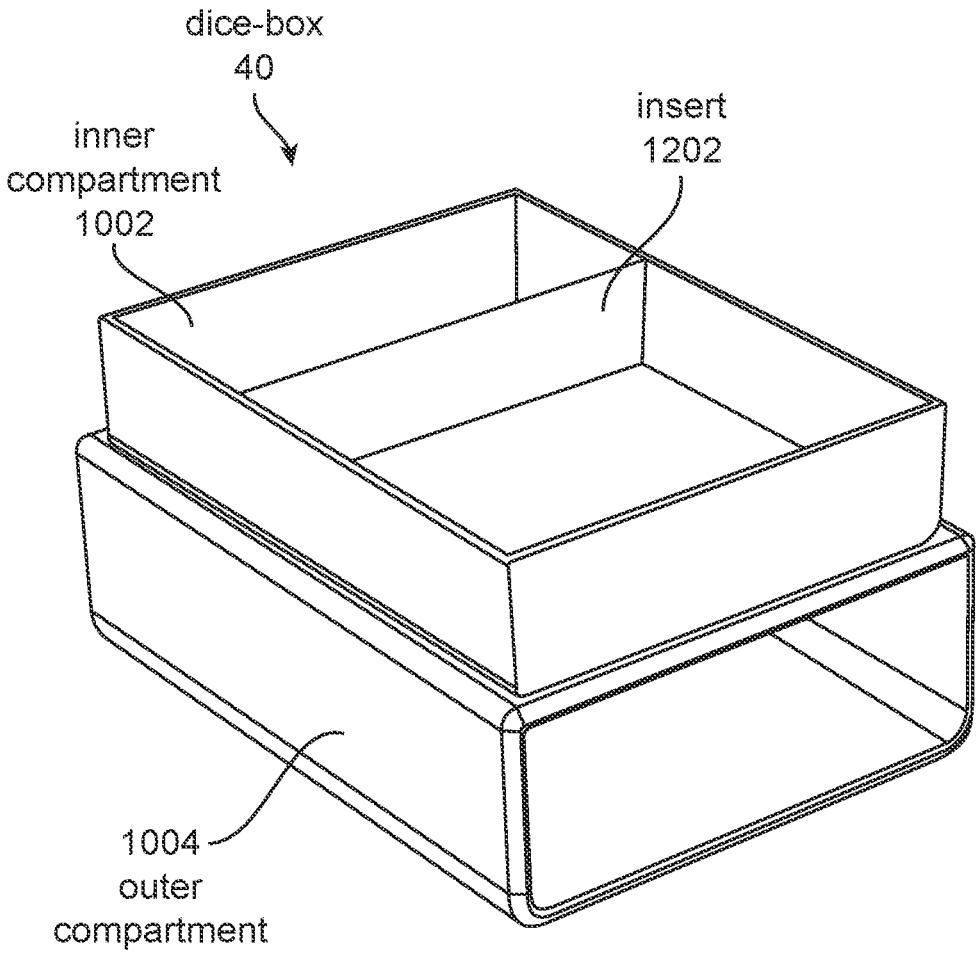
FIG. 12A illustrates a perspective view of an exemplary dice-box with the inner compartment magnetically coupled to the outer compartment from the outside.
Figure 12B:
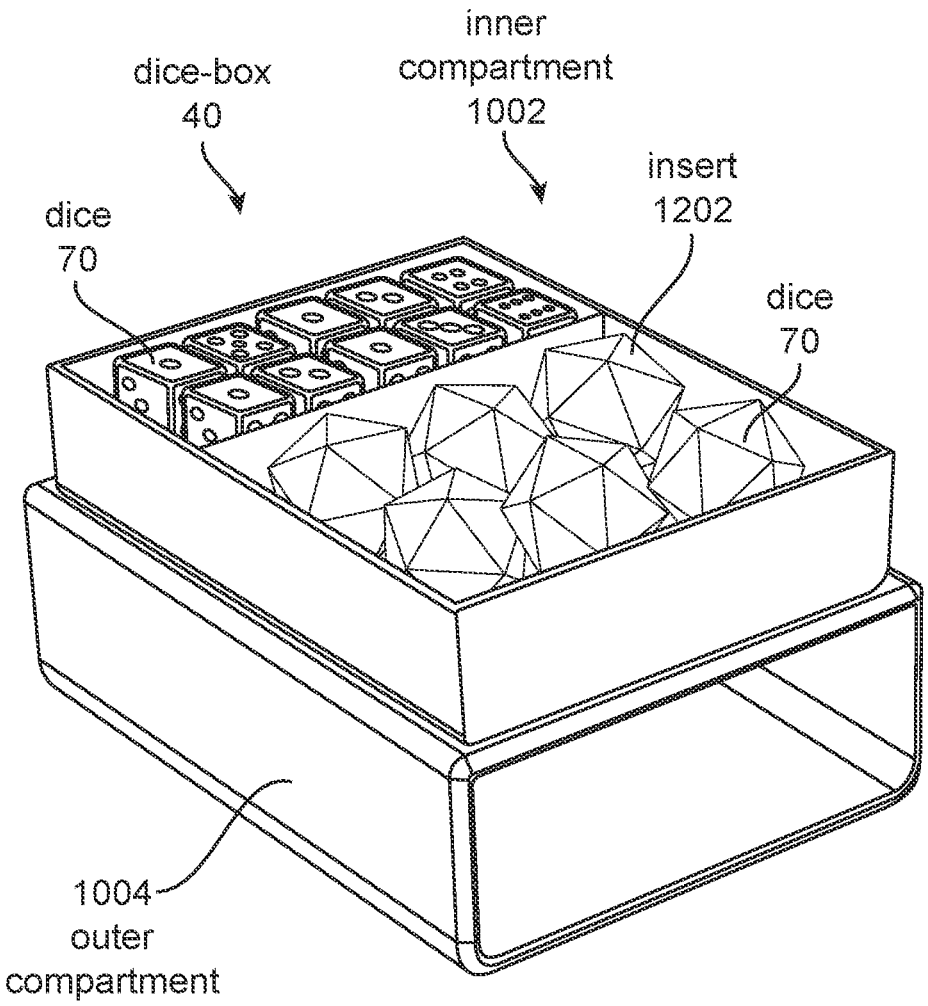
FIG. 12B illustrates the perspective view of the exemplary dice box of FIG. 12A with die.

FIG. 10B illustrates a perspective view of another exemplary dice-box 40*b* in a closed configuration. The dice-box 40*b* is much the same as the dice-box 40*a* of FIG. 10A, including an inner compartment 1002 that may slidably couple to or slidably engage an outer compartment 1004. However, the dice-box 40*b* includes at least one outer top magnet 1014 integral to the outer top wall 1008. The at least one outer top magnet 1014 may couple to an at least one inner bottom magnet 1114 as shown in FIGS. 11C, 12A, and 12B. The at least one outer top magnet 1014 may also couple to the at least one mat magnet 314 as shown in FIG. 13.

While the at least one outer top magnet 1014 is shown as integral to or disposed within the outer top wall 1008, this is not strictly necessary. The outer top magnets 1014 may also be present on the surface of the outer top wall 1008 without affecting the functionality of the dice-box 40*b*.

Four outer top magnets 1014 are shown in FIG. 10B. However, the number of outer top magnets 1014 does not need to be exactly four. Any number of magnets sufficient to magnetically couple the inner compartment 1002 to the outer compartment 1004 (as shown in FIGS. 12A and 12B), or the outer compartment 1004 to a playing mat 20 may be present. This may be as few as one outer top magnet 1014, and up to as many outer top magnets 1014 as may reasonably fit on the outer top wall 1008. While not shown, in some examples magnetic strips may be present instead of or in addition to individual magnets.

In example dice-boxes 40*b* having at least one outer top magnet 1014, the at least one outer bottom magnet 1112 (as described in FIG. 11C) may magnetically couple or magnetically engage the at least one outer top magnet 1014 in order to stack multiple dice-boxes 40. Note that a dice-box 40*a* as described in FIG. 10A may magnetically couple to a dice-box 40*b* as described in FIG. 10B. Dice-box 40*a* as described in FIG. 10B may also magnetically couple to another dice-box 40*b*.

Figure 11A:
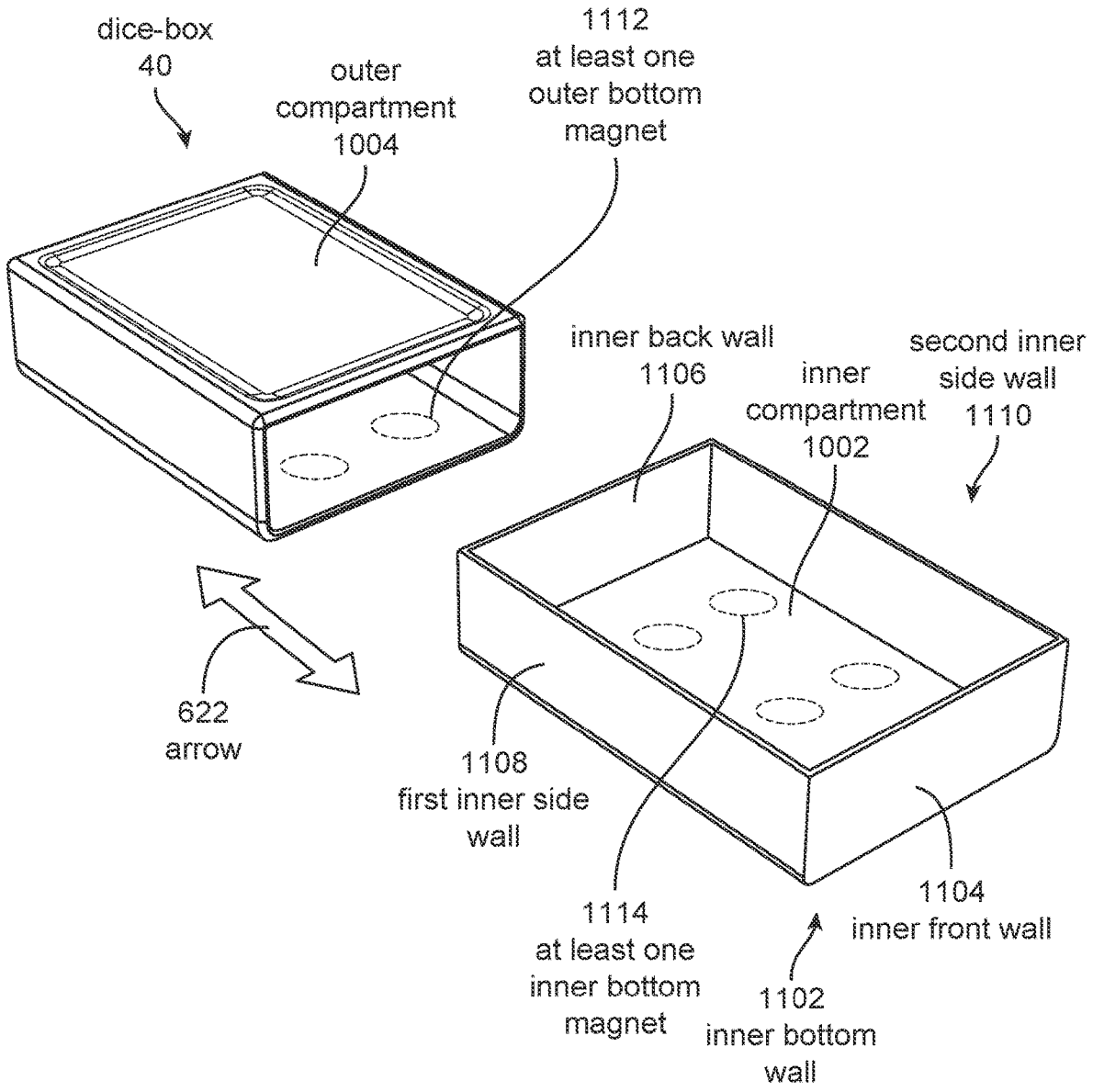
FIG. 11A illustrates a perspective view of an exemplary dice-box in an open configuration.
Figure 11B:
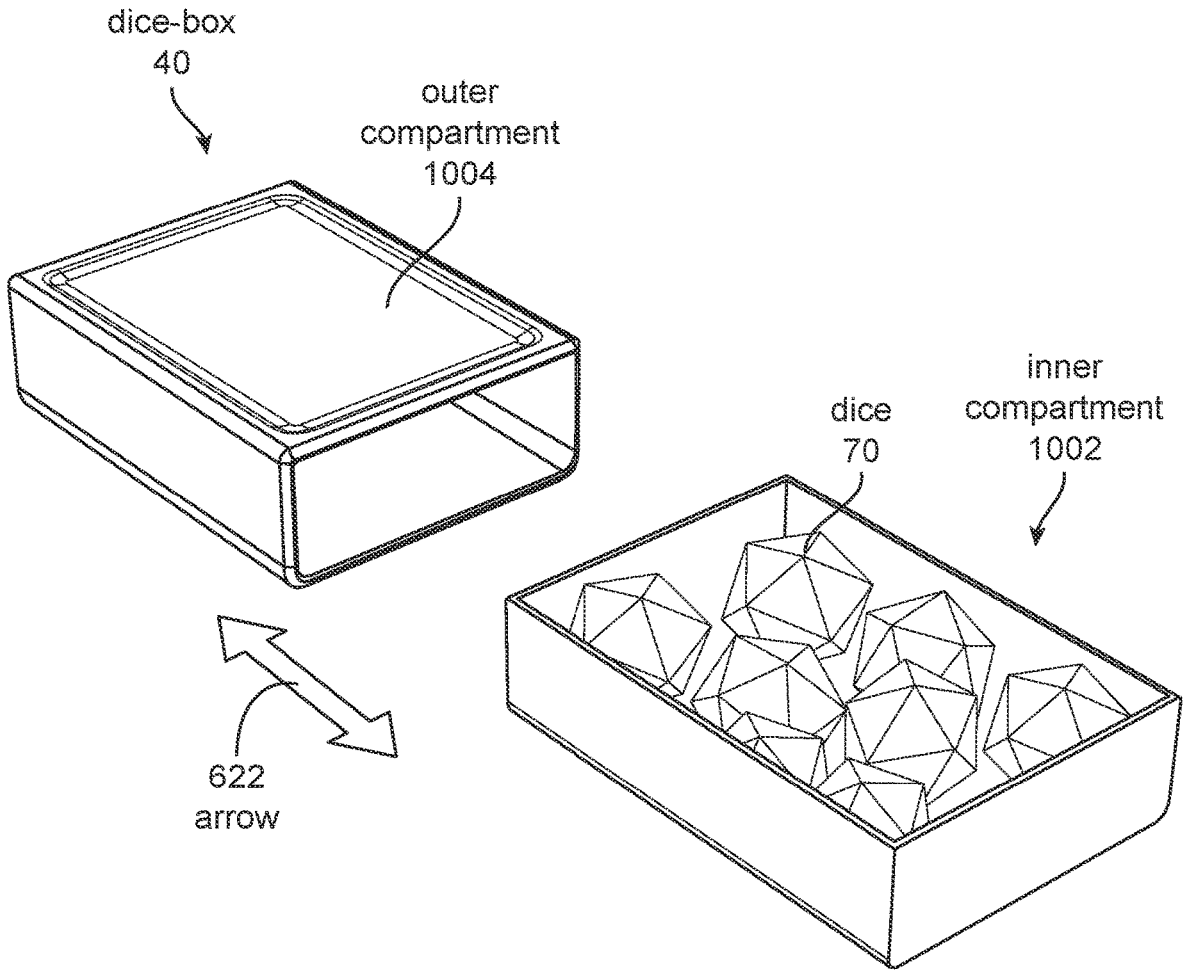
FIG. 11B illustrates the perspective view of the exemplary dice-box of FIG. 11A with die.

FIGS. 11A and 11B illustrate a perspective view of an exemplary dice-box 40 in an open configuration. Stated another way, FIG. 11A shows the exemplary dice-box 40 with the inner compartment 1002 disengaged from the outer compartment 1004 allowing for a better look at the inner compartment 1002. The dice-box 40 may be either of the dice-box 40*a* from FIG. 10A and the dice-box 40*b* of FIG. 10B.

The inner compartment 1002 may include an inner bottom wall 1102. The inner front wall 1104 and the inner back wall 1106 may be substantially perpendicular to the inner bottom wall 1102.

The inner compartment 1002 may also include a first inner side wall 1108 that extends substantially perpendicular to the inner bottom wall 1102, the inner front wall 1104, and the inner back wall 1106. The first inner side wall 1108 may couple to and close the spaces that exist between the inner front wall 1104 and the inner back wall 1106. The inner compartment 1002 may also include a second inner side wall 1110 that extends substantially perpendicular to the inner bottom wall 1102, the inner front wall 1104, and the inner back wall 1106. The second inner side wall 1110 may be opposite of and substantially parallel to the first inner side wall 1108. The second inner side wall 1110 may couple to and close the spaces that exist between the inner front wall 1104 and the inner back wall 1106.

As shown in hidden lines, the outer bottom wall 1006 may include at least one outer bottom magnet 1112. This is the case in any dice-box 40, including dice-box 40*a* of FIG. 10A and dice-box 40*b* of FIG. 10B. Also shown in FIG. 11A is hidden lines depicting at least one inner bottom magnet 1114 along the inner bottom wall 1102. When the inner compartment 1002 is slidably engaged with the outer compartment 1004, the at least one inner bottom magnet 1114 may engage with the at least one outer bottom magnet 1112 to keep the inner compartment 1002 substantially in place with the outer compartment 1004. As will be explored in FIG. 13, either the at least one outer bottom magnet 1112 and/or the at least one inner bottom magnet 1114 may magnetically engage with the playmat 20.

The inner compartment 1002 as shown forms an open top box that may receive an object or objects, such as die 70. FIG. 11B shows the dice-box 40 of FIG. 11A with some die 70 inside of the inner compartment 1002. The inner compartment 1002 may be sized so as to be insertable into the outer compartment 1004. Arrows 622 are provided to show the direction of travel when the inner compartment 1002 is inserted into the outer compartment 1004. It is understood that, as the outer compartment 1004 does not have a wall on either side where the inner compartment 1002 is inserted, the motion of travel may come from either side of the outer compartment 1004. It is also understood that the motion of travel may be reversed to remove the inner compartment 1002 from the outer compartment 1004.

FIG. 11C illustrates a bottom view of the exemplary dice-box of FIG. 11A. As shown, the inner compartment 1002 includes at least one inner bottom magnet 1114 in its inner bottom wall 1102. The at least one inner bottom magnet 1114 is shown as hidden lines to indicate that the at least one inner bottom magnet 1114 is integral to, or disposed within, the inner bottom wall 1102. Similarly, the outer compartment 1004, as shown, includes at least one outer bottom magnet 1112 in its outer bottom wall 1006. The at least one outer bottom magnet 1112 is shown as hidden lines to indicate that the at least one outer bottom magnet 1112 is integral to, or disposed within, the outer bottom wall 1006.

While the dice-box is closed, the at least one inner bottom magnet 1114 may magnetically couple to the at least one outer bottom magnet 1112. This may prevent the inner compartment 1002 from moving with respect to the outer compartment 1004, to facilitate the transport of objects within the dice-box 40 while mitigating the risk of anything falling out. The at least one outer bottom magnet 1112 may magnetically couple the dice-box 40 to a playing mat 20, as shown in FIG. 13. While not shown, the at least one inner bottom magnet 1114, which resides in a similar position as the at least one outer bottom magnet 1112, may also magnetically couple the inner compartment 1002 of the dice-box 40 to the playing mat 20.

While the at least one outer bottom magnet 1112, and the at least one inner bottom magnet 1114 are described as integral to or disposed within the outer bottom wall 1006 and the inner bottom wall 1102, respectively, this is not strictly necessary. The magnets may also be present on the surface of the outer bottom wall 1006 and the inner bottom wall 1102 without affecting the functionality of the dice-box 40.

Four outer bottom magnets 1112, as well as four inner bottom magnets 1114 are shown in FIG. 11C. However, the number of magnets present does not need to be exactly four, nor does the number of outer bottom magnets 1112 need to match the number of inner bottom magnets 1114. Any number of magnets sufficient to magnetically couple the inner compartment 1002 to the outer compartment 1004, or the outer compartment 1004 to a playing mat 20, or the inner compartment 1002 to a playing mat 20, may be provided based on the needs of the user. This may be as few as one magnet, and up to as many magnets as may reasonably fit on the outer bottom wall 1006 and the inner bottom wall 1102. While not shown, in some examples magnetic strips may be present instead of or in addition to individual magnets.

Any of the magnets described herein, including the at least one outer top magnet 1014, the at least one outer bottom magnet 1112, and the at least one inner bottom magnet 1114 may magnetically couple to magnets present on an additional dice-box 40, or the two-piece deck box 30 or folding deck box 50. In examples where the dice-box 40 includes at least one outer top magnet 1014 and at least one outer bottom magnet 1112, an additional dice-box 40, a two-piece deck box 30, and/or a folding deck box 50 may be present on either side of the dice-box 40, allowing for easier carrying of multiple components. Additionally, in these examples where the dice-box 40 includes at least one outer top magnet 1014 and at least one outer bottom magnet 1112, the dice-box 40 may magnetically couple to the playmat 20, while permitting another dice-box 40, two-piece deck box 30, or folding deck box 50 to magnetically couple to the opposing side of the dice-box 40.

FIG. 12A illustrates a perspective view of an exemplary dice-box 40 with the inner compartment 1002 magnetically coupled to the outer compartment 1004 from the outside. The dice-box 40 may be either of the dice-box 40*a* from FIG. 10A and the dice-box 40*b* of FIG. 10B.

The at least one inner bottom magnet 1114 may interact with the at least one outer bottom magnet 1112 from the outside surface, allowing access to the contents of the inner compartment 1002. In examples including at least one top outer magnet 1014, the at least one inner bottom magnet 1114 may couple to the at least one top outer magnet 1014 from the outside surface. While not shown, it is understood that the at least one inner bottom magnet 1114 may also couple to the at least one outer bottom magnet from the outside surface, thus forming the configuration shown in FIGS. 12A and 12B without the presence of at least one top outer magnet. FIG. 12B illustrates the perspective view of the exemplary dice-box 40 of FIG. 12A with die 70.

In both FIGS. 12A and 12B, an insert 1202 is present. The insert 1202 may allow a user to compartmentalize the dice-box 40. As shown in FIG. 12B, the insert 1202 may be used to separate different types of dice 70.

Figure 13:
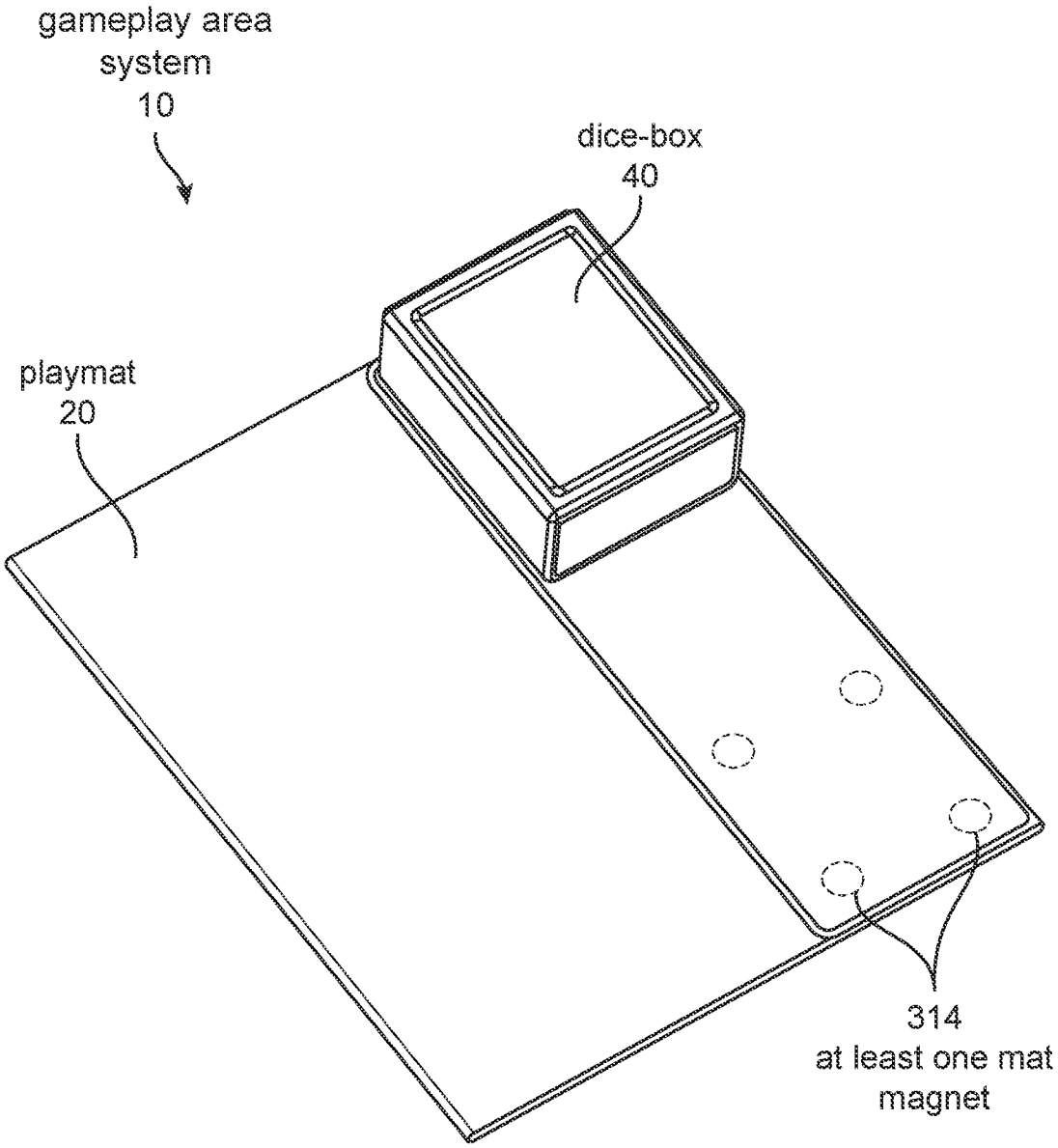
FIG. 13 illustrates a perspective view of an exemplary dice-box magnetically coupled to an exemplary playmat.

FIG. 13 illustrates a perspective view of an exemplary dice-box 40 magnetically coupled to an exemplary playmat 20, creating a two-component gameplay area system 10. As can be seen in FIG. 13, the playmat 20 includes two distinct docking areas. The bottom docking area is exposed, showing hidden circles indicating included mat magnets 314 within the playmat 20. The other docking area is covered by the dice-box 40, where either the at least one outer top magnet 1014 or the at least one outer bottom magnet 1112 are magnetically coupled to the mat magnets 314 in this location. This facilitates the transport of both the playmat 20 and the dice-box 40, while still leaving room for additional components to dock to the playmat 20. As discussed previously, the inclusion of only two distinct docking areas is not intended to be limiting, and any number of distinct docking areas as can fit on the playmat 20 may be present in the gameplay area system 10.

Folding deck boxes in the prior art include a magnetic closure along the front face of the deck box. This means that the magnets are providing retention against a shear force to keep the deck box closed. Some prior art solutions include a mechanical cleat feature to assist the magnets in keeping the deck box closed. The present invention places the magnets at the bottom of the folding deck box 50, which allows magnetic retention through tensile force rather than shear, and thus mitigate the risk of the folding deck box 50 opening during incidental impact, such as being dropped. Additionally, the cover may be inset into a molded shell so that, during an impact, the forces are applied to shell, preventing any shock from traveling into the cover or magnets. Folding deck boxes in the prior art have covers that lay proud so that they rest on the top lip of the folding deck box walls. This forces the cover to bear the brunt of an impact if the landing occurs in that region, which will often cause the deck box to unintentionally open.

Figure 14A:
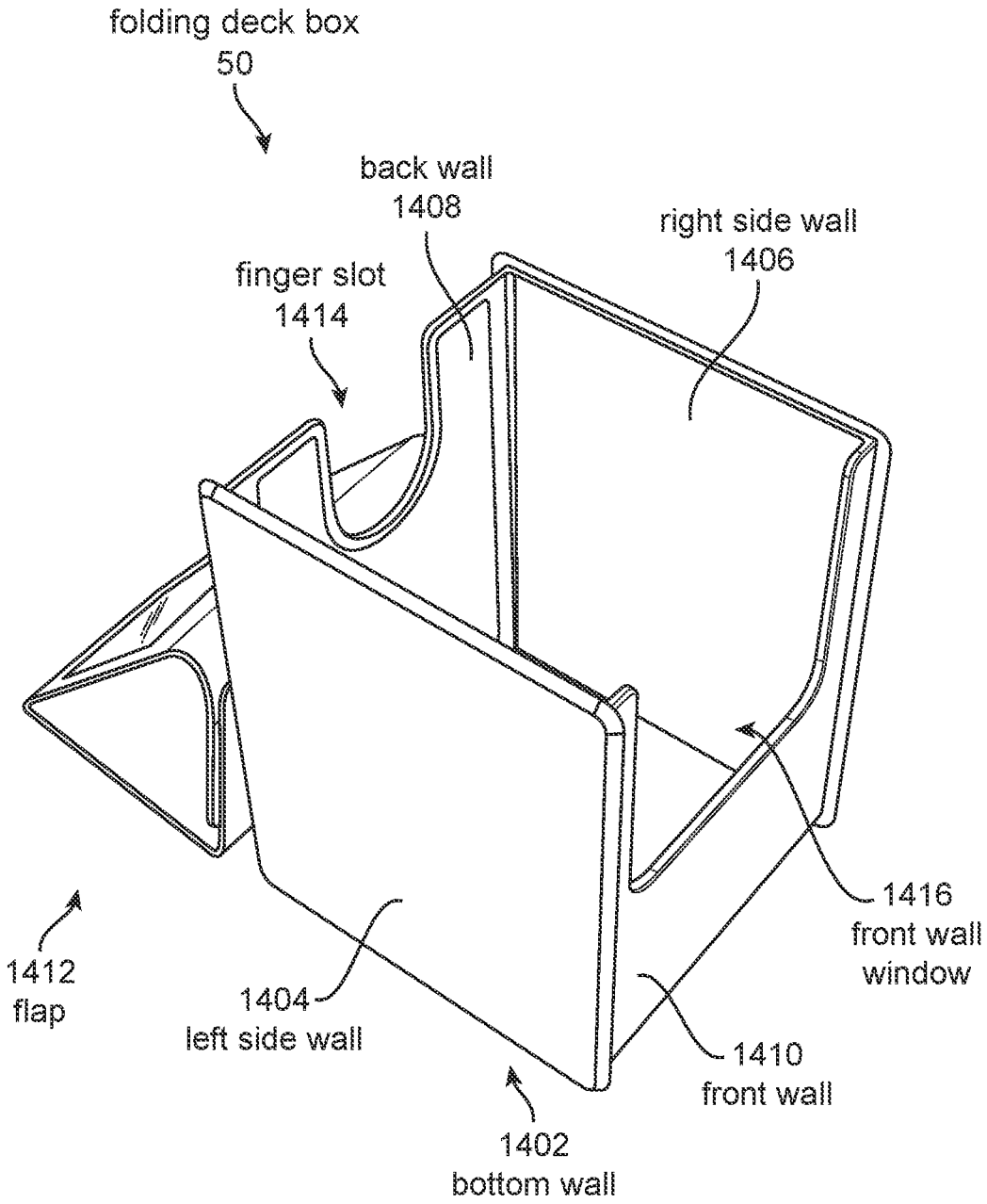
FIG. 14A illustrates a perspective view of an exemplary folding deck box in a fully open configuration.
Figure 14B:
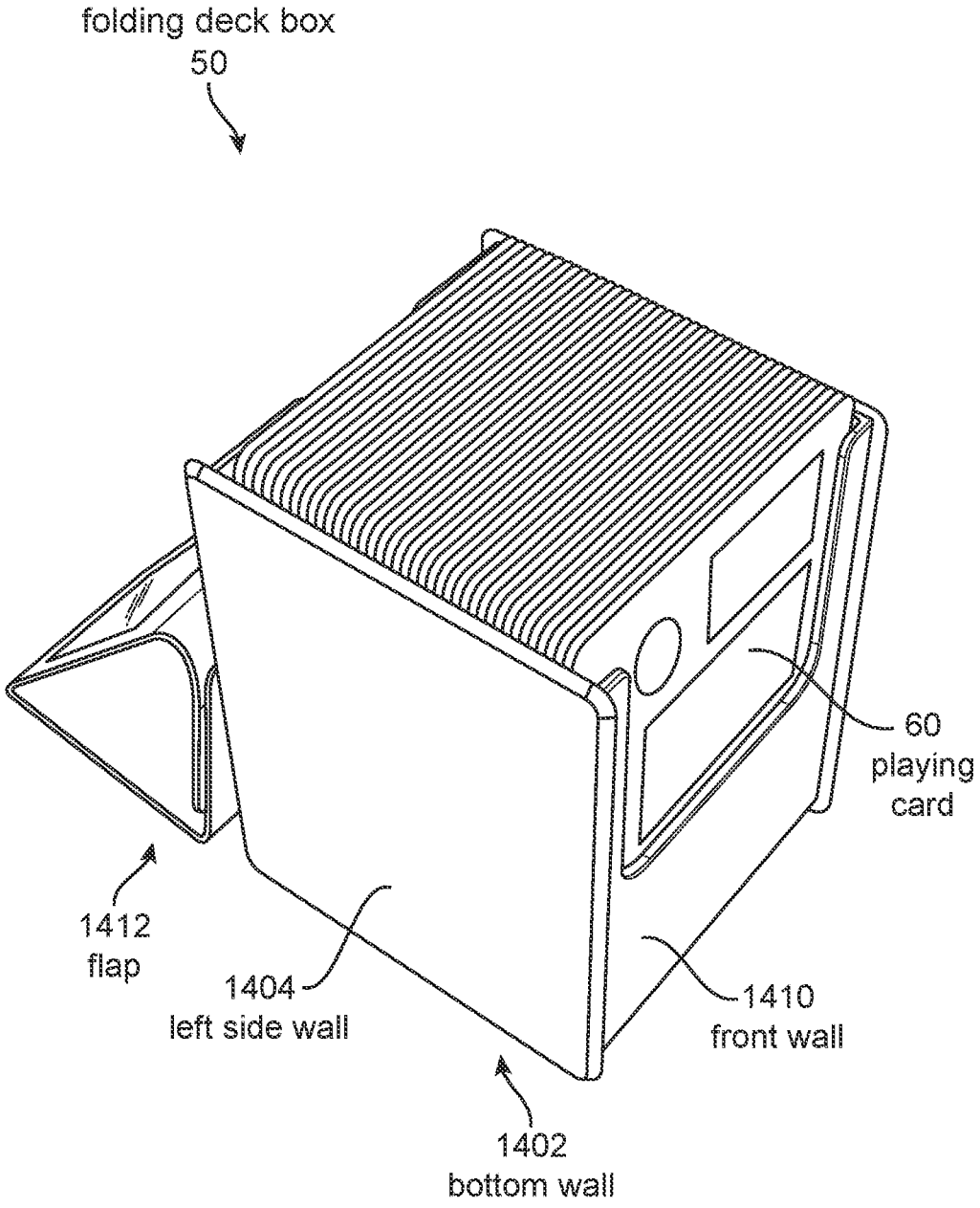
FIG. 14B illustrates the perspective view of the exemplary folding deck box of FIG. 14A with cards.

FIGS. 14A and 14B illustrate a perspective view of an exemplary folding deck box 50 in a fully open configuration. FIG. 14A describes an empty folding deck box 50, and FIG. 14B describes a folding deck box 50 containing playing cards 60. As is shown in FIGS. 14A and 14B, the folding deck box 50 may include a bottom wall 1402. A left side wall 1404 may extend substantially perpendicular to the bottom wall 1402. A right side wall 1406 may extend substantially perpendicular to the bottom wall 1402 as well, and the right side wall 1406 may couple to the bottom wall 1402 along an edge opposite that of the left side wall 1404.

The folding deck box 50 may include a back wall 1408 extending substantially perpendicular to the bottom wall 1402, the left side wall 1404, and the right side wall 1406. The back wall 1408 may couple to and close the spaces that exist between the left side wall 1404 and the right side wall 1406. The folding deck box 50 may also include a front wall 1410 extending substantially perpendicular to the bottom wall 1402, the left side wall 1404, and the right side wall 1406. The front wall 1410 may couple to the bottom wall 1402 along an edge opposite that of the back wall 1408. The front wall 1410 may couple to and close the spaces that exist between the left side wall 1404 and the right side wall 1406.

In some examples, the folding deck box 50 includes a flap 1412. When the flap 1412 is folded away from the folding deck box 50 (i.e., not covering the folding deck box 50), it may reside behind the back wall 1408. In this configuration, the at least one flap magnet 1704 may magnetically couple the flap 1412 to the at least one back magnet 1802 in order to keep the flap 1412 out of the way, but still close to the folding deck box 50, permitting a smaller footprint while in its open configuration. The flap 1412 is described in greater detail in FIGS. 15A, 15B, and 17A.

According to some examples, the back wall 1408 includes a finger slot 1414. The finger slot 1414 may be viewed as a small cutout from the top of the back wall 1408, approximately in the middle of the back wall 1408, although this placement is not strictly necessary. This finger slot 1414 may facilitate a user's ability to retrieve playing cards 60 (as seen in FIG. 14B) from the folding deck box 50. The finger slot 1414 may be sized so as to accept the digit size of the majority of users.

Folding deck boxes in the prior art generally use opaque covers, relying on exterior art for identification of the card deck contained within the folding deck box. According to the present disclosure, a solution to this problem includes the front wall 1410 comprising a front wall window 1416 through which the front playing card 60 may be viewed. This is beneficial as it allows the user to view the front-most playing card 60 without having to open the folding deck box 50 or rely on exterior artwork. This front wall window 1416 may also be useful in showing off a playing card 60 that the user would like to promote to others in the vicinity while the folding deck box 50 is in a close configuration. The front wall window 1416 may be viewed as a rectangular cutout from the front wall 1410, much larger in size than the finger slot 1414 as described previously. The front wall window 1416 may allow a user to view the artwork on their playing cards 60, or at least the forwardmost playing card 60 within the folding deck box 50, without removing the playing card 60 from the folding deck box 50. An example of how the artwork of a playing card 60 may line up with the front wall window 1416 may be seen in FIG. 14A. The front wall window 1416 may also be sized and positioned to line up with a front portion window 1510 in the flap 1412 (see FIGS. 15A, 15B, 16, and 17A).

Figure 15A:
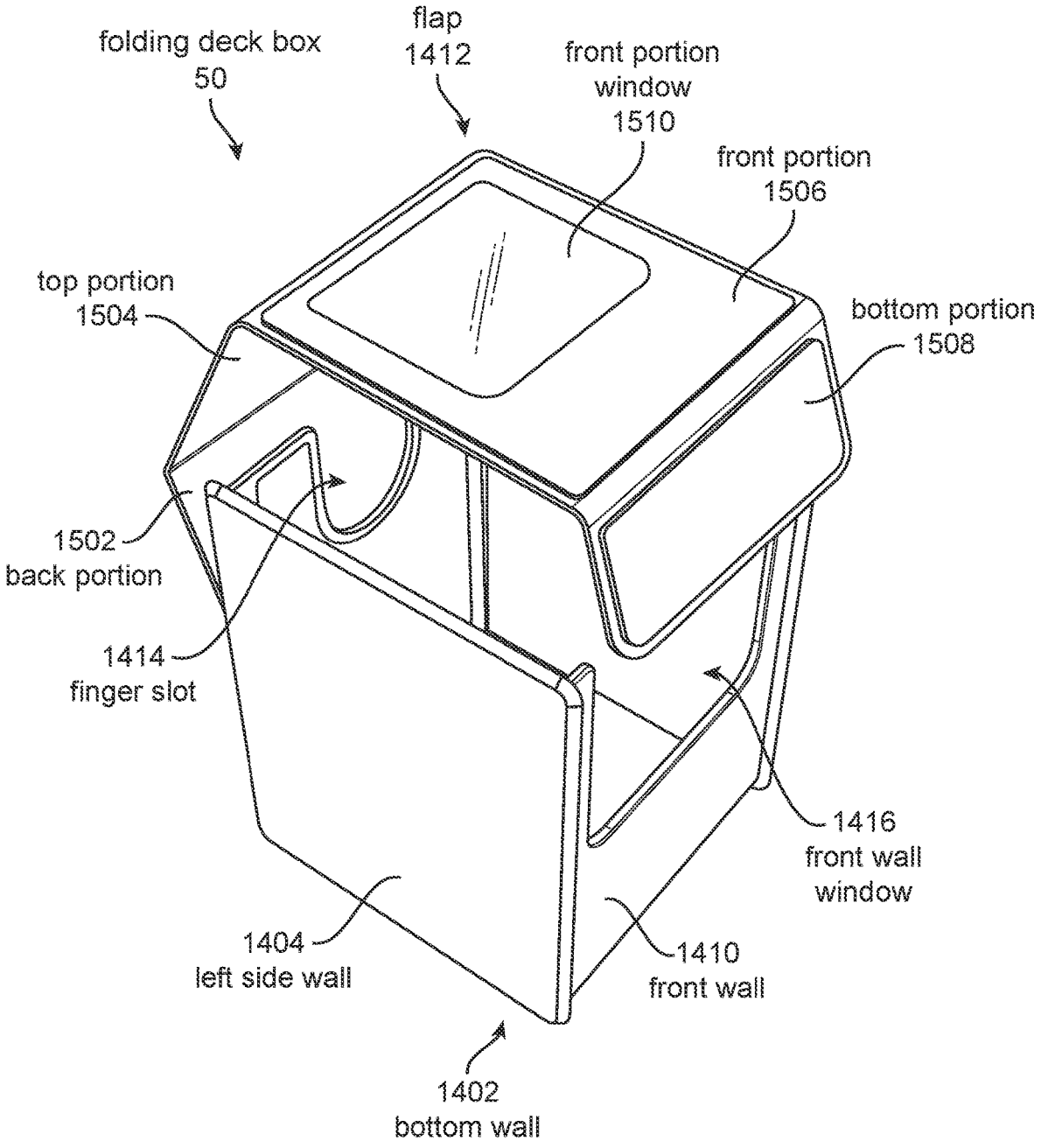
FIG. 15A illustrates a perspective view of an exemplary folding deck box while in the process of closing.
Figure 15B:
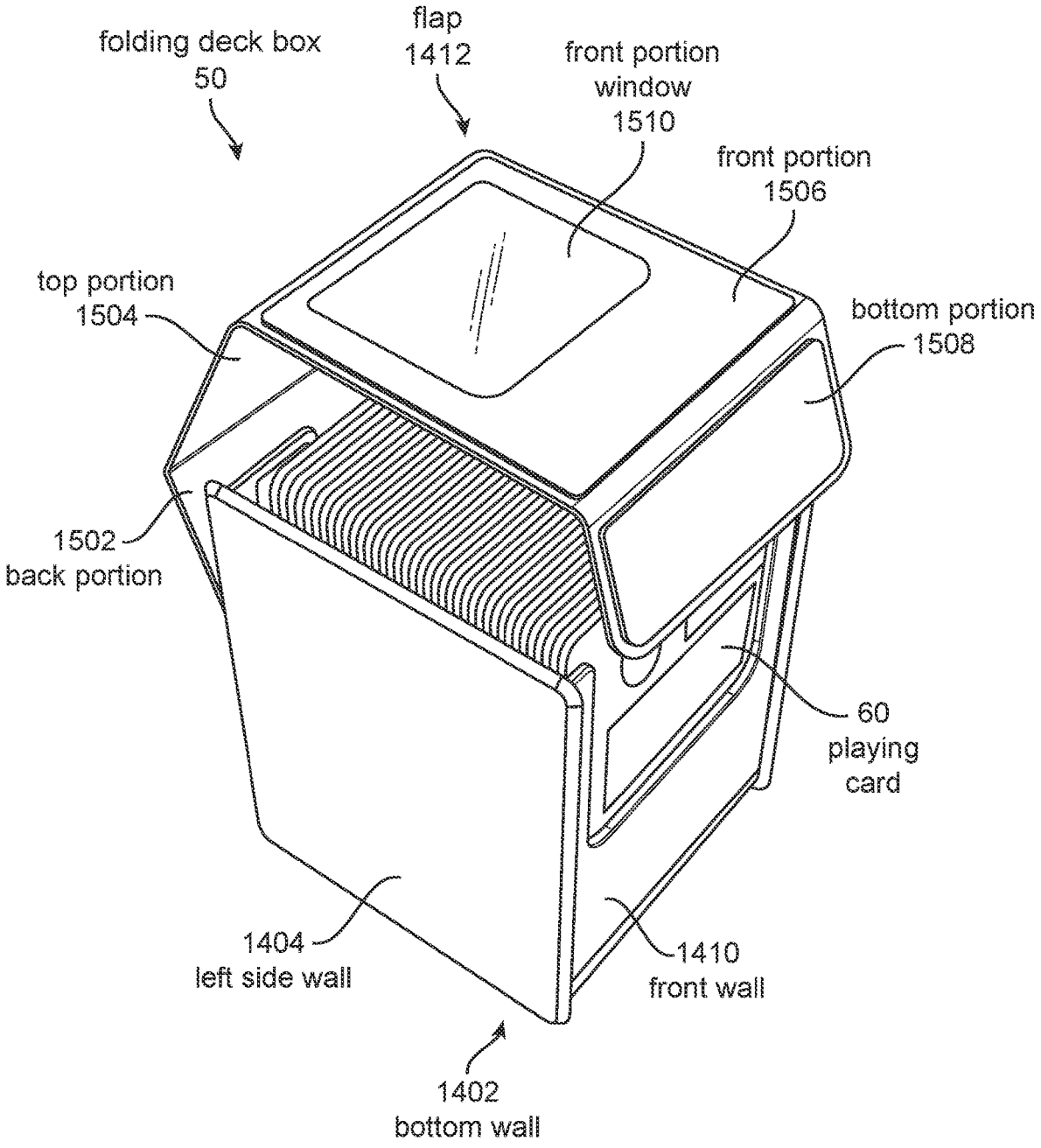
FIG. 15B illustrates the perspective view of the exemplary folding deck box of FIG. 15A with cards.

FIGS. 15A and 15B illustrate a perspective view of an exemplary folding deck box while in the process of closing. FIG. 15A describes an empty folding deck box 50, and FIG. 15B describes a folding deck box 50 containing playing cards 60. The walls of the folding deck box 50 are the same as those described in FIGS. 14A and 14B, but FIGS. 15A and 15B show the flap 1412 in greater detail.

In some examples, the flap 1412 includes back portion 1502 rotatably coupled to the outside of the back wall 1408. The back portion 1502 may rotate about the line of coupling between the back portion 1502 and the back wall 1408. According to some examples, the flap 1412 includes a top portion 1504 rotatably coupled to the back portion 1502. The top portion 1504 may rotate about the line of coupling between the top portion 1504 and the back portion 1502.

Additionally or alternatively, the flap 1412 may include a front portion 1506 rotatably coupled to the top portion 1504. The front portion 1506 may rotate about the line of coupling between the front portion 1506 and the top portion 1504. In some examples, the flap 1412 includes a bottom portion 1508 rotatably coupled to the front portion 1506. The bottom portion 1508 may rotate about the line of coupling between the bottom portion 1508 and the front portion 1506.

In some examples, the front portion 1506 includes a front portion window 1510. The front portion window 1510 may at least partially align with a front wall window 1416 in the front wall 1410 of the folding deck box 50. The front portion window 1510 may allow a user to view the artwork on their playing cards 60, or at least the forwardmost playing card 60 within the folding deck box 50 while the folding deck box is in a closed configuration (FIG. 16).

Additionally or alternatively, the bottom portion 1508 may include at least one flap magnet 1704 for magnetically coupling to the bottom wall 1402 of the folding deck box 50. This is explored in greater detail in FIGS. 17A, 17B, and 17C.

Figure 16:
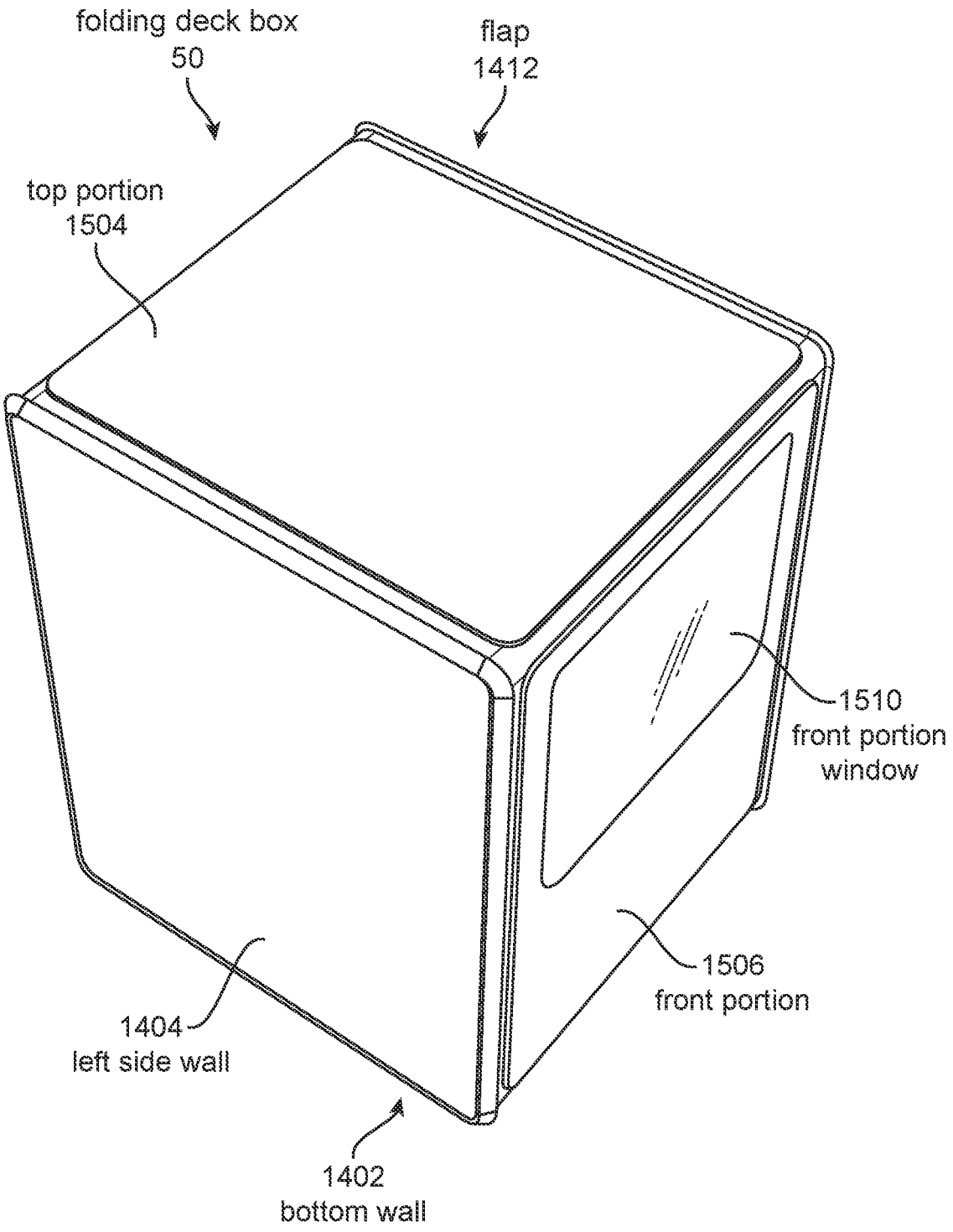
FIG. 16 illustrates a perspective view of an exemplary folding deck box while fully closed.

FIG. 16 illustrates a perspective view of an exemplary folding deck box 50 while fully closed. FIG. 16 makes it clearer that the front portion window 1510 will line up with the front wall window 1416 while in a closed configuration, thus permitting the user to see the artwork on their forwardmost playing card 60 while the folding deck box 50 is closed.

Figure 17A:
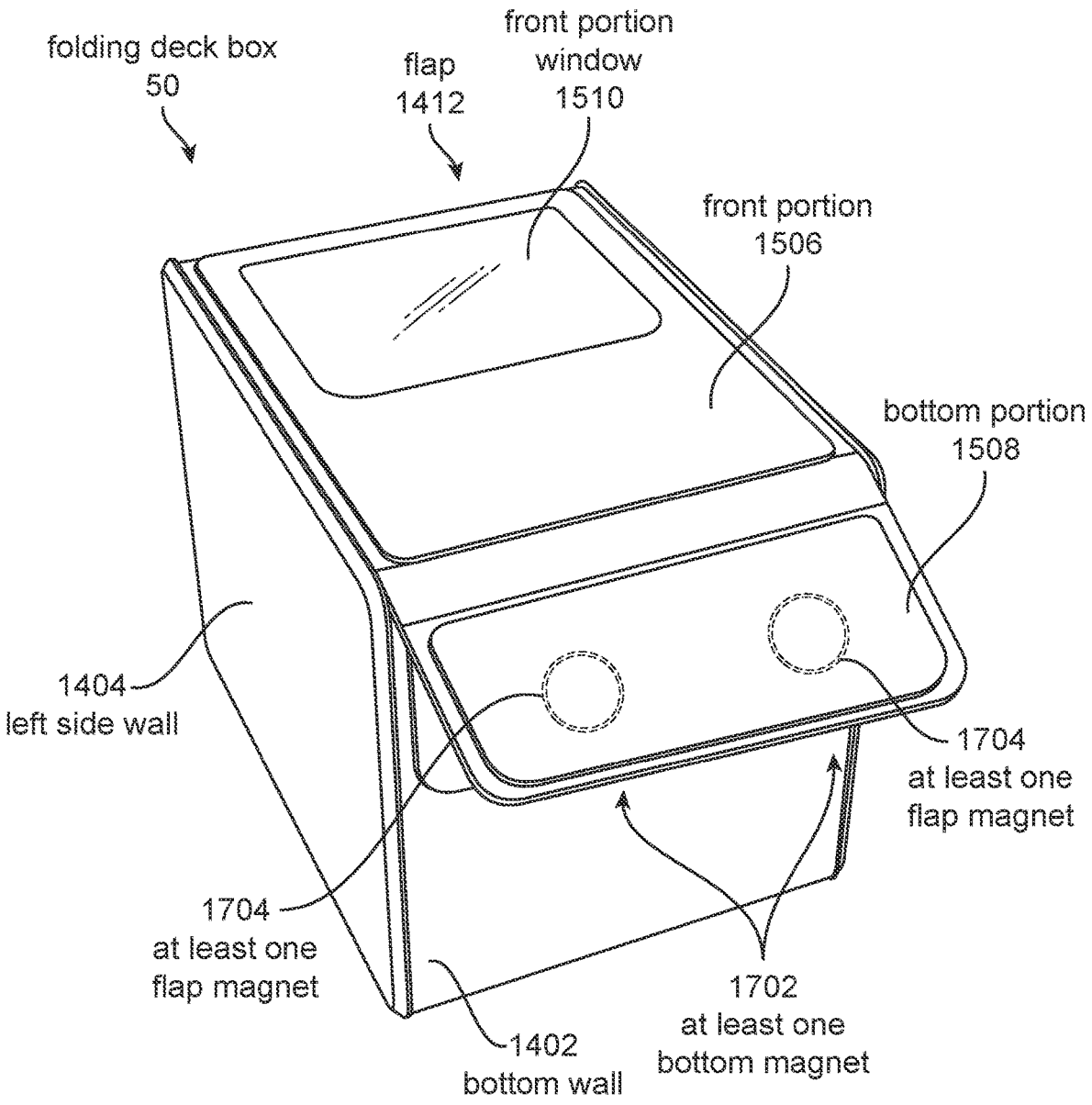
FIG. 17A illustrates a perspective view of an exemplary folding deck box with a bottom portion of a flap decoupled from the folding deck box.

FIG. 17A illustrates a perspective view of an exemplary folding deck box 50 with the bottom portion 1508 of the flap 1412 decoupled from the folding deck box 50. As can be seen in FIG. 17A, the bottom portion 1508 of the flap 1412 may include at least one flap magnet 1704. The at least one flap magnet 1704 is shown as hidden lines, as the at least one flap magnet 1704 may be integral, or disposed within, the bottom portion 1508 of the flap.

Likewise, the bottom wall 1402 of the folding deck box 50 may include at least one bottom magnet 1702. The at least one bottom magnet 1702 cannot be seen through the bottom portion 1508 of the flap 1412, but is shown in greater detail in FIG. 17B. The at least one flap magnet 1704 is positioned and configured to magnetically engage or magnetically couple to the at least one bottom magnet 1702.

Figure 17B:
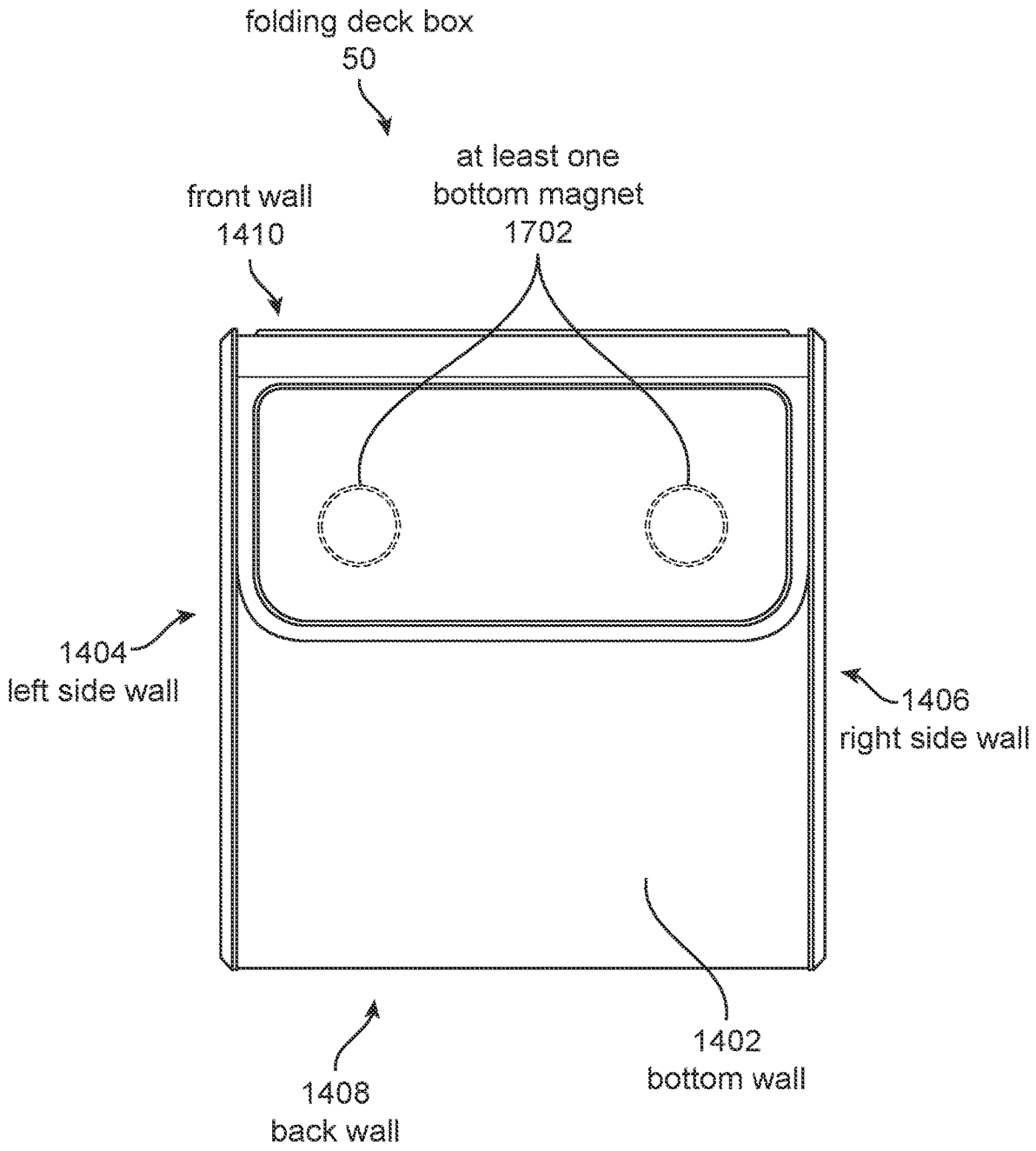
FIG. 17B illustrates a bottom view of the exemplary folding deck box of FIG. 17A without a flap present.
Figure 17C:
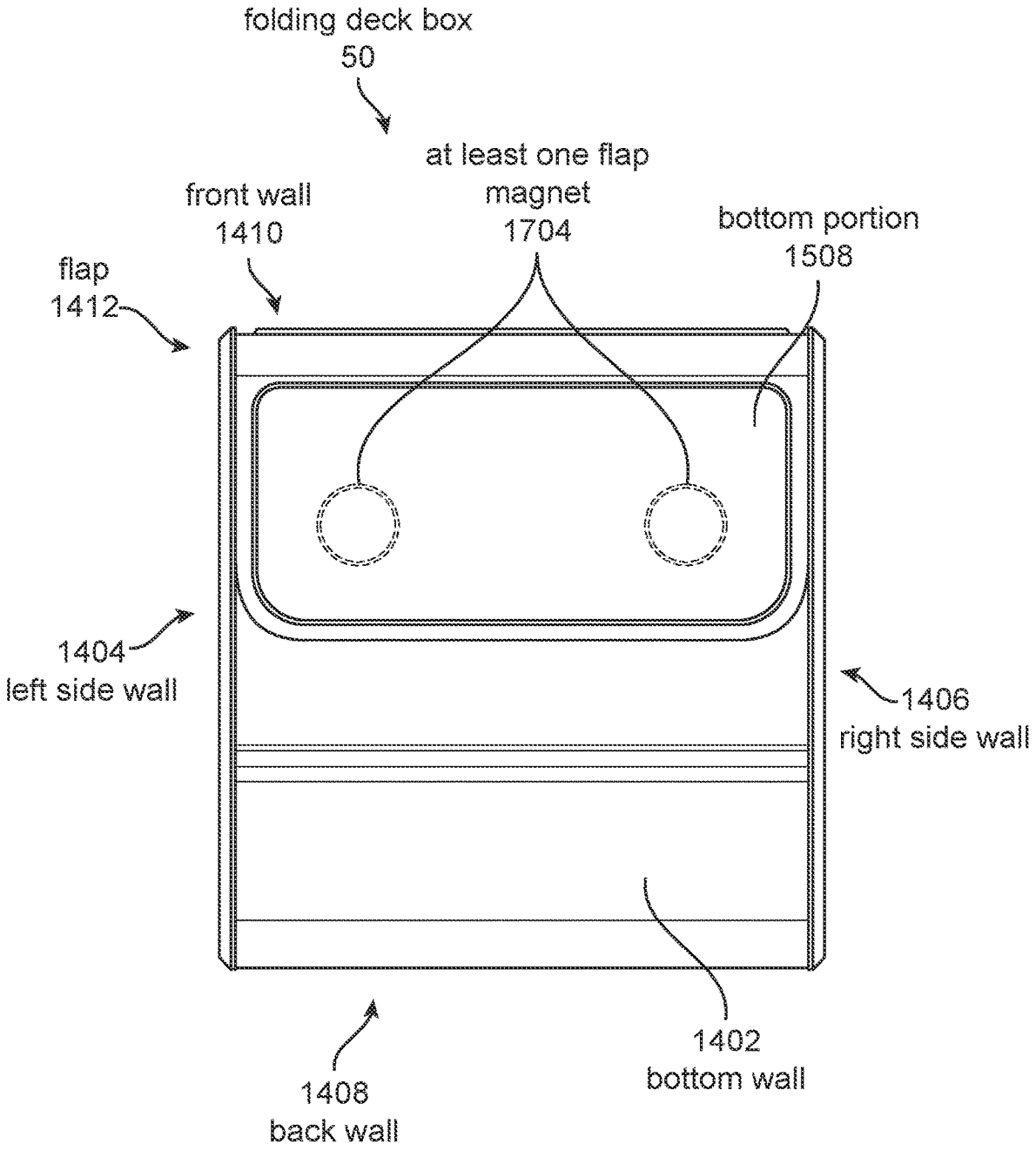
FIG. 17C illustrates a bottom view of the exemplary folding deck box of FIG. 17A with the flap coupled to folding deck box.

FIGS. 17B and 17C illustrate a bottom view of the exemplary folding deck box 50 of FIG. 17A. FIG. 17B shows the bottom view without the flap 1412 present, and FIG. 17C shows the bottom view with the flap 1412 coupled to the bottom wall 1402.

FIG. 17B shows the at least one bottom magnet 1702 as it may be presented in the bottom wall 1402 of the folding deck box 50. The at least one bottom magnet 1702 is shown as hidden lines to indicate that the at least one bottom magnet 1702 is integral to, or disposed within, the bottom wall 1402.

FIG. 17C shows the at least one flap magnet 1704 as it may be presented in the bottom portion 1508 of the flap 1412. The at least one flap magnet 1704 is shown as hidden lines to indicate that the at least one flap magnet 1704 is integral to, or disposed within, the bottom portion 1508.

While the at least one bottom magnet 1702 and the at least one flap magnet 1704 are described and shown as integral to or disposed within the bottom wall 1402 and the bottom portion 1508, respectively, this is not strictly necessary. The magnets may also be present on the surface of the bottom wall 1402 or the bottom portion 1508 without affecting the functionality of the folding deck box 50.

Two flap magnets 1704, as well as two bottom magnets 1702 are shown in FIGS. 17A, 17B, and 17C. However, the number of magnets present does not need to be exactly two, nor does the number of flap magnets 1704 need to match the number of bottom magnets 1702. Any number of magnets sufficient to magnetically couple the bottom portion 1508 of the flap 1412 to the bottom wall 1402 of the folding deck box 50 may be provided. This may be as few as one magnet, and up to as many magnets as may reasonably fit on the bottom portion 1508 of the flap 1412 and the bottom wall 1402 of the folding deck box 50. While not shown, in some examples magnetic strips may be present instead of or in addition to individual magnets.

Figure 18:
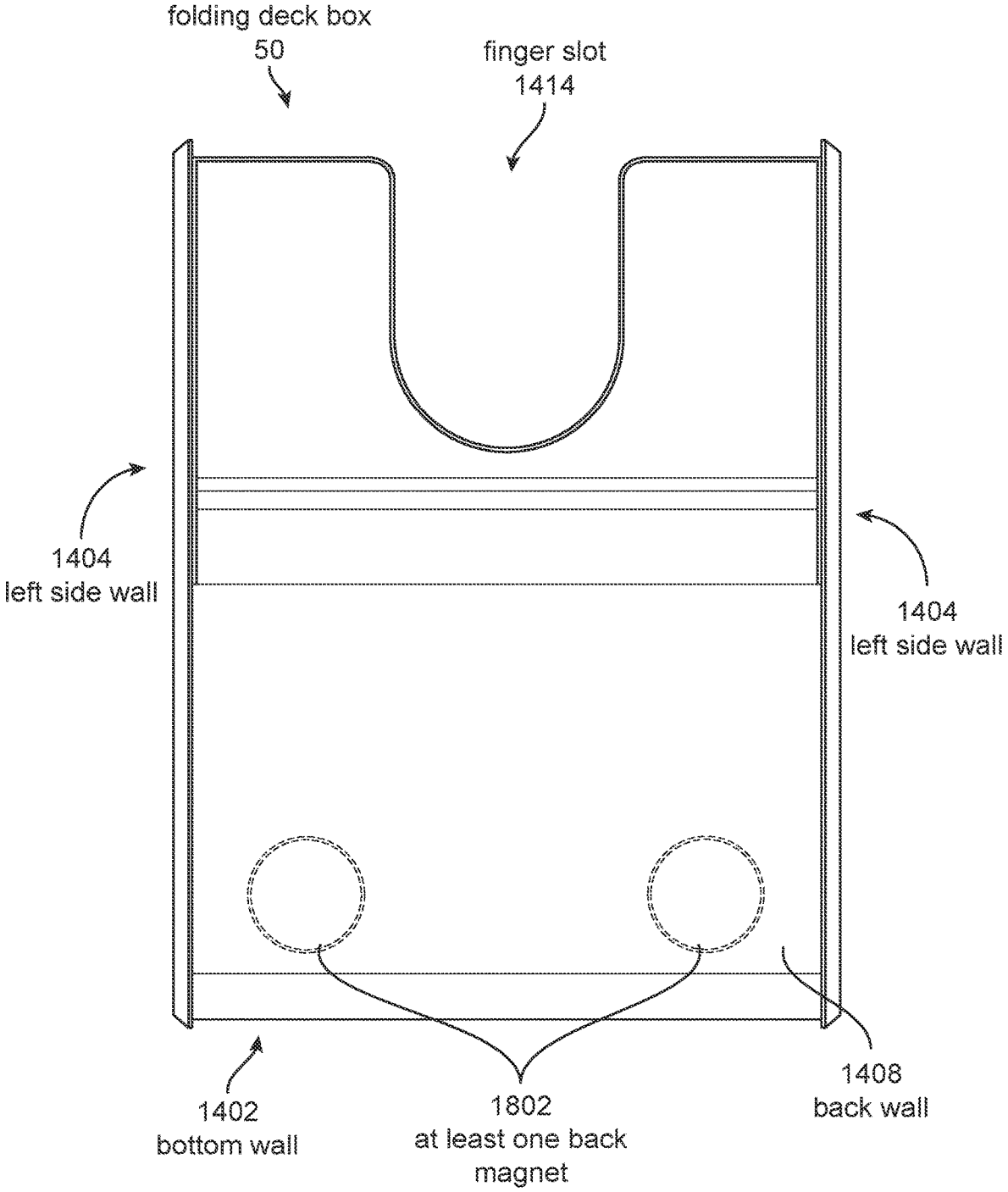
FIG. 18 illustrates a back view of an exemplary folding deck box.

FIG. 18 illustrates a back view of an exemplary folding deck box 50. The back view includes the finger slot 1414. Because in some examples, including the one shown in FIG. 18, a front wall window 1416 may be present, the front wall 1410 cannot be seen through the finger slot 1414 in this figure.

As shown, the back wall 1408 may include at least one back magnet 1802. The at least one back magnet 1802 is shown as hidden lines to indicate that the at least one back magnet 1802 is integral to, or disposed within, the back wall 1408. While the at least one back magnet 1802 is shown as integral to or disposed within the back wall 1408, this is not strictly necessary. The back magnets 1802 may also be present on the surface of the back wall 1408 without affecting the functionality of the folding deck box 50.

Four back magnets 1802 are shown in FIG. 18. However, the number of back magnets 1802 does not need to be exactly four. Any number of back magnets 1802 sufficient to magnetically couple the folding deck box 50 to a playmat 20 may be present. This may be as few as one back magnet 1802, and up to as many back magnets 1802 as may reasonably fit on the back wall 1408. Additionally, the at least one back magnet 1802 may be positioned as such to permit magnetic coupling with any magnets present on the two-piece deck box 30 and/or the dice-box 40.

Figure 19:
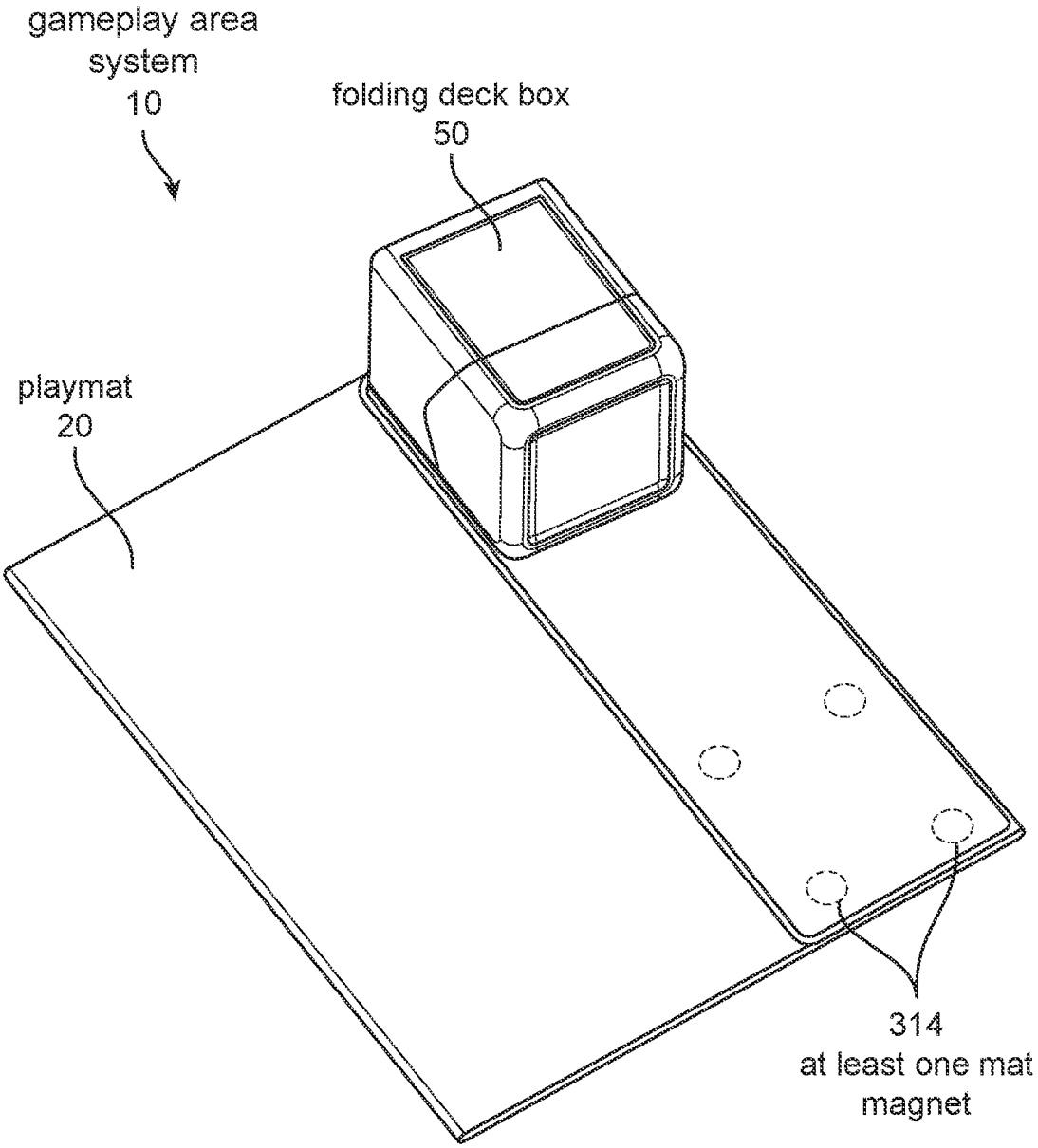
FIG. 19 illustrates a perspective view of an exemplary folding deck box magnetically coupled to an exemplary playmat.

FIG. 19 illustrates a perspective view of an exemplary folding deck box 50 magnetically coupled to an exemplary playmat 20, creating a two-component gameplay area system 10. As can be seen in FIG. 19, the playmat 20 includes two distinct docking areas. The bottom docking area is exposed, showing hidden circles indicating included mat magnets 314 within the playmat 20. The other docking area is covered by the folding deck box 50, where either the at least one back magnet 1802 is magnetically coupled to the mat magnets 314 in this location. This facilitates the transport of both the playmat 20 and the folding deck box 50, while still leaving room for additional components to dock to the playmat 20. As discussed previously, the inclusion of only two distinct docking areas is not intended to be limiting, and any number of distinct docking areas as can fit on the playmat 20 may be present in the gameplay area system 10.

Figure 20A:
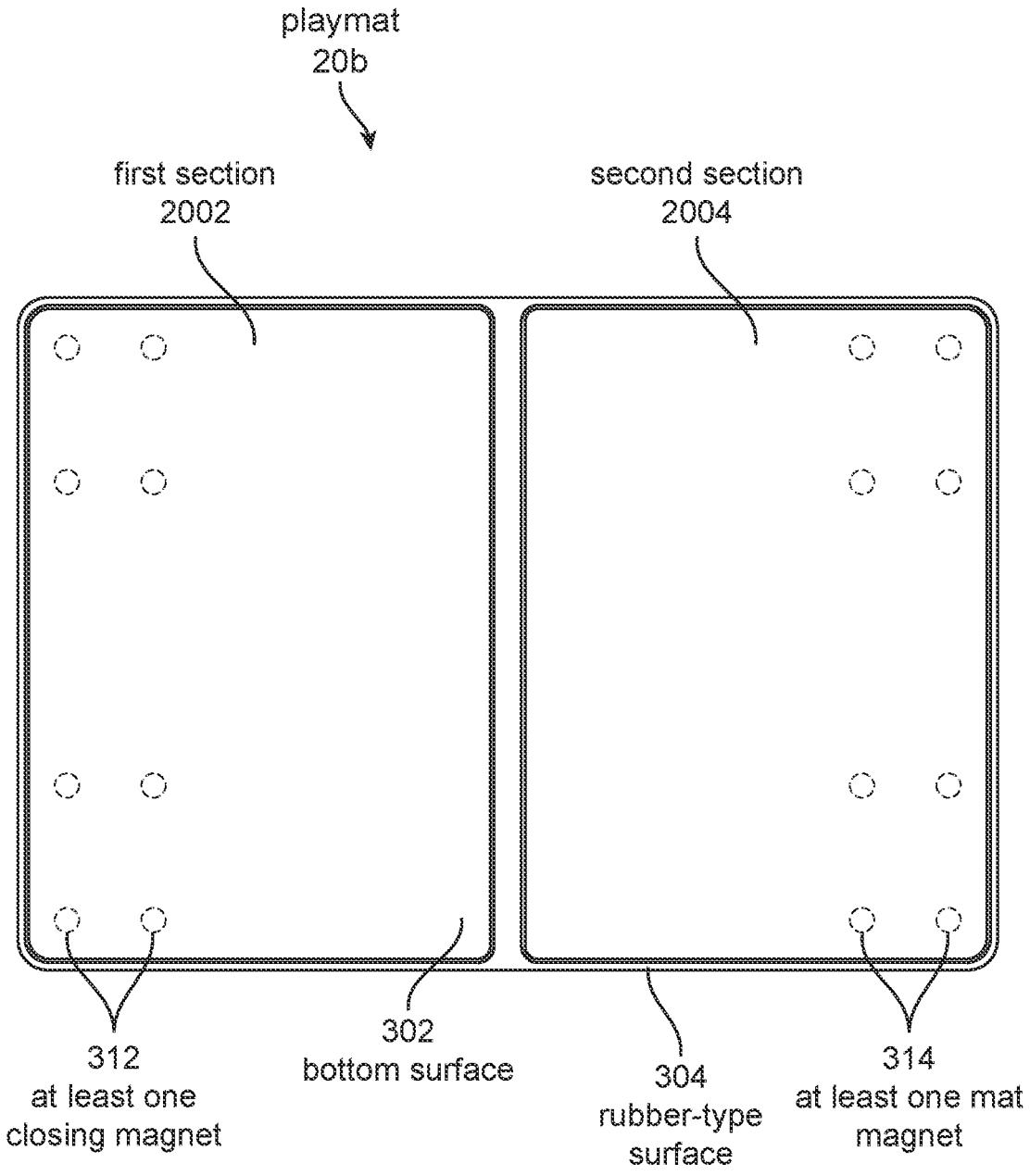
FIG. 20A illustrates a back view of an exemplary playmat.
Figure 20B:
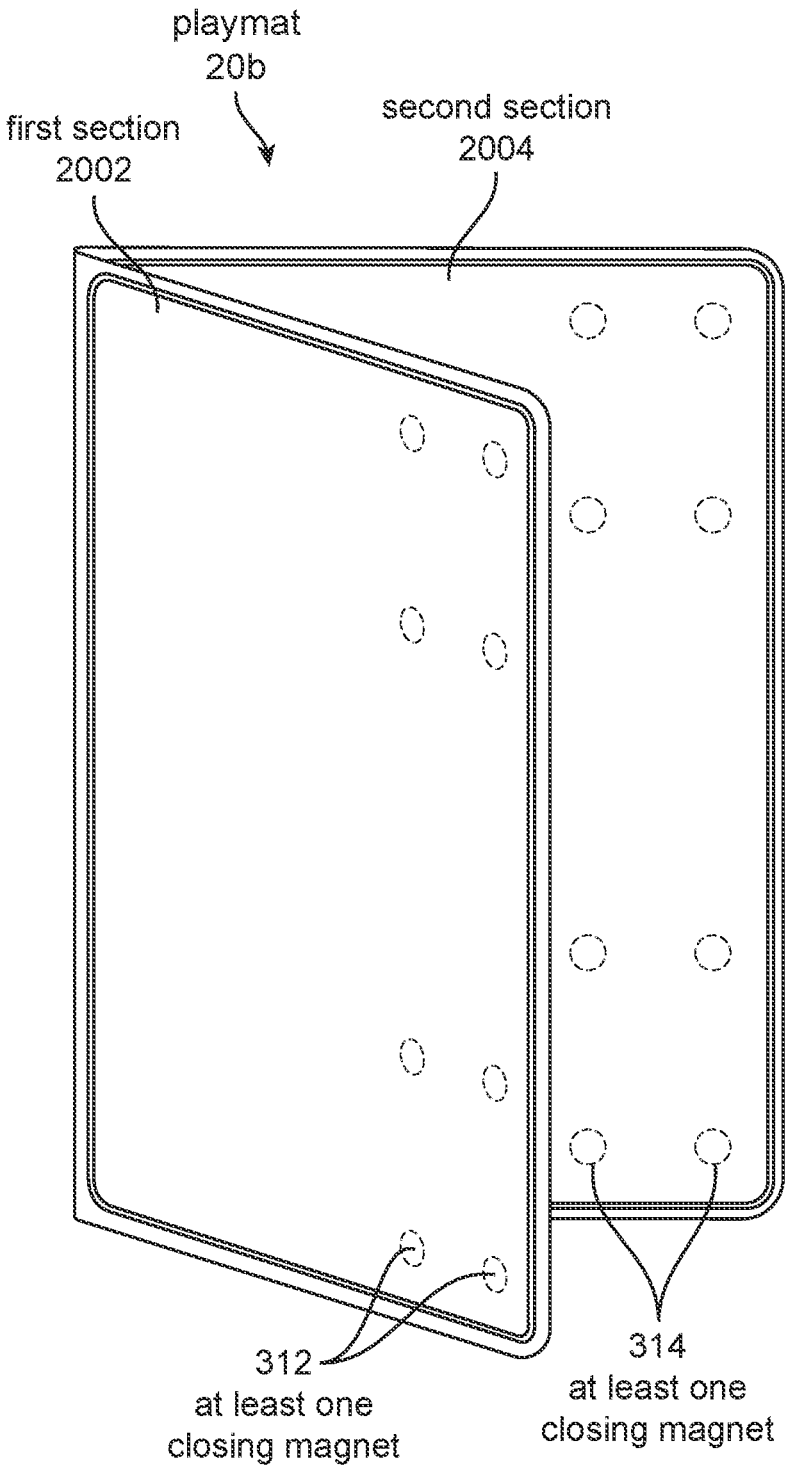
FIG. 20B illustrates a perspective view of the exemplary playmat of FIG. 20A being partially folded.
Figure 21A:
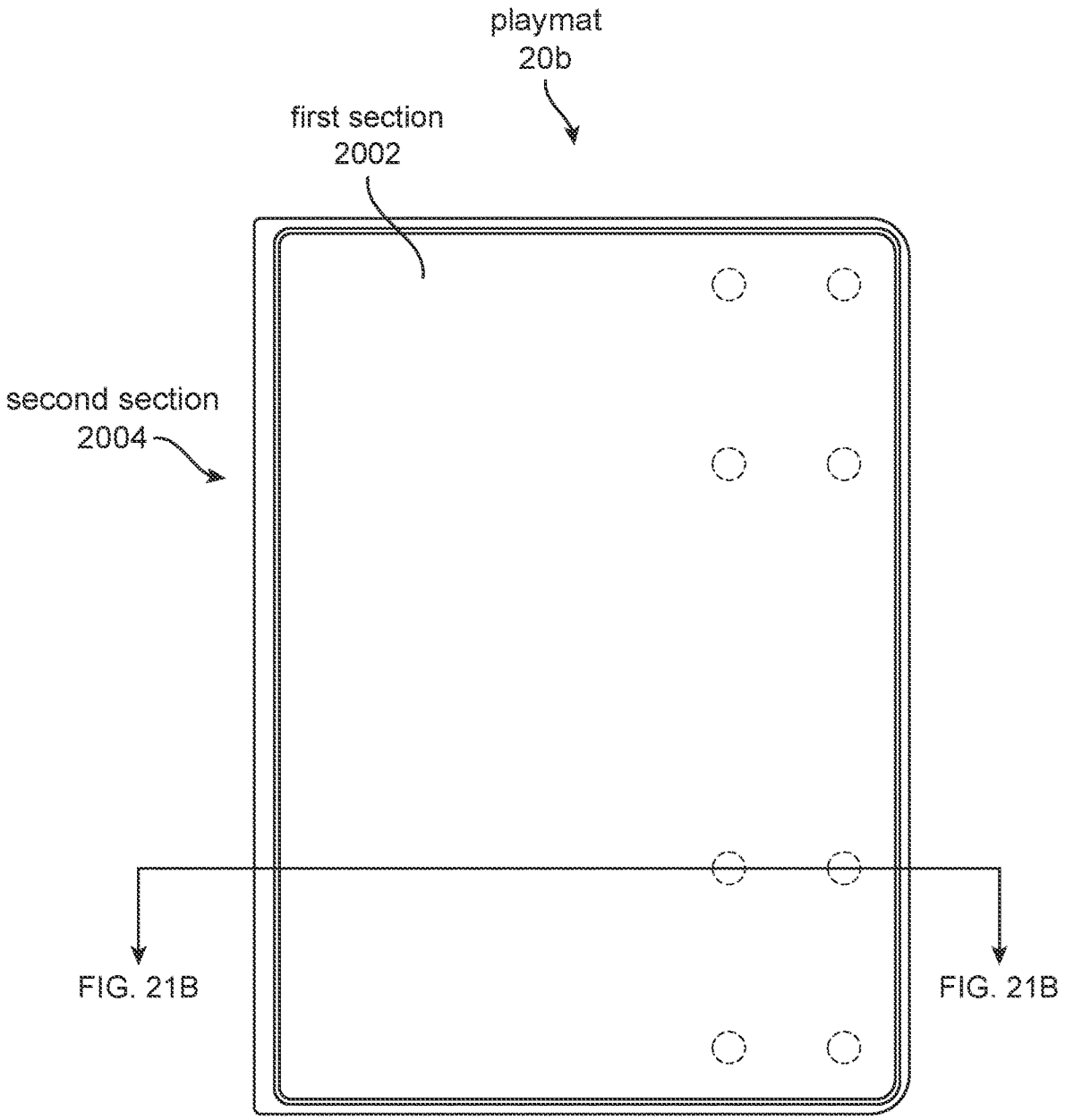
FIG. 21A illustrates a top view of the exemplary playmat of FIG. 20A with the fold completed.

FIGS. 20A, 20B, and 21 illustrate an exemplary playmat 20*b* having two panels, or sections. Specifically, FIG. 20A illustrates a back view of the exemplary playmat 20*b*, FIG. 20B illustrates a perspective view of the exemplary playmat 20*b* of FIG. 20A being partially folded, and FIG. 21A illustrates a front view of the exemplary playmat 20*b* of FIG. 20A with the fold completed. The front view of the playmat 20*b* may be very similar to the playmat 20 of FIG. 2, and as such, this view is not recreated here.

FIG. 20A illustrates the back view of exemplary playmat 20*b* having a two-paneled construction. The back view shows the bottom surface 302 as it may appear when the playmat 20*b* is laid flat. The bottom surface 302 may comprise a rubber-type surface 304. This rubber-type surface 304 helps to prevent slipping of the playmat 20*b* while in use.

The two panels of the playmat 20*b* can be viewed on the bottom surface 302. This is because the top surface 202 may be constructed as such to prevent seeing the disconnects between distinct portions, allowing a smooth playing surface. The two panels of playmat 20*b* may include a first section 2002 and a second section 2004 adjacent to the first section 2002.

The first section 2002 may include at least one closing magnet 312 within its construction, presented as hidden lines to indicate the closing magnets 312 are not flush or exposed from the surface of the first section 2002. Similarly, the second section 2004 may include at least one mat magnet 314 within its construction, again presented as hidden lines to indicate that the mat magnets 314 are not flush or exposed from the surface of the second section 2004. Eight closing magnets 312, as well as eight mat magnets 314 are shown in FIGS. 20A and 20B. However, the number of magnets present does not need to be exactly eight, nor does the number of closing magnets 312 need to match the number of mat magnets 314. Any number of magnets sufficient to magnetically couple components of the gameplay area system 10 to one another may be provided. This may be as few as one magnet, and up to as many magnets as may reasonably fit within the first section 2002 and the second section 2004 without interfering with one another. While not shown, in some examples magnetic strips may be present instead of or in addition to individual magnets.

As was described previously in FIGS. 9, 13, and 19, the magnets on both sides (the at least one closing magnet 312 and the at least one mat magnet 314) are broken into distinct sections—one section of four magnets near the top edge of the playmat 20*b*, and one section of four magnets near the bottom edge. These distinct sections are to facilitate coupling to the other distinct components of the gameplay area system 10 (i.e., the two-piece deck box 30, the dice-box 40, and the folding deck box 50). However, the number of sections need not be limited to two, and as few as one distinct section, or as many distinct sections as could reasonably fit within the confines of the playmat 20*b* may be included.

FIG. 20B illustrates the exemplary playmat 20*b* being folded for storage or transport from a perspective view. While this view is shown from the front surface, the delineation between the first section 2002 and the second section 2004 that is seen from the back surface is still drawn to facilitate visualization of the folding process. FIG. 20B shows the first section 2002 being folded over the second section 2004.

Figure 21B:
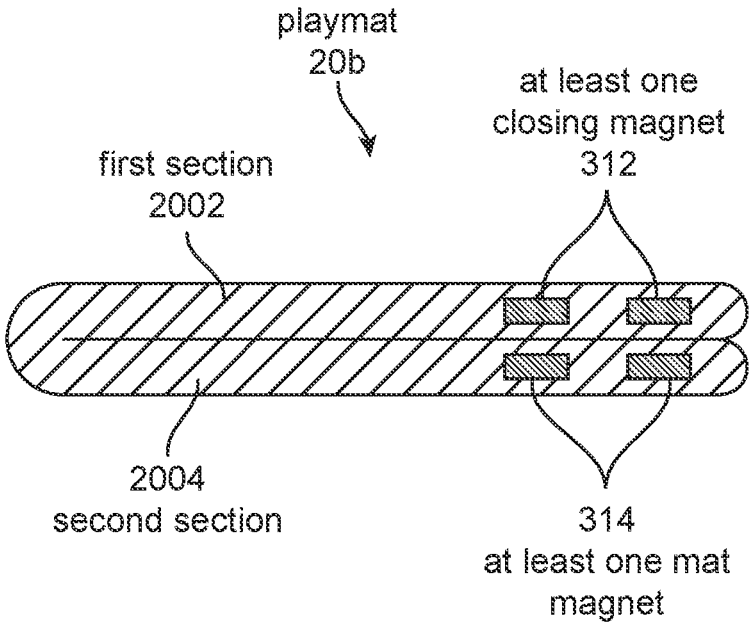
FIG. 21B illustrates a cross-sectional front view of the exemplary playmat of FIG. 20A.

FIG. 21A illustrates a top view of the playmat 20*b* after the fold has been completed. FIG. 21B illustrates a cross-sectional view of the playmat 20*b* with the thicknesses of the first section 2002 and the second section 2004 exaggerated for the purposes of illustrating the playmat 20*b* in its folded configuration. In this view, the at least one closing magnet 312 and the at least one mat magnet 314 are aligned, and in this fully closed configuration they secure the first section 2002 to the second section 2004. This may prevent the playmat 20*b* from opening without outside influence. This also exposes the at least one mat magnets 314 present in the second section 2004 to the outside, which permits magnets described previously from the two-piece deck box 30, the dice-box 40, and the folding deck box 50 to magnetically couple to this second section 2004. Because of the nature of a two-panel system having exposed magnets on either section, the at least one closing magnet 312 may perform in the same manner as the at least one mat magnet 314 in the sense that, if it were so desired, the two-piece deck box 30, the dice-box 40, and the folding deck box 50 may be magnetically coupled to the first section 2002 through these at least one closing magnets 312.

Figure 22A:
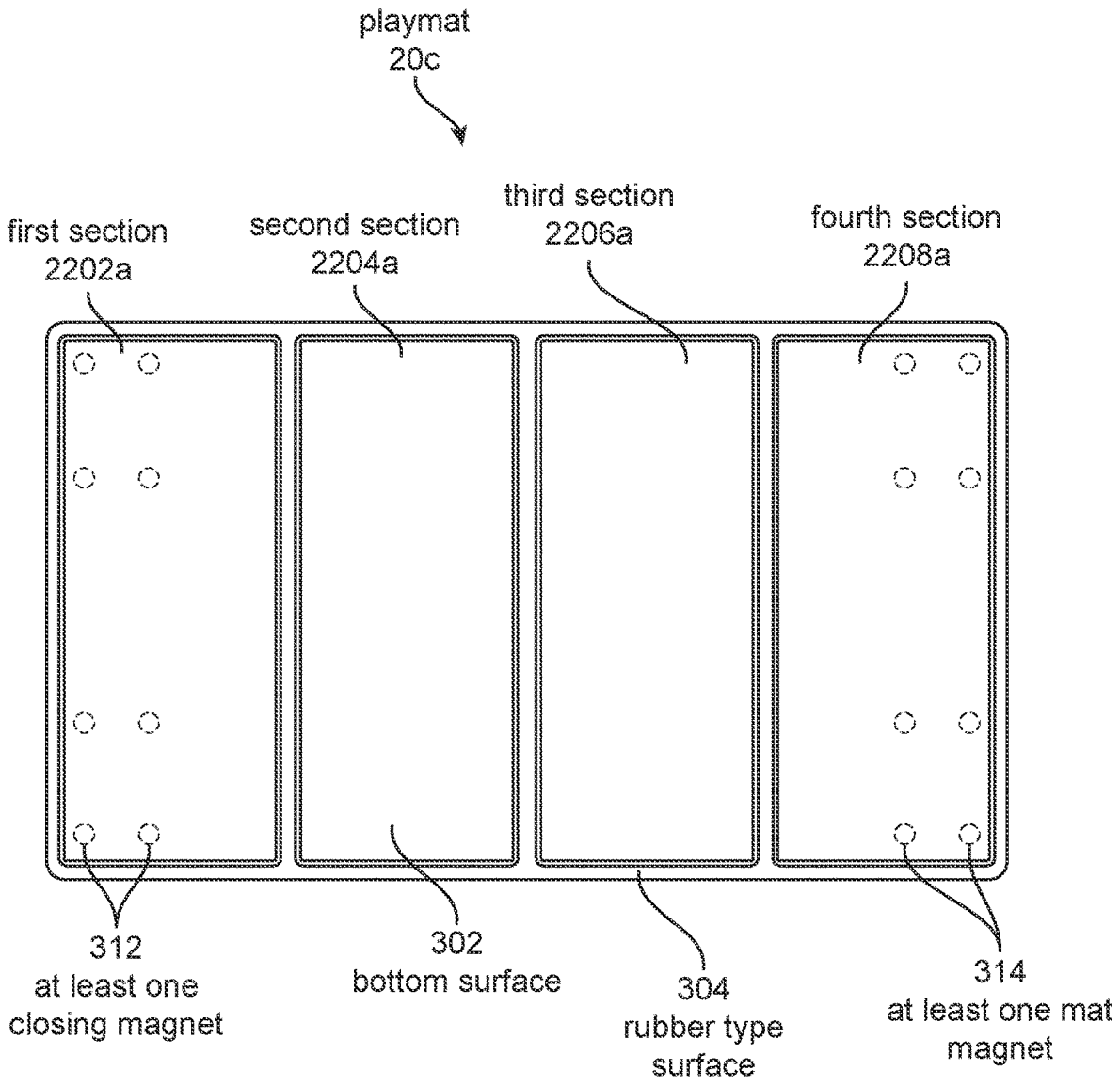
FIG. 22A illustrates a back view of an exemplary playmat.
Figure 22B:
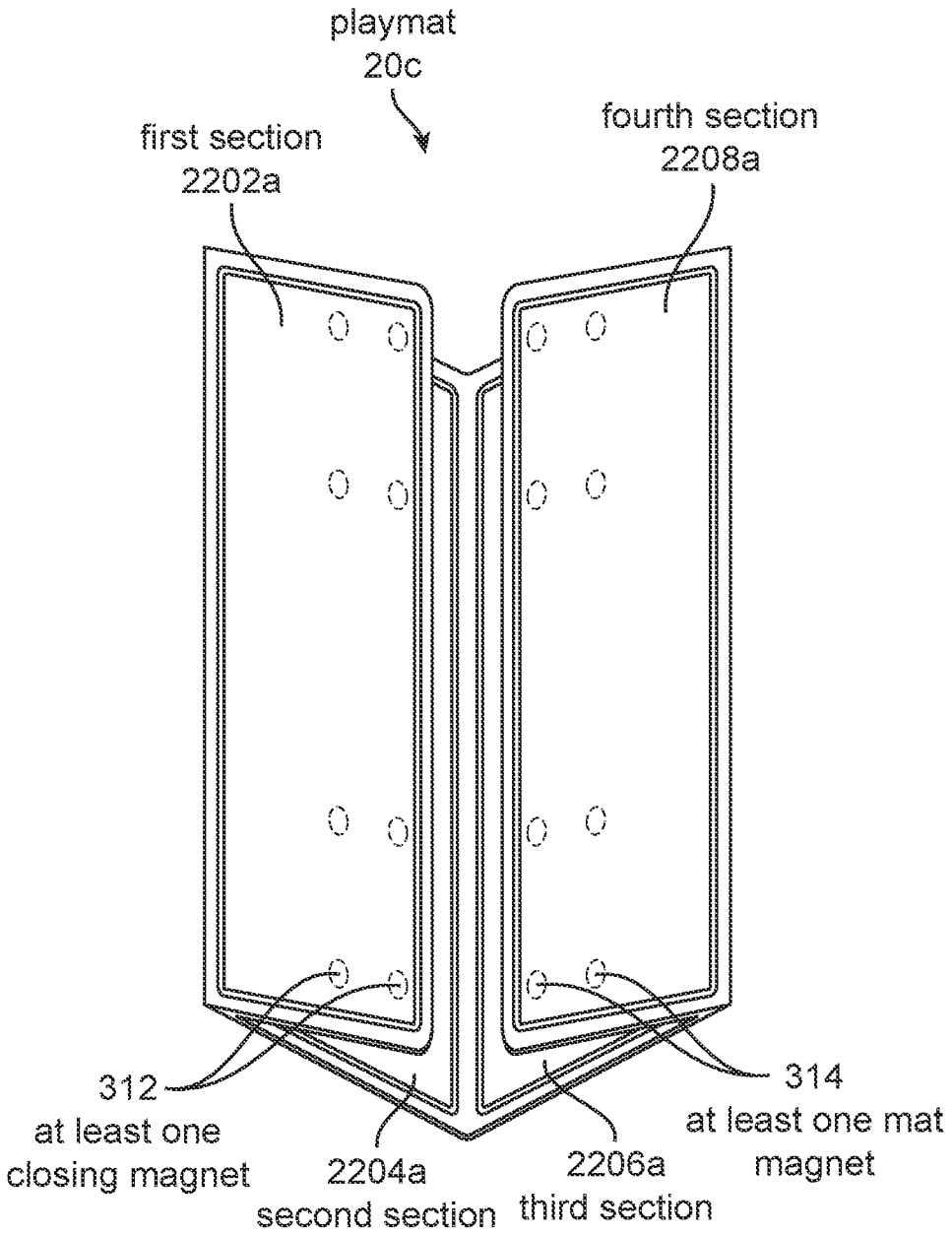
FIG. 22B illustrates a perspective view of the exemplary playmat of FIG. 22A being partially folded.
Figure 23A:
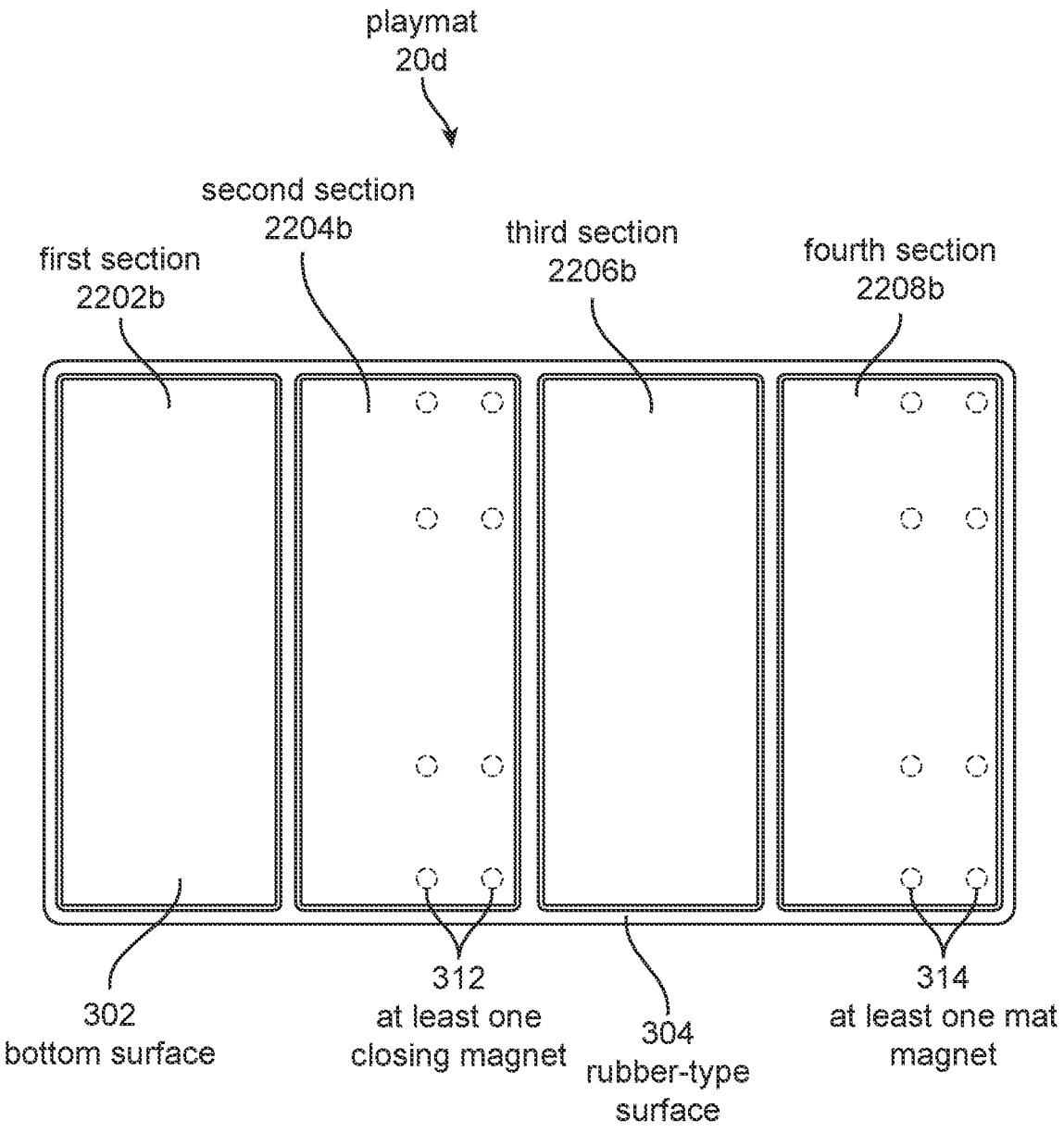
FIG. 23A illustrates a back view of an exemplary playmat.
Figure 23B:
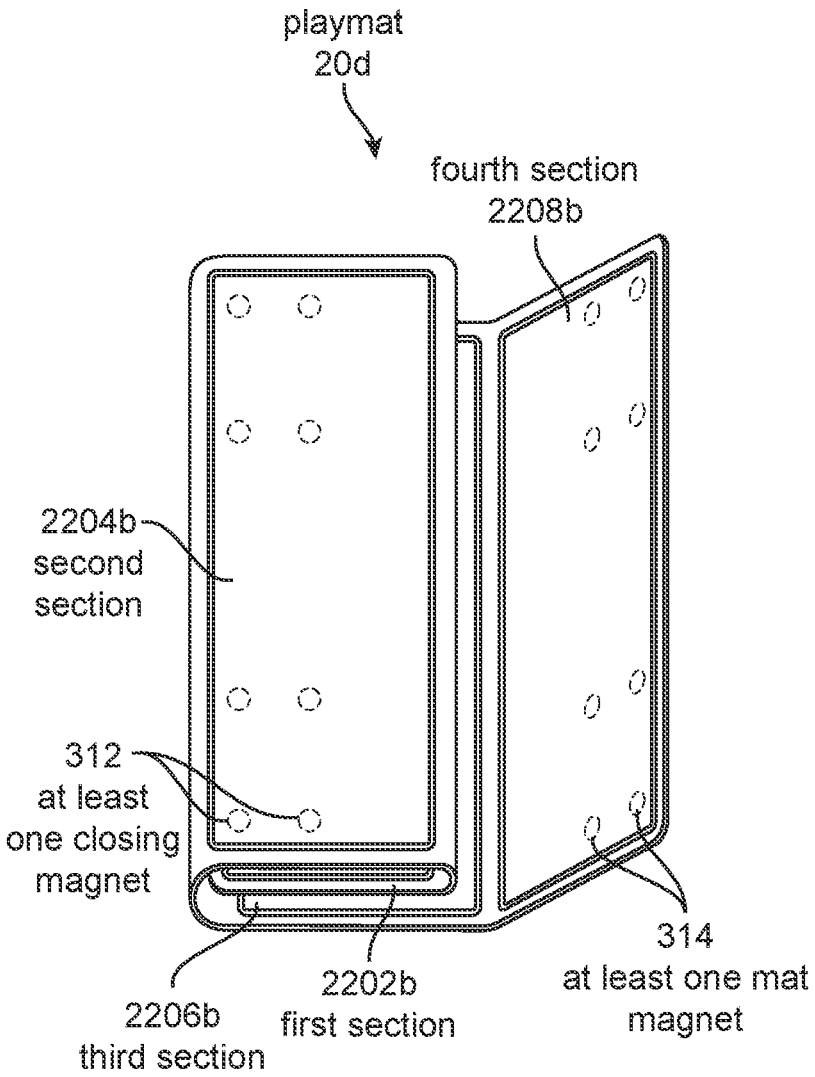
FIG. 23B illustrates a perspective view of the exemplary playmat of FIG. 23A being partially folded.
Figure 24A:
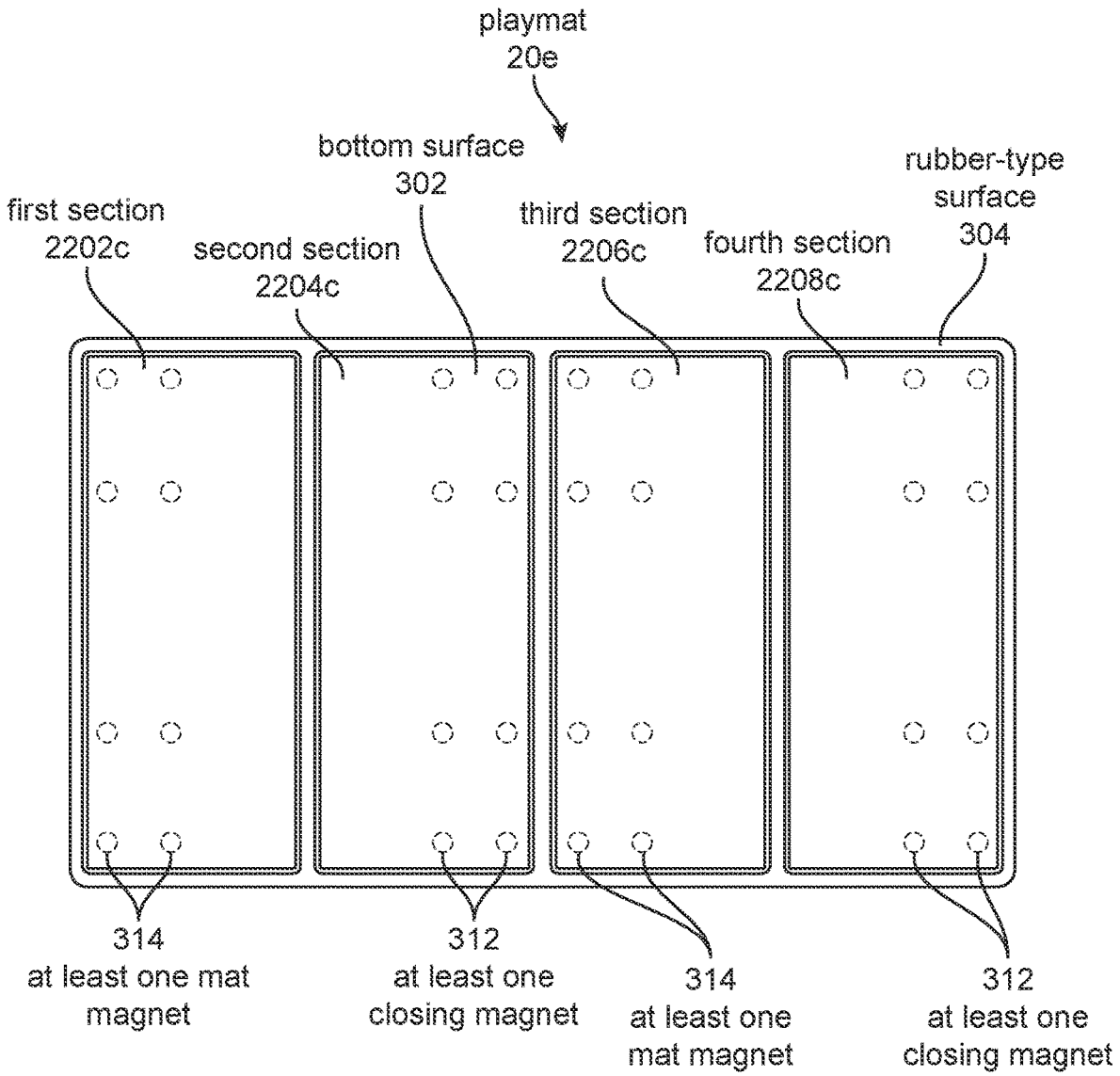
FIG. 24A illustrates a back view of an exemplary playmat.
Figure 24B:
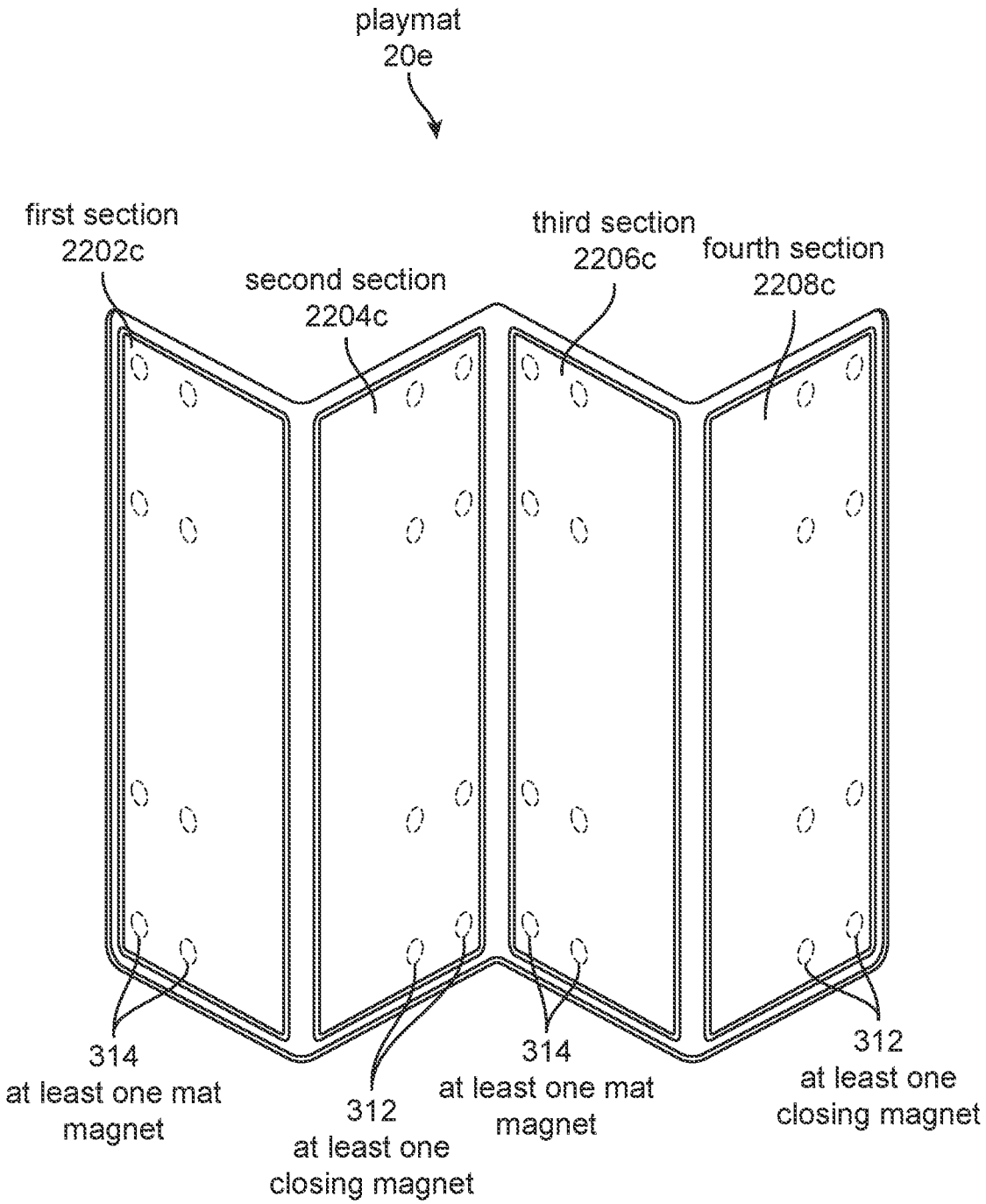
FIG. 24B illustrates a perspective view of the exemplary playmat of FIG. 24A being partially folded.

FIGS. 22A, 22B, 23A, 23B, 24A, 24B, and 25 illustrate example playmats 20 having four panels, or sections. Specifically, FIGS. 22A and 22B illustrate an exemplary playmat 20*c*, FIGS. 23A and 23B illustrate an exemplary playmat 20*d*, and FIGS. 24A and 24B illustrate an exemplary playmat 20*e*. FIG. 25A, which is a closed configuration of a four-panel playmat 20, may illustrate playmat 20*c*, playmat 20*d*, or playmat 20*e*, as all of these playmats 20 may appear the same when closed.

FIG. 22A illustrates a back view of exemplary playmat 20*c* having this four-paneled construction. The back view shows the bottom surface 302 as it may appear when the playmat 20*c* is laid flat. The bottom surface 302 may comprise a rubber-type surface 304. This rubber-type surface 304 helps to prevent slipping of the playmat 20*c* while in use. The front view of the playmat 20*c* may be very similar to the playmat 20 of FIG. 2, and as such, this view is not recreated here.

The four panels of the playmat 20*c* can be viewed on the bottom surface 302. This is because the top surface 202 may be constructed as such to prevent seeing the disconnects between distinct portions, allowing a smooth playing surface. The four panels of playmat 20*c* may include a first section 2202*a*, a second section 2204*a* adjacent to the first section 2202*a*, a third section 2206*a* adjacent to the second section 2204*a* along an edge opposite that of the first section 2202*a*, and a fourth section 2208*a* adjacent the third section 2206*a* along an edge opposite that of the second section 2204*a*.

The first section 2202*a* may include at least one closing magnet 312 within its construction, presented as hidden lines to indicate the closing magnets 312 are not flush or exposed from the surface of the first section 2202*a*. Similarly, the fourth section 2208*a* may include at least one mat magnet 314 within its construction, again presented as hidden lines to indicate that the mat magnets 314 are not flush or exposed from the surface of the fourth section 2208*a*. Eight closing magnets 312, as well as eight mat magnets 314 are shown in FIGS. 22A and 22B. However, the number of magnets present does not need to be exactly eight, nor does the number of closing magnets 312 need to match the number of mat magnets 314. Any number of magnets sufficient to magnetically couple components of the gameplay area system 10 to one another may be provided. This may be as few as one magnet, and up to as many magnets as may reasonably fit within the first section 2202*a* and the fourth section 2208*a* without interfering with one another. While not shown, in some examples magnetic strips may be present instead of or in addition to individual magnets.

As was described previously in FIGS. 9, 13, and 19, the magnets on both sides (the at least one closing magnet 312 and the at least one mat magnet 314) are broken into distinct sections—one section of four magnets near the top edge of the playmat 20*c*, and one section of four magnets near the bottom edge. These distinct sections are to facilitate coupling to the other distinct components of the gameplay area system 10 (i.e., the two-piece deck box 30, the dice-box 40, and the folding deck box 50). However, the number of sections need not be limited to two, and as few as one distinct section, or as many distinct sections as could reasonably fit within the confines of the playmat 20*c* may be included.

FIG. 22B illustrates the exemplary playmat 20*c* being folded for storage or transport from a perspective view. This view is shown from the front surface with the delineations between the first section 2202*a* and the second section 2204*a*, the second section 2204*a* and the third section 2206*a*, and the third section 2206*a* and the fourth section 2208*a* still drawn to facilitate visualization of the folding process.

As seen in FIG. 22B, the first section 2202*a* may fold over the second section 2204*a*, and the fourth section 2208*a* may fold over the third section 2206*a*, such that the first section 2202*a* and the fourth section 2208*a* are adjacent one another. Either from this position, or at approximately the same time as the previous folds, the second section 2204*a* and the third section 2206*a* may fold onto one another, causing the at least one closing magnet 312 and the at least one mat magnet 314 to approach one another, thus magnetically coupling or magnetically engaging. This will cause the first section 2202*a* and the fourth section 2208*a* to stay in place relative to one another, thus keeping the playmat 20*c* closed in the configuration shown in FIG. 25A.

FIG. 23A illustrates a back view of an exemplary playmat 20*d* having a similar four-paneled construction. The back view shows the bottom surface 302 as it may appear when the playmat 20*d* is laid flat. The bottom surface 302 may comprise a rubber-type surface 304. This rubber-type surface 304 helps to prevent slipping of the playmat 20*d* while in use. The front view of the playmat 20*d* may be very similar to the playmat 20 of FIG. 2, and as such, this view is not recreated here.

The four panels of the playmat 20*d* can be viewed on the bottom surface 302. This is because the top surface 202 may be constructed as such to prevent seeing the disconnects between distinct portions, allowing a smooth playing surface. The four panels of playmat 20*d* may include a first section 2202*b*, a second section 2204*b* adjacent to the first section 2202*b*, a third section 2206*b* adjacent to the second section 2204*b* along an edge opposite that of the first section 2202*b*, and a fourth section 2208*b* adjacent the third section 2206*b* along an edge opposite that of the second section 2204*b*.

The second section 2204*b* may include at least one closing magnet 312 within its construction, presented as hidden lines to indicate the closing magnets 312 are not flush or exposed from the surface of the first section 2202*b*. Similarly, the fourth section 2208*b* may include at least one mat magnet 314 within its construction, again presented as hidden lines to indicate that the mat magnets 314 are not flush or exposed from the surface of the fourth section 2208*b*. Eight closing magnets 312, as well as eight mat magnets 314 are shown in FIGS. 23A and 23B. However, the number of magnets present does not need to be exactly eight, nor does the number of closing magnets 312 need to match the number of mat magnets 314. Any number of magnets sufficient to magnetically couple components of the gameplay area system 10 to one another may be provided. This may be as few as one magnet, and up to as many magnets as may reasonably fit within the second section 2204*b* and the fourth section 2208*b* without interfering with one another. While not shown, in some examples magnetic strips may be present instead of or in addition to individual magnets.

As was described previously in FIGS. 9, 13, and 19, the magnets on both sides (the at least one closing magnet 312 and the at least one mat magnet 314) are broken into distinct sections—one section of four magnets near the top edge of the playmat 20*d*, and one section of four magnets near the bottom edge. These distinct sections are to facilitate coupling to the other distinct components of the gameplay area system 10 (i.e., the two-piece deck box 30, the dice-box 40, and the folding deck box 50). However, the number of sections need not be limited to two, and as few as one distinct section, or as many distinct sections as could reasonably fit within the confines of the playmat 20*d* may be included.

FIG. 23B illustrates the exemplary playmat 20*d* being folded for storage or transport from a perspective view. This view is shown from the front surface with the delineations between the first section 2202*b* and the second section 2204*b*, the second section 2204*b* and the third section 2206*b*, and the third section 2206*b* and the fourth section 2208*b* still drawn to facilitate visualization of the folding process.

As seen in FIG. 23B, the first section 2202*b* may fold over the second section 2204*b*, the second section 2204*b* may fold over the third section 2206*b*, and the third section 2206*b* may fold over the fourth section 2208*b* in such a manner as to position the fourth section 2208*b* on top of the second section 2204*b*.

Because the fourth section 2208*b* is now on top of, or planarly adjacent to the second section 2204*b*, the at least one closing magnet 312 and the at least one mat magnet 314 may magnetically couple or magnetically engage one another. This will cause the second section 2204*b* and the fourth section 2208*b* to stay in place relative to one another, thus keeping the playmat 20*d* closed in the configuration shown in FIG. 25A.

FIG. 24A illustrates a back view of an exemplary playmat 20*e* having another similar four-paneled construction. The back view shows the bottom surface 302 as it may appear when the playmat 20*e* is laid flat. The bottom surface 302 may comprise a rubber-type surface 304. This rubber-type surface 304 helps to prevent slipping of the playmat 20*e* while in use. The front view of the playmat 20*e* may be very similar to the playmat 20 of FIG. 2, and as such, this view is not recreated here.

The four panels of the playmat 20*e* can be viewed on the bottom surface 302. This is because the top surface 202 may be constructed as such to prevent seeing the disconnects between distinct portions, allowing a smooth playing surface. The four panels of playmat 20*e* may include a first section 2202*c*, a second section 2204*c* adjacent to the first section 2202*c*, a third section 2206*c* adjacent to the second section 2204*c* along an edge opposite that of the first section 2202*c*, and a fourth section 2208*c* adjacent the third section 2206*c* along an edge opposite that of the second section 2204*c*.

The first section 2202*c* may include at least one mat magnet 314 within its construction, presented as hidden lines to indicate the mat magnets 314 are not flush or exposed from the surface of the first section 2202*c*. The second section 2204*c* may include at least one closing magnet 312 within its construction, presented as hidden lines to indicate the closing magnets 312 are not flush or exposed from the surface of the second section 2204*c*. The third section 2206*c* may include at least one mat magnet 314 within its construction, presented as hidden lines to indicate the mat magnets 314 are not flush or exposed from the surface of the third section 2206*c*. Similarly, the fourth section 2208*c* may include at least one closing magnet 312 within its construction, again presented as hidden lines to indicate that the closing magnets 312 are not flush or exposed from the surface of the fourth section 2208*c*. Sixteen closing magnets 213, as well as sixteen mat magnets 314 are shown in FIGS. 24A and 24B. However, the number of magnets present does not need to be exactly sixteen, nor does the number of closing magnets 312 need to match the number of mat magnets 314. Any number of magnets sufficient to magnetically couple components of the gameplay area system 10 to one another may be provided. This may be as few as one magnet, and up to as many magnets as may reasonably fit within the first section 2202*c*, the second section 2204*c*, the third section 2206*c*, and the fourth section 2208*c* without interfering with one another.

As was described previously in FIGS. 9, 13, and 19, the magnets on both sides (the at least one closing magnet 312 and the at least one mat magnet 314) are broken into distinct sections—one section of four magnets near the top edge of the playmat 20*e*, and one section of four magnets near the bottom edge. These distinct sections are to facilitate coupling to the other distinct components of the gameplay area system 10 (i.e., the two-piece deck box 30, the dice-box 40, and the folding deck box 50). However, the number of sections need not be limited to two, and as few as one distinct section, or as many distinct sections as could reasonably fit within the confines of the playmat 20*e* may be included.

FIG. 24B illustrates the exemplary playmat 20*e* being folded for storage or transport from a perspective view. This view is shown from the front surface with the delineations between the first section 2202*c* and the second section 2204*c*, the second section 2204*c* and the third section 2206*c*, and the third section 2206*c* and the fourth section 2208*c* still drawn to facilitate visualization of the folding process.

As seen in FIG. 24B, the first section 2202*c* may fold over the second section 2204*c*. This folding action will cause the at least one mat magnet 314 in the first section 2202*c* to approach the at least one closing magnet 312 in the second section 2204*c*, thus magnetically coupling or magnetically engaging the first section 2202*c* to the second section 2204*c*. This will cause the first section 2202*c* and the second section 2204*c* to stay in place relative to one another.

Similarly, the fourth section 2208*c* may fold over the third section 2206*c*. This folding action will cause the at least one closing magnet 312 in the fourth section 2208*c* to approach the at least one mat magnet 314 in the third section 2206*c*, thus magnetically coupling or magnetically engaging the fourth section 2208*c* to the third section 2206*c*. This will cause the fourth section 2208*c* and the third section 2206*c* to stay in place relative to one another.

The second section 2204*c* may fold over the third section 2206*c* in a direction opposite the folds previously described. This folding action will cause the at least one closing magnet 312 in the second section 2204*c* to approach the at least one mat magnet 314 in the third section 2206*c*, thus magnetically coupling or magnetically engaging the second section 2204*c* to the third section 2206*c*. This will cause the second section 2204*c* and the third section 2206*c* to stay in place relative to one another. With all of the sections held in place through magnetic coupling or magnetic engagement, the playmat 20*e* may be kept closed in the configuration shown in FIG. 25A.

Figure 25A:
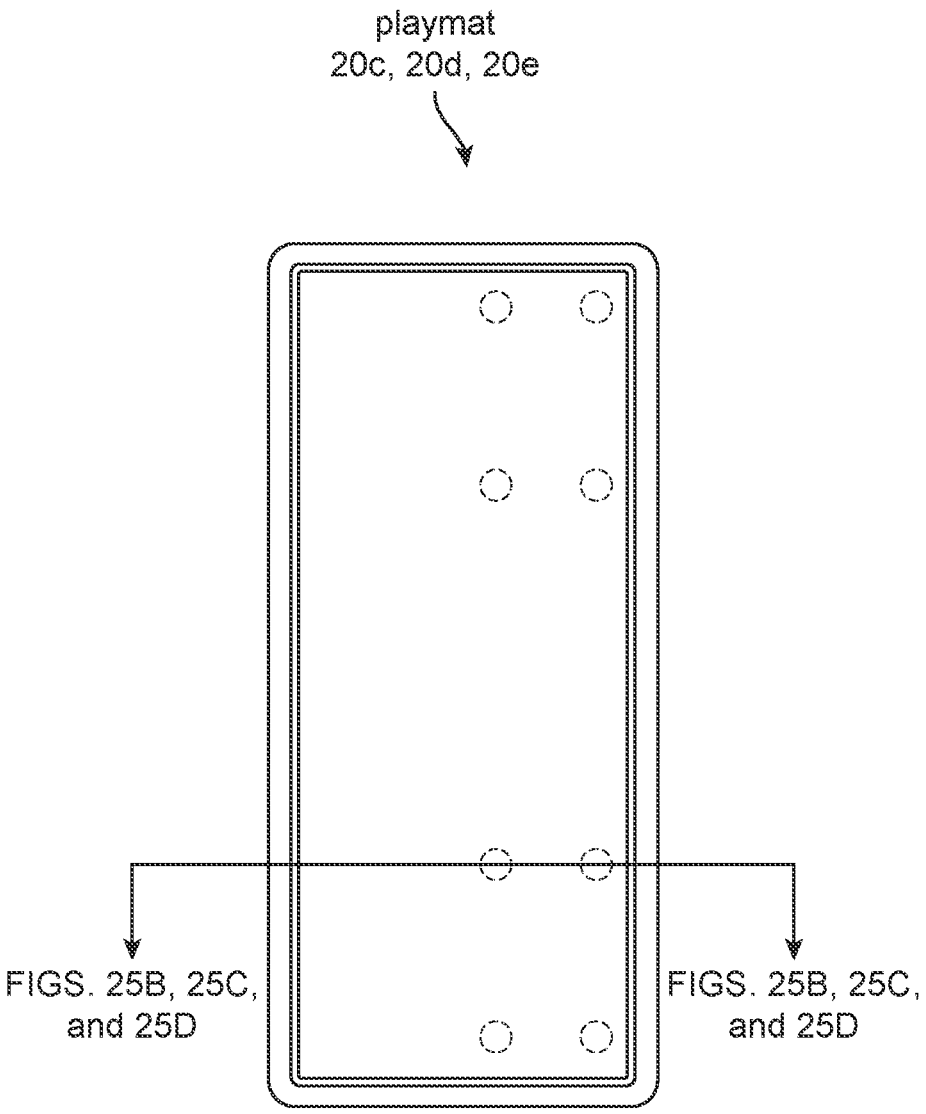
FIG. 25A illustrates a top view of the exemplary playmat of FIG. 22A, 23A, or 24A with the fold completed.

FIG. 25A illustrates a top view of the exemplary playmat 20*c* of FIG. 22A, the exemplary playmat 20*d* of FIG. 23A, or the exemplary playmat 20*e* of FIG. 24A with the fold completed. In this view, the at least one closing magnet 312 and the at least one mat magnet 314 are aligned (see FIGS. 25B, 25C, and 25D), and in this fully closed configuration they secure the section (or at least one section in the case of FIGS. 24A and 24B) containing the at least one closing magnet 312 to the section (or, again, the at least one section in the case of FIGS. 24A and 24B) containing the at least one mat magnet 314. This may prevent the playmat 20*c*, the playmat 20*d*, or the playmat 20*e* from opening without outside influence. In the cases of playmat 20*d* and playmat 20*e*, this exposes the at least one mat magnet 314 to the outside, which permits magnets described previously from the two-piece deck box 30, the dice-box 40, and the folding deck box 50 to magnetically couple to the section containing the at least one mat magnet 314.

Figure 25B:
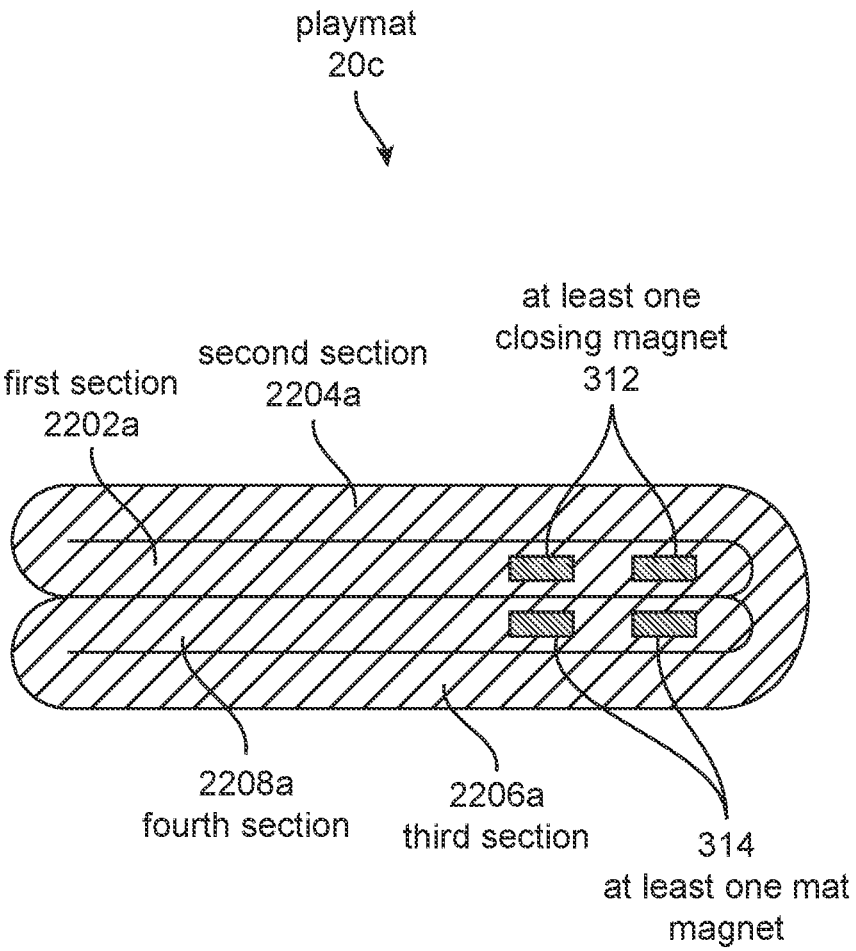
FIG. 25B illustrates a cross-sectional front view of the exemplary playmat of FIG. 22A.
Figure 25C:
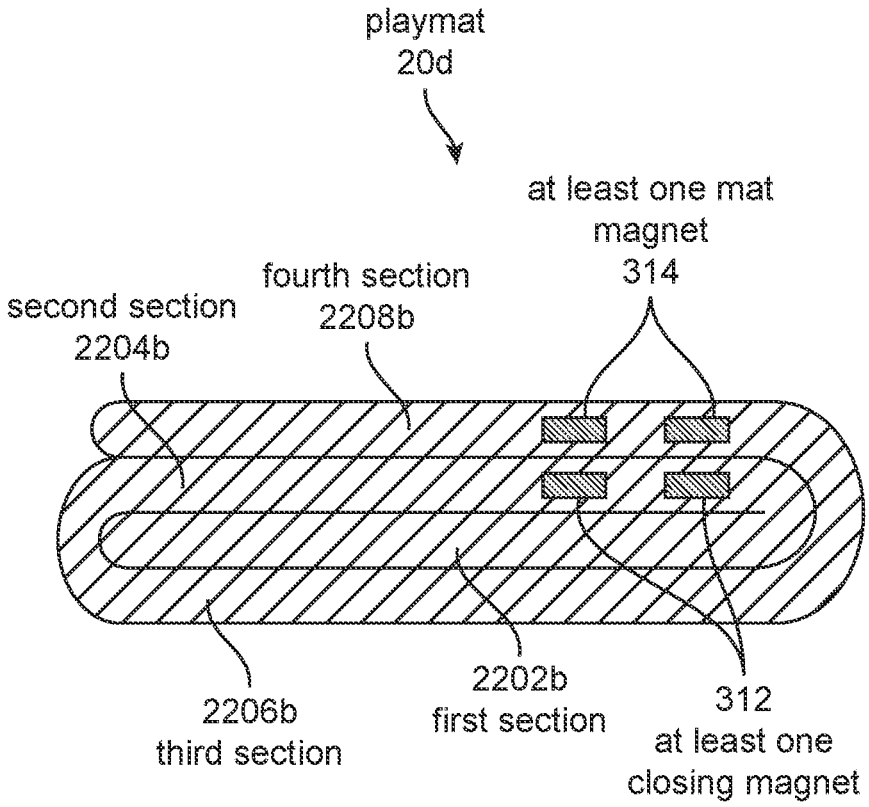
FIG. 25C illustrates a cross-sectional front view of the exemplary playmat of FIG. 23A.
Figure 25D:
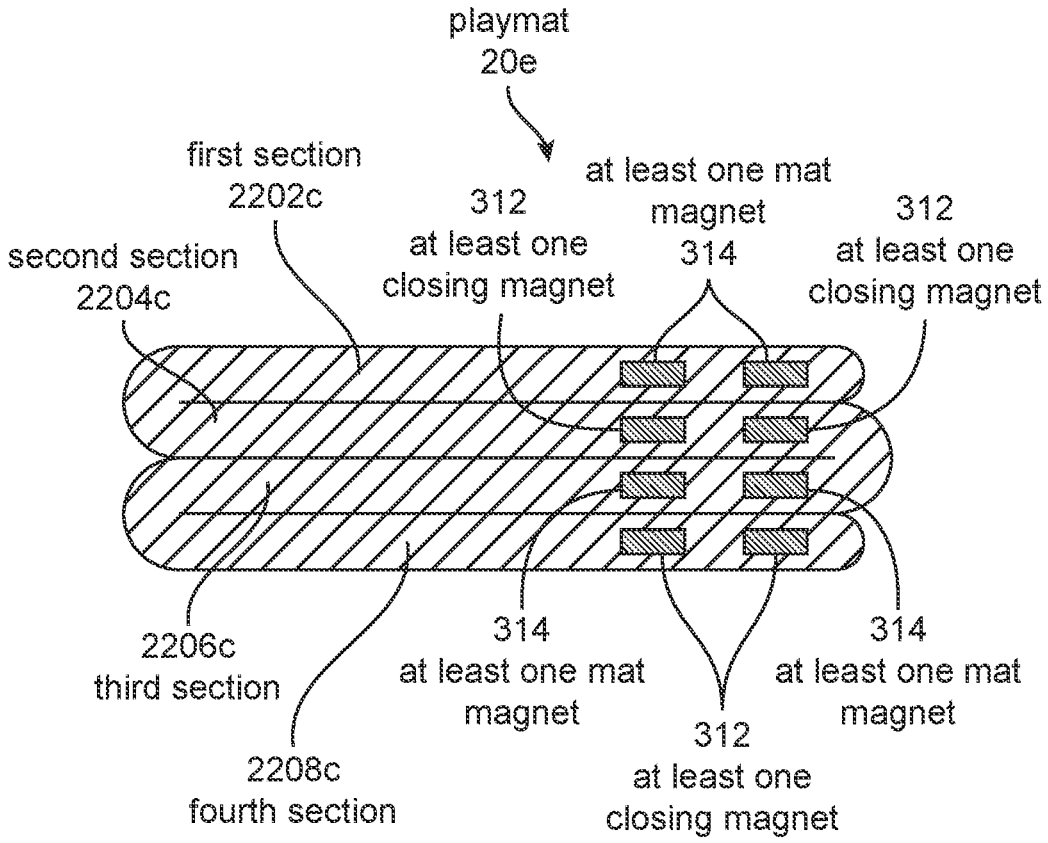
FIG. 25D illustrates a cross-sectional front view of the exemplary playmat of FIG. 24A.

FIGS. 25B, 25C, and 25D illustrate cross-sectional views of the playmat 20. Specifically, FIG. 25B shows the playmat 20*c* with the thicknesses of the first section 2202*a*, the second section 2204*a*, the third section 2206*a*, and the fourth section 2208*a* exaggerated for the purposes of illustrating the playmat 20*a* in its folded configuration. FIG. 25C shows the playmat 20*d* with the thicknesses of the first section 2202*b*, the second section 2204*b*, the third section 2206*b*, and the fourth section 2208*b* exaggerated for the purposes of illustrating the playmat 20*a* in its folded configuration. FIG. 25D shows the playmat 20*e* with the thicknesses of the first section 2202*c*, the second section 2204*c*, the third section 2206*c*, and the fourth section 2208*c* exaggerated for the purposes of illustrating the playmat 20*a* in its folded configuration.

Figure 26A:
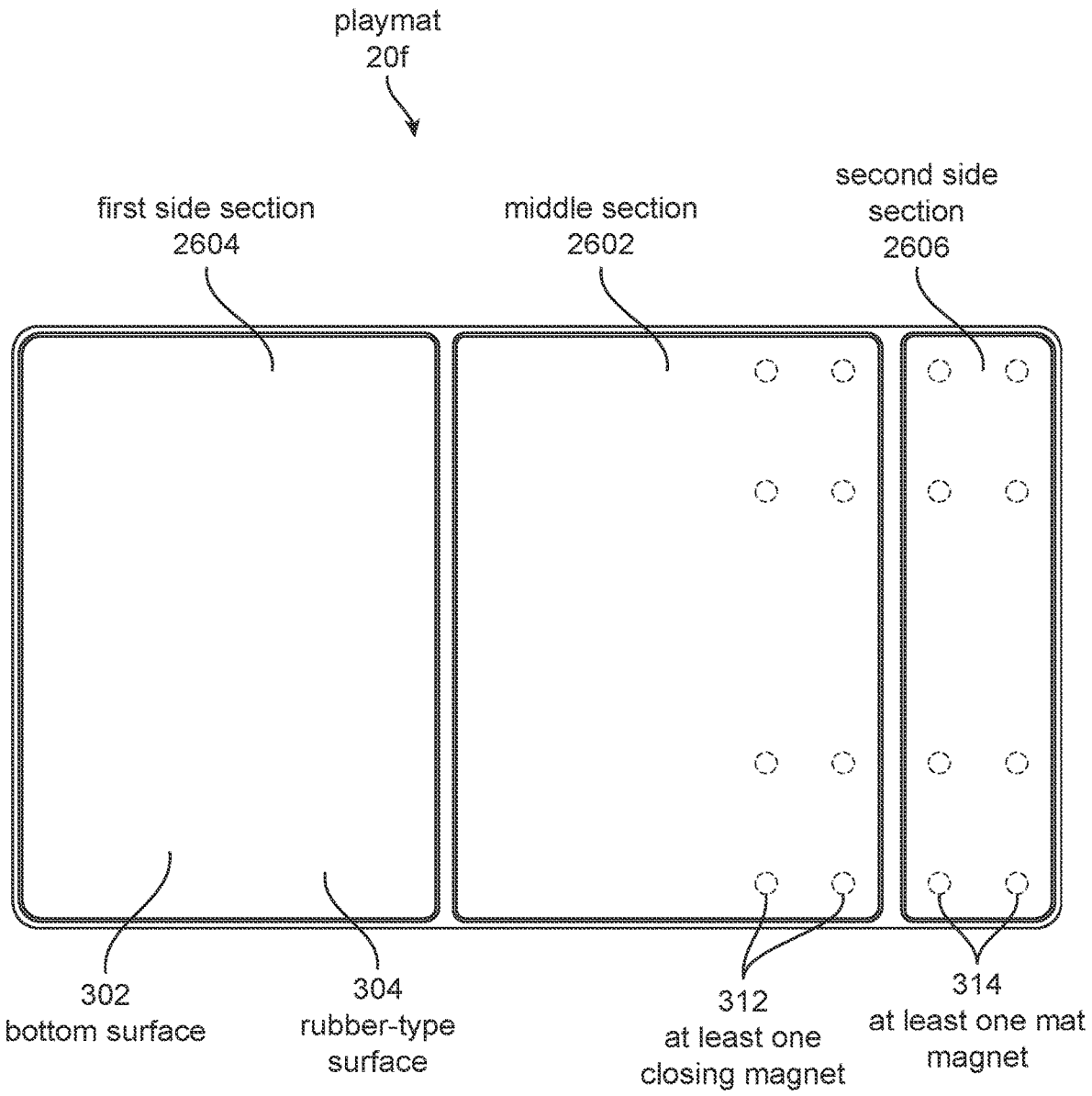
FIG. 26A illustrates a back view of an exemplary playmat.

FIG. 26A illustrates a back view of an exemplary playmat 20*f* having a similar construction to the playmat 20*a* of FIGS. 1-5C. The notable difference between playmat 20*f* and playmat 20*a* is the location of the at least one closing magnet 312. Where the at least one closing magnet in playmat 20*a* was on the first side section 308, the at least one closing magnet present in playmat 20*f* is on the middle section. The back view shows the bottom surface 302 as it may appear when the playmat 20*f* is laid flat. The bottom surface 302 may comprise a rubber-type surface 304. This rubber-type surface 304 helps to prevent slipping of the playmat 20*f* while in use. The front view of the playmat 20*f* may be very similar to the playmat 20 of FIG. 2, and as such, this view is not recreated here.

The three panels of the playmat 20*f* can be viewed on the bottom surface 302. This is because the top surface 202 may be constructed as such to prevent seeing the disconnects between distinct portions, allowing a smooth playing surface. The three panels of playmat 20*f* may include a middle section 2602, a first side section 2604 adjacent to the middle section 2602, and a second side section 2606 adjacent to the middle section 2602 along an edge opposite that of the first side section 2604.

Figure 26B:
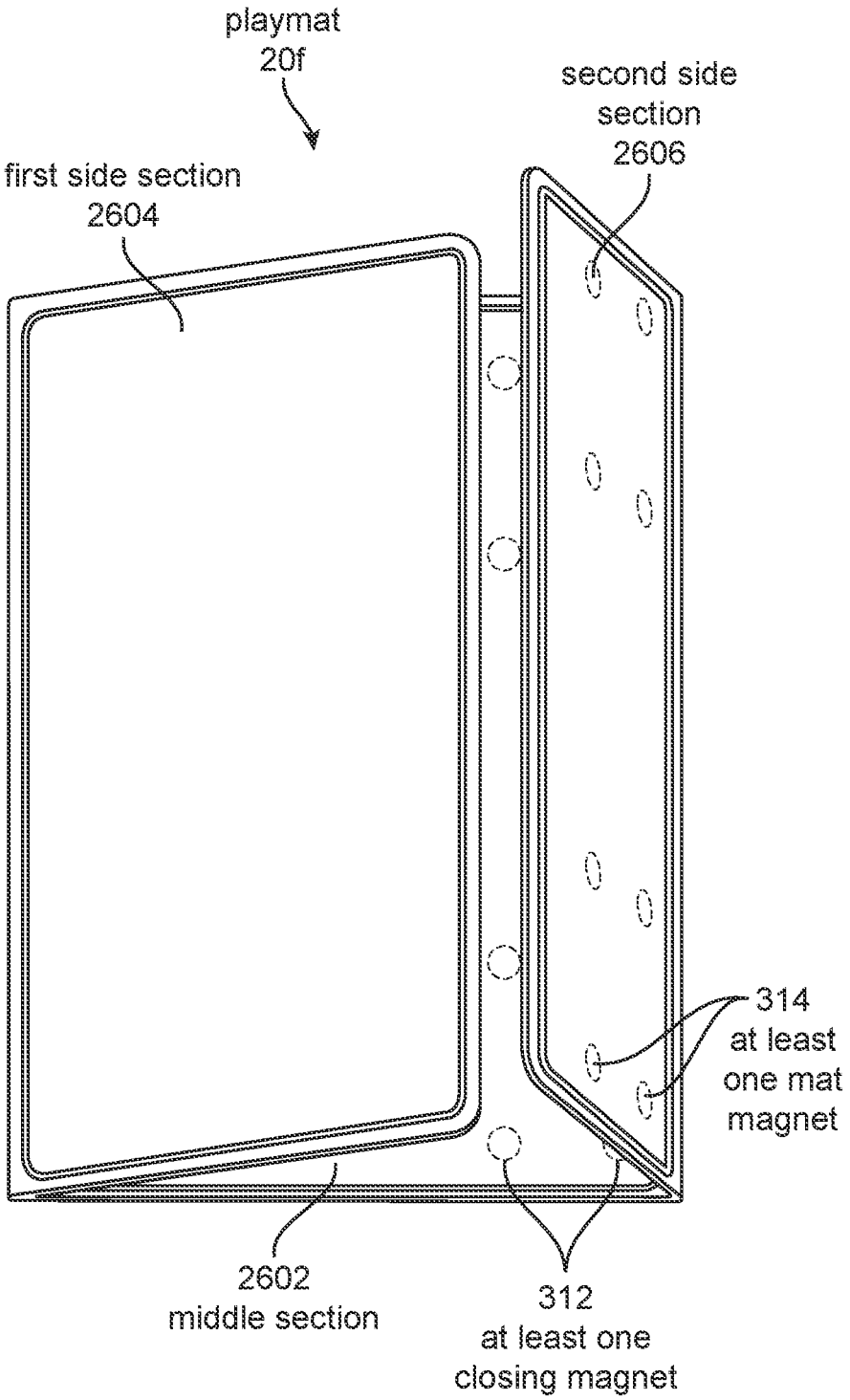
FIG. 26B illustrates a perspective view of the exemplary playmat of FIG. 26A being partially folded.

The middle section 2602 may include at least one closing magnet 312 within its construction, presented as hidden lines to indicate the closing magnets 312 are not flush or exposed from the surface of the middle section 2602. The second side section 2606 may include at least one mat magnet 314 within its construction, presented as hidden lines to indicate the mat magnets 314 are not flush or exposed from the surface of the second side section 2606. Eight closing magnets 312 as well as eight mat magnets 314 are shown in FIGS. 26A and 26B. However, the number of magnets present does not need to be exactly eight, nor does the number of closing magnets 312 need to match the number of mat magnets 314. Any number of magnets sufficient to magnetically couple components of the gameplay area system 10 to one another may be provided. This may be as few as one magnet, and up to as many magnets as may reasonably fit within the middle section 2602 and the second side section 2606 without interfering with one another.

As was described previously in FIGS. 9, 13, and 19, the magnets on both sides (the at least one closing magnet 312 and the at least one mat magnet 314) are broken into distinct sections—one section of four magnets near the top edge of the playmat 20*f*, and one section of four magnets near the bottom edge. These distinct sections are to facilitate coupling to the other distinct components of the gameplay area system 10 (i.e., the two-piece deck box 30, the dice-box 40, and the folding deck box 50). However, the number of sections need not be limited to two, and as few as one distinct section, or as many distinct sections as could reasonably fit within the confines of the playmat 20*f* may be included.

FIG. 26B illustrates the exemplary playmat 20*f* being folded for storage or transport from a perspective view. As seen in FIG. 26B, the first side section 2604 may fold over the middle section 2602, prior to the second side section 2606 folding over the top of both the middle section 2602 and the first side section 2604. In this example, the present magnets are strong enough that an extra layer of playmat does not impede the magnetic coupling of the middle section 2602 and the second side section 2606. With all of the sections held in place through magnetic coupling or magnetic engagement, the playmat 20*f* may be kept closed in the configuration shown in FIG. 27A.

Figure 27A:
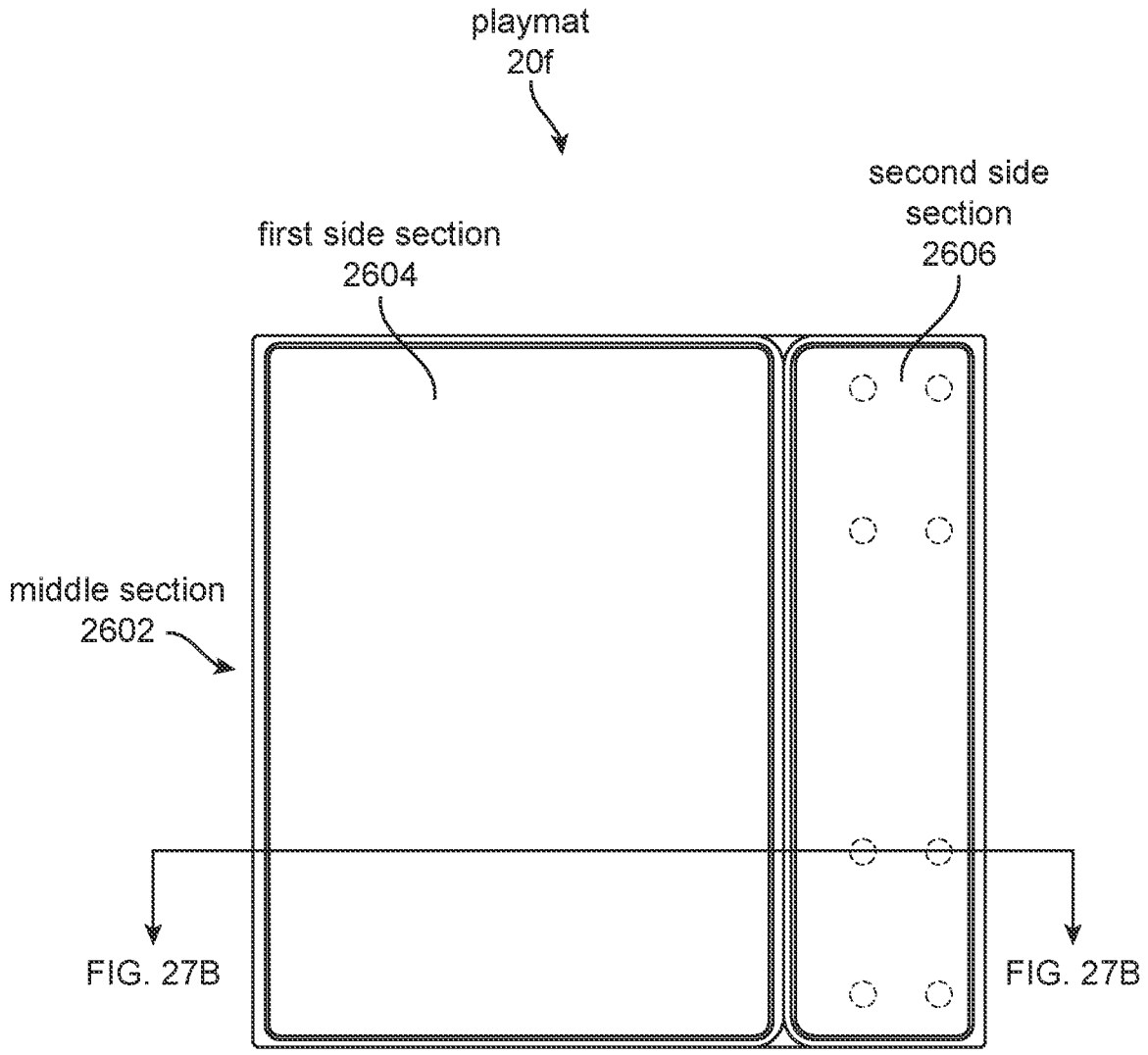
FIG. 27A illustrates a top view of the exemplary playmat of FIG. 26A with the fold completed.
Figure 27B:
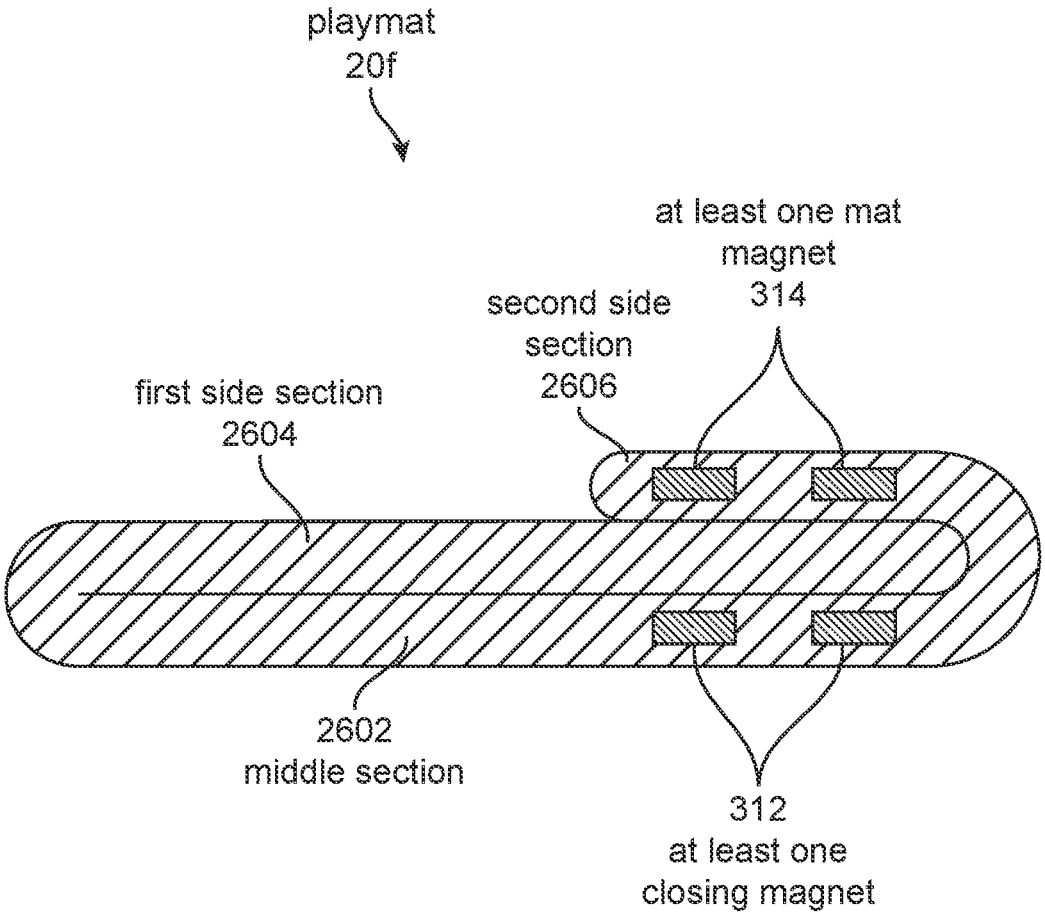
FIG. 27B illustrates a cross-sectional front view of the exemplary playmat of FIG. 26A.

FIG. 27A illustrates a top view of the playmat 20*f* after the fold has been completed. FIG. 27B illustrates a cross-sectional front view of the exemplary playmat of the playmat 20*f* with the thicknesses of the middle section 2602, the first side section 2604, and the second side section 2606 exaggerated for the purposes of illustrating the playmat 20*f* in its folded configuration. In this view, the at least one closing magnet 312 and the at least one mat magnet 314 are aligned, and in this fully closed configuration they secure the second side section 2606 to the middle section 2602. This may prevent the playmat 20*f* from opening without outside influence. This also exposes the at least one mat magnets 314 present in the second side section 2606 to the outside, which permits magnets described previously from the two-piece deck box 30, the dice-box 40, and the folding deck box 50 to magnetically couple to this second side section 2606. Because of the nature of the presented playmat 20*f* having exposed magnets on either section, the at least one closing magnet 312 may perform in the same manner as the at least one mat magnet 314 in the sense that, if it were so desired, the two-piece deck box 30, the dice-box 40, and the folding deck box 50 may be magnetically coupled to the middle section 2602 through these at least one closing magnets 312.

Figure 28A:
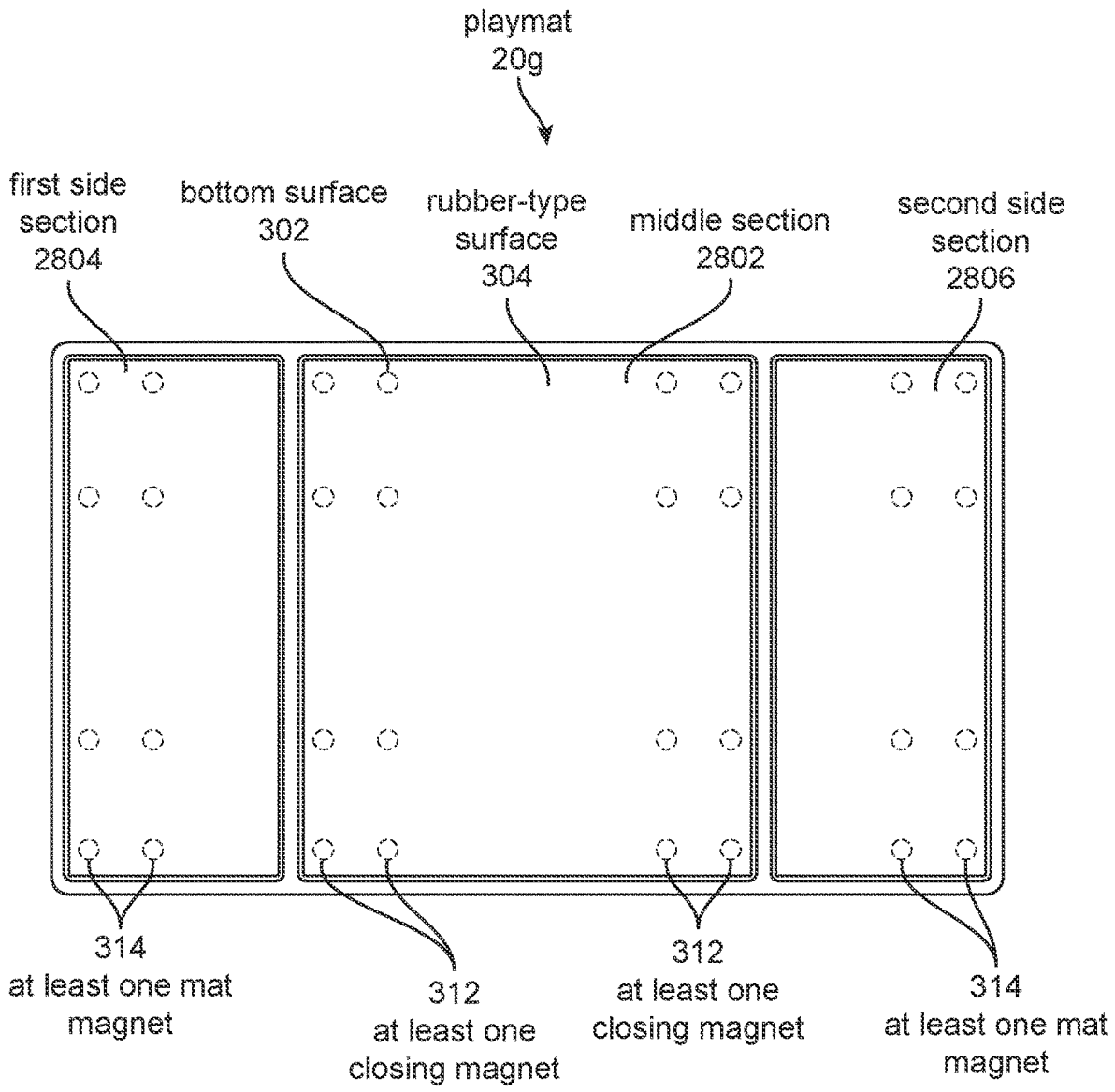
FIG. 28A illustrates a back view of an exemplary playmat.

FIG. 28A illustrates a back view of an exemplary playmat 20*g*. The back view shows the bottom surface 302 as it may appear when the playmat 20*f* is laid flat. The bottom surface 302 may comprise a rubber-type surface 304. This rubber-type surface 304 helps to prevent slipping of the playmat 20*g* while in use. The front view of the playmat 20*f* may be very similar to the playmat 20 of FIG. 2, and as such, this view is not recreated here.

The three panels of the playmat 20*g* can be viewed on the bottom surface 302. This is because the top surface 202 may be constructed as such to prevent seeing the disconnects between distinct portions, allowing a smooth playing surface. The three panels of playmat 20*g* may include a middle section 2802, a first side section 2804 adjacent to the middle section 2802, and a second side section 2806 adjacent to the middle section 2802 along an edge opposite that of the first side section 2604.

Figure 28B:
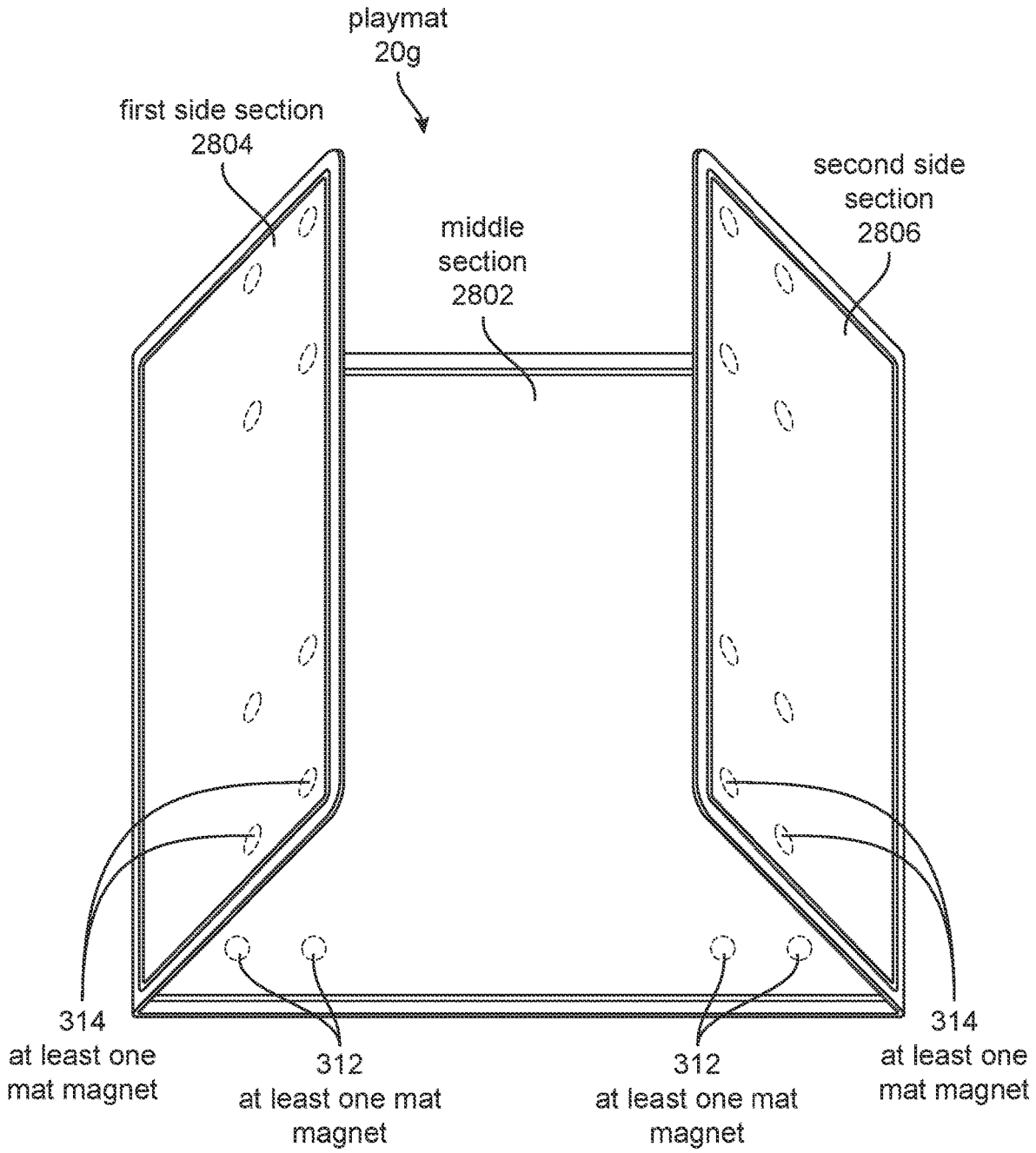
FIG. 28B illustrates a perspective view of the exemplary playmat of FIG. 28A being partially folded.

The middle section 2802 may include at least one closing magnet 312 within its construction, presented as hidden lines to indicate the closing magnets 312 are not flush or exposed from the surface of the middle section 2802. Dissimilar to previous examples of three-paneled playmats 20 (20*a* and 20*f*), the middle section 2802 may include at least one closing magnet near either edge that is adjacent to the first side section 2804 and the second side section 2806, to allow magnetic coupling to both of these panels. The first side section 2804 may include at least one mat magnet 314 within its construction, presented as hidden lines to indicate the mat magnets 314 are not flush or exposed from the surface of the first side section 2804. Likewise, the second side section 2806 may include at least one mat magnet 314 within its construction, presented as hidden lines to indicate the mat magnets 314 are not flush or exposed from the surface of the second side section 2806. Sixteen closing magnets 312 as well as sixteen mat magnets 314 are shown in FIGS. 28A and 28B. However, the number of magnets present does not need to be exactly sixteen, nor does the number of closing magnets 312 need to match the number of mat magnets 314. Any number of magnets sufficient to magnetically couple components of the gameplay area system 10 to one another may be provided. This may be as few as one magnet, and up to as many magnets as may reasonably fit within the middle section 2802, the first side section 2804, and the second side section 2806 without interfering with one another.

As was described previously in FIGS. 9, 13, and 19, the magnets on both sides (the at least one closing magnet 312 and the at least one mat magnet 314) are broken into distinct sections—one section of four magnets near the top edge of the playmat 20*g*, and one section of four magnets near the bottom edge. These distinct sections are to facilitate coupling to the other distinct components of the gameplay area system 10 (i.e., the two-piece deck box 30, the dice-box 40, and the folding deck box 50). However, the number of sections need not be limited to two (for instance, middle section 2802 in FIGS. 28A and 28B displays four such sections), and as few as one distinct section, or as many distinct sections as could reasonably fit within the confines of the playmat 20*g* may be included.

FIG. 28B illustrates the exemplary playmat 20*g* being folded for storage or transport from a perspective view. As seen in FIG. 28B, the first side section 2804 and the second side section 2806 may both fold over the middle section 2802 without interfering with one another. In this example, the order of folds is unimportant. With all of the sections held in place through magnetic coupling or magnetic engagement, the playmat 20*g* may be kept closed in the configuration shown in FIG. 28A.

Figure 29A:
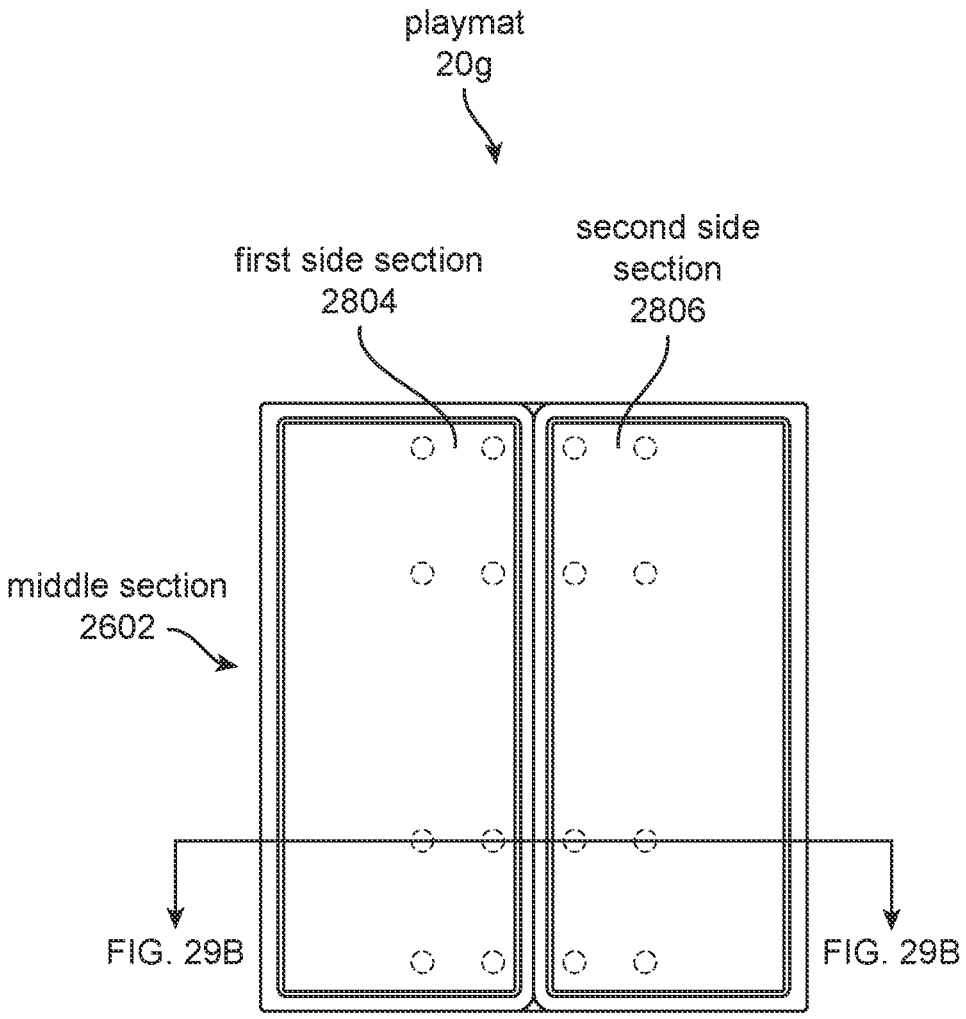
FIG. 29A illustrates a top view of the exemplary playmat of FIG. 28A with the fold completed.
Figure 29B:
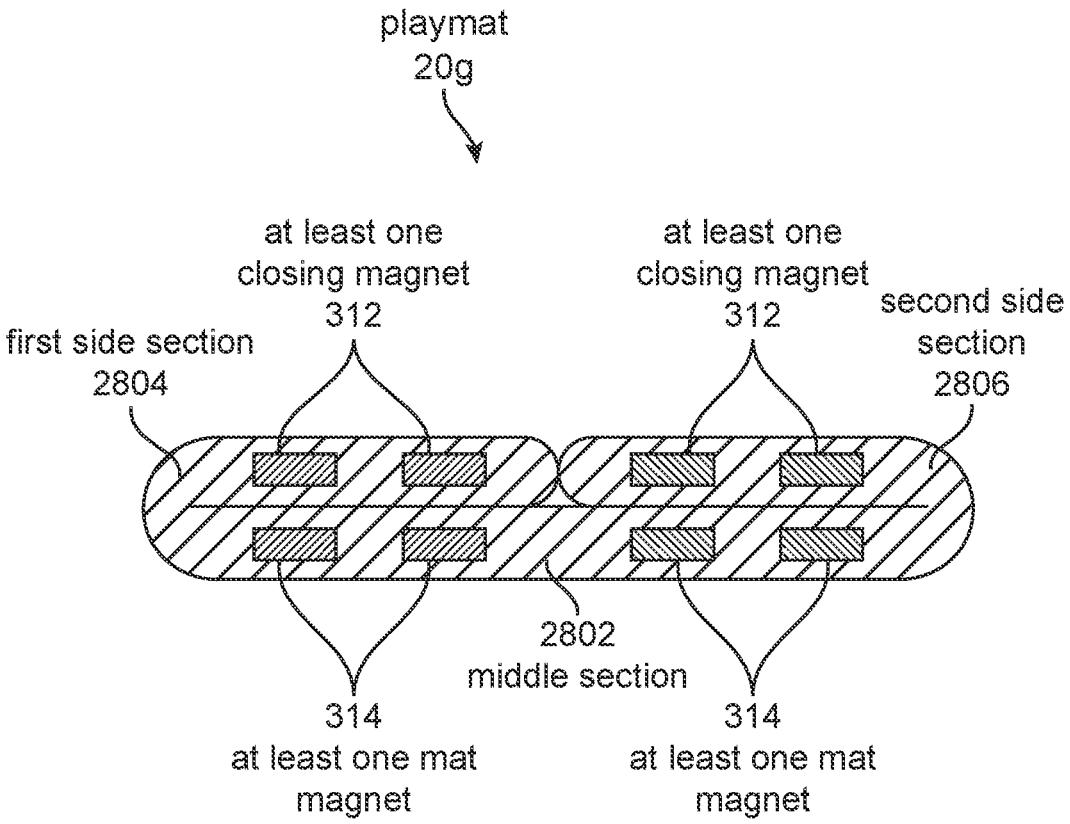
FIG. 29B illustrates a cross-sectional front view of the exemplary playmat of FIG. 28A.

FIG. 29A illustrates a top view of the playmat 20*g* after the fold has been completed. FIG. 29B illustrates a cross-sectional front view of the exemplary playmat of the playmat 20*g* with the thicknesses of the middle section 2802, the first side section 2804, and the second side section 2806 exaggerated for the purposes of illustrating the playmat 20*g* in its folded configuration. In this view, the at least one closing magnet 312 and the at least one mat magnet 314 are aligned along both sides of the middle section 2802. In this fully closed configurations, the present magnets secure the first side section 2804, as well as the second side section 2806, to the middle section 2802. This may prevent the playmat 20*g* from opening without outside influence. This also exposes the at least one mat magnets 314 present in the first side section 2804 and the second side section 2806 to the outside, which permits magnets described previously from the two-piece deck box 30, the dice-box 40, and the folding deck box 50 to magnetically couple to the first side section 2804 and the second side section 2806. Because the playmat 20*g*, while closed, has exposed magnets on either section, the at least one closing magnet 312 may perform in the same manner as the at least one mat magnet 314 in the sense that, if it were so desired, the two-piece deck box 30, the dice-box 40, and the folding deck box 50 may be magnetically coupled to the middle section 2802 through these at least one closing magnets 312.

Throughout the preceding disclosure, it is understood that in examples where the at least one closing magnet 312 is not specifically described as being capable of magnetically coupling to the two-piece deck box 30, the dice-box 40, and the folding deck box 50, the use of more powerful magnets may still permit these magnetic couplings.

Interpretation

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

What is claimed is:

1. A gameplay area system, comprising:

a playmat, comprising:

a first section comprising a closing magnet; and a second section rotatably coupled to the first section enabling the second section to fold over the first section, the second section comprising a mat magnet, wherein the mat magnet is configured to magnetically couple to the closing magnet while the second section is folded over the first section, and wherein when the playmat lays in an open position, the playmat comprises a top surface and a bottom surface opposite the top surface; and a folding deck box sized to retain at least one playing card, the folding deck box comprising:

a bottom wall;

a left side wall coupled to the bottom wall, the left side wall perpendicular to the bottom wall;

a right side wall coupled to the bottom wall, the right side wall perpendicular to the bottom wall, and the right side wall opposite the left side wall;

a back wall coupled to the bottom wall, the left side wall, and the right side wall, the back wall perpendicular to the bottom wall, the left side wall, and the right side wall;

a back magnet disposed within the back wall, the back magnet configured to magnetically couple to the mat magnet;

a front wall coupled to the bottom wall, the left side wall, and the right side wall, the front wall perpendicular to the bottom wall, the left side wall, and the right side wall, and the front wall opposite the back wall; and a flap comprising:

a back portion rotatably coupled to the back wall;

a top portion rotatably coupled to the back portion;

a front portion rotatably coupled to the top portion; and a bottom portion rotatably coupled to the front portion.

2. The gameplay area system of claim 1, the folding deck box further comprising:

a flap magnet disposed within the bottom portion; and a bottom magnet disposed within the bottom wall, wherein the flap magnet is configured to magnetically couple to the bottom magnet.

3. The gameplay area system of claim 1, wherein the front portion of the flap comprises a feature selected from the group consisting of a window, optical translucency, optical transparency, and optical opacity.

4. The gameplay area system of claim 1, wherein the bottom surface comprises a rubber backer configured to prevent the playmat from slipping from a surface.

5. The gameplay area system of claim 1, wherein the top surface comprises a cloth surface configured to facilitate sliding of an object across the top surface.

6. The gameplay area system of claim 1, wherein the mat magnet covers at least a portion of an edge of the second section, and wherein the closing magnet covers at least a portion an edge of the first section.

7. A gameplay area system, comprising:

a playmat, comprising:

a first section comprising a closing magnet; and a second section rotatably coupled to the first section enabling the second section to fold over the first section, the second section comprising a mat magnet, wherein the mat magnet is configured to magnetically couple to the closing magnet while the second section is folded over the first section, and wherein when the playmat lays in an open position, the playmat comprises a top surface and a bottom surface opposite the top surface; and a two-piece deck box sized to retain at least one playing card, the two-piece deck box comprising;

a top section, comprising:

a top wall;

a top section front wall coupled to the top wall, the top section front wall perpendicular to the top wall;

a top section back wall coupled to the top wall, the top section back wall perpendicular to the top wall, wherein the top section back wall is parallel to the top section front wall;

a first top section side wall coupled to the top wall, the top section front wall, and the top section back wall, the first top section side wall perpendicular to the top wall, the top section front wall, and the top section back wall; and a second top section side wall coupled to the top wall, the top section front wall, and the top section back wall, the second top section side wall perpendicular to the top wall, the top section front wall, and the top section back wall, wherein the second top section side wall is parallel to the first top section side wall, wherein a top magnet is disposed within a wall selected from the group consisting of the top section front wall, the top section back wall, the first top section side wall, and the second top section side wall, and wherein the top magnet is configured to magnetically couple to the mat magnet; and a bottom section, comprising:

a bottom wall;

a bottom section front wall coupled to the bottom wall, the bottom section front wall perpendicular to the top wall;

a bottom section back wall coupled to the bottom wall, the bottom section back wall perpendicular to the bottom wall, wherein the bottom section back wall is parallel to the bottom section front wall;

a first bottom section side wall coupled to the bottom wall, the bottom section front wall, and the bottom section back wall, the first bottom section side wall perpendicular to the bottom wall, the bottom section front wall, and the bottom section back wall; and a second bottom section side wall coupled to the bottom wall, the bottom section front wall, and the bottom section back wall, the second bottom section side wall perpendicular to the bottom wall, the bottom section front wall, and the bottom section back wall, wherein the second bottom section side wall is parallel to the first bottom section side wall, wherein a bottom magnet is disposed within a wall selected from the group consisting of the bottom section front wall, the bottom section back wall, the first bottom section side wall, and the second bottom section side wall, and wherein the bottom magnet is configured to magnetically couple to the mat magnet.

8. The gameplay area system of claim 7, wherein the top section is configured to detachably couple to the bottom section.

9. The gameplay area system of claim 7, wherein:

the bottom section front wall further comprises a bottom section front inset lip, the bottom section back wall further comprises a bottom section back inset lip, the first bottom section side wall further comprises a first bottom section side inset lip, and the second bottom section side wall further comprises a second bottom section side inset lip.

10. The gameplay area system of claim 9, wherein:

the top section front wall is configured to receive the bottom section front inset lip, the top section back wall is configured to receive the bottom section back inset lip, the first top section side wall is configured to receive the first bottom section side inset lip, and the second top section side wall is configured to receive the second bottom section side inset lip.

11. The gameplay area system of claim 10, wherein:

an inset lip selected from the group consisting of the bottom section front inset lip, the bottom section back inset lip, the first bottom section side inset lip, and the second bottom section side inset lip further comprises a male snap fixture, and a wall selected from the top section front wall, the top section back wall, the first top section side wall, and the second top section side wall further comprises a female snap fixture configured to receive the male snap fixture in a corresponding location.

12. The gameplay area system of claim 7, wherein the bottom surface comprises a rubber backer configured to prevent the playmat from slipping from a surface.

13. The gameplay area system of claim 7, wherein the top surface comprises a cloth surface configured to facilitate sliding of an object across the top surface.

14. The gameplay area system of claim 7, wherein the mat magnet covers at least a portion of an edge of the second section, and wherein the closing magnet covers at least a portion an edge of the first section.

15. A gameplay area system, comprising:

a playmat, the playmat comprising:

a first section comprising a closing magnet; and a second section rotatably coupled to the first section enabling the second section to fold over the first section, the second section comprising a mat magnet, wherein the mat magnet is configured to magnetically couple to the closing magnet while the second section is folded over the first section, and wherein when the playmat lays in an open position, the playmat comprises a top surface and a bottom surface opposite the top surface; and a dice-box sized to retain at least one die, the dice-box comprising:

an inner compartment comprising:

an inner bottom wall;

an inner front wall coupled to the inner bottom wall, the inner front wall perpendicular to the inner bottom wall;

an inner back wall coupled to the inner bottom wall opposite the inner front wall, the inner back wall perpendicular to the inner bottom wall;

a first inner side wall coupled to the inner bottom wall, the inner front wall, and the inner back wall, the first inner side wall perpendicular to the inner bottom wall, the inner front wall, and the inner back wall; and a second inner side wall coupled to the inner bottom wall, the inner front wall opposite the first inner side wall, and the inner back wall opposite the first inner side wall, the second inner side wall perpendicular to the inner bottom wall, the inner front wall, and the inner back wall; and an outer compartment sized to retain the inner compartment, the outer compartment comprising:

an outer bottom wall;

an outer bottom magnet disposed within the outer bottom wall, the outer bottom magnet configured to couple to the mat magnet;

an outer back wall coupled to the outer bottom wall and perpendicular to the outer bottom wall;

a first outer side wall coupled to the outer bottom wall and the outer back wall, the first outer side wall perpendicular to the outer bottom wall and the outer back wall;

a second outer side wall coupled to the outer bottom wall opposite the first outer side wall and the outer back wall opposite the first outer side wall, the second outer side wall perpendicular to the outer bottom wall and the outer back wall; and an outer top wall coupled to the outer back wall opposite the outer bottom wall, the first outer side wall opposite the outer bottom wall, and the second outer side wall opposite the outer bottom wall, the outer top wall perpendicular to the outer back wall, the first outer side wall, and the second outer side wall.

16. The gameplay area system of claim 15, wherein the inner bottom wall further comprises an inner bottom magnet configured to magnetically couple to the outer bottom magnet.

17. The gameplay area system of claim 16, wherein the outer top wall further comprises an outer top magnet configured to magnetically couple to the mat magnet.

18. The gameplay area system of claim 15, wherein the bottom surface comprises a rubber backer configured to prevent the playmat from slipping from a surface.

19. The gameplay area system of claim 15, wherein the top surface comprises a cloth surface configured to facilitate sliding of an object across the top surface.

20. The gameplay area system of claim 15, wherein the mat magnet covers at least a portion of an edge of the second section, and wherein the closing magnet covers at least a portion an edge of the first section.

* * * * *